US005993356A

United States Patent [19]

Houston et al.

[11] Patent Number: 5,993,356

[45] Date of Patent: Nov. 30, 1999

[54] FORCE GENERATION AND CONTROL SYSTEM FOR AN EXERCISE MACHINE

[75] Inventors: Randie M. Houston; Thomas E. Houston, both of Fairfax, Va.

[73] Assignee: Houston Enterprises, Inc., Fairfax, Va.

[21] Appl. No.: 08/778,004

[22] Filed: Dec. 31, 1996

[51] Int. Cl.[6] ..... A63B 21/005

[52] U.S. Cl. ..... 482/4; 482/6; 482/7; 482/9

[58] Field of Search ..... 482/1–9, 51, 52, 482/54, 129, 130, 900–903

[56] References Cited

U.S. PATENT DOCUMENTS

| | | |
|---|---|---|
| 3,465,592 | 9/1969 | Perrine . |
| 4,620,703 | 11/1986 | Greenhut . |
| 4,635,933 | 1/1987 | Schnell . |
| 4,746,113 | 5/1988 | Kissel . |
| 4,828,257 | 5/1989 | Dyer et al. . |
| 4,907,795 | 3/1990 | Shaw et al. . |
| 4,907,797 | 3/1990 | Gezari et al. . |
| 4,912,638 | 3/1990 | Pratt, Jr. . |
| 4,930,770 | 6/1990 | Baker . |
| 5,015,926 | 5/1991 | Casler . |
| 5,020,794 | 6/1991 | Englehardt et al. . |
| 5,117,170 | 5/1992 | Keane et al. . |
| 5,131,895 | 7/1992 | Rogers, Jr. . |
| 5,135,447 | 8/1992 | Robards et al. . |
| 5,151,071 | 9/1992 | Jain et al. . |
| 5,186,695 | 2/1993 | Mangseth et al. . |
| 5,201,772 | 4/1993 | Maxwell . |
| 5,230,672 | 7/1993 | Brown et al. . |
| 5,308,303 | 5/1994 | Rawls et al. . |
| 5,310,394 | 5/1994 | Kallios . |
| 5,312,313 | 5/1994 | Holmes et al. . |
| 5,328,429 | 7/1994 | Potash et al. . |
| 5,387,170 | 2/1995 | Rawls et al. . |
| 5,624,353 | 4/1997 | Naidus ..... 482/5 |
| 5,697,869 | 12/1997 | Ehrenfried et al. ..... 482/6 |

*Primary Examiner*—Glenn E. Richman

*Attorney, Agent, or Firm*—Blank Rome Comisky & McCauley LLP

[57] ABSTRACT

An exercise machine having a user interface engaged by a user to perform exercises using the exercise machine is disclosed in which an electric, direct current (DC), servo control motor is used as the force producing element to which the user interface is mechanically connected and in which a digital data processor, operatively connected to the electric motor, is used for monitoring the position and direction of movement of the linkage relative to the electric DC servo motor and for controlling the electric DC servo motor to operate as one of a generator or a motor depending upon the determined position and direction of movement of the linkage is disclosed. The force exerted by the electric motor, whether it is operating as a motor or a generator, is dependant upon the position and direction of movement of the mechanical linkage as well as upon the force exerted by the user on the mechanical linkage, and other parameters, depending upon which one of three modes of operation is selected.

24 Claims, 51 Drawing Sheets

Prior Art

Polarity and Current Flow For Counterclockwise Motor Rotation (Rotation Resisted By Motor). The Only Change For Clockwise Rotation Is That the Motor Polarity Is Reversed.

KILLTIME

MPLUS

In mid zone moving in positive direction.

MMINUS

In mid zone moving in negative direction.

9
10
845
Current Level >1 Above Value In LOC 103 ?
Yes
Add R4 To LOC 101/102
851
No
846
Set Bit 2 of R1
847
Read FET #2 Current
852
848
Current Level >1 Below Value In LOC 103 ?
Yes
Add R3 To LOC 101/102
No
849
Set Bit 3 of R1
850
Call OUTPUT
856
854
Decrement R2
No
R2=0 ?
Yes
853
Are Both FETs At the Correct Current ?
No
857
Clear R1
Is R2 Equal To 0 ?
No
855
Yes
Yes
RETURN
7

FIG. 7Z
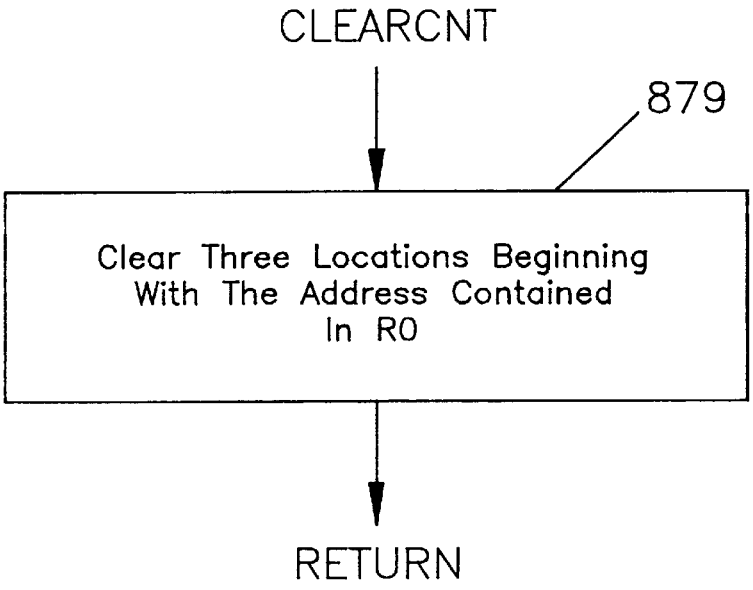
FIG. 7A1-1
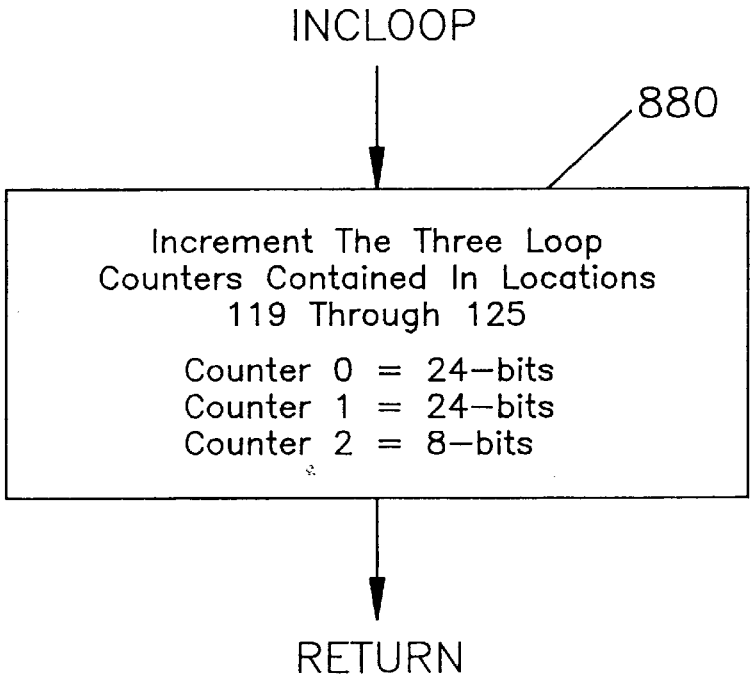

FIG. 7A1-2
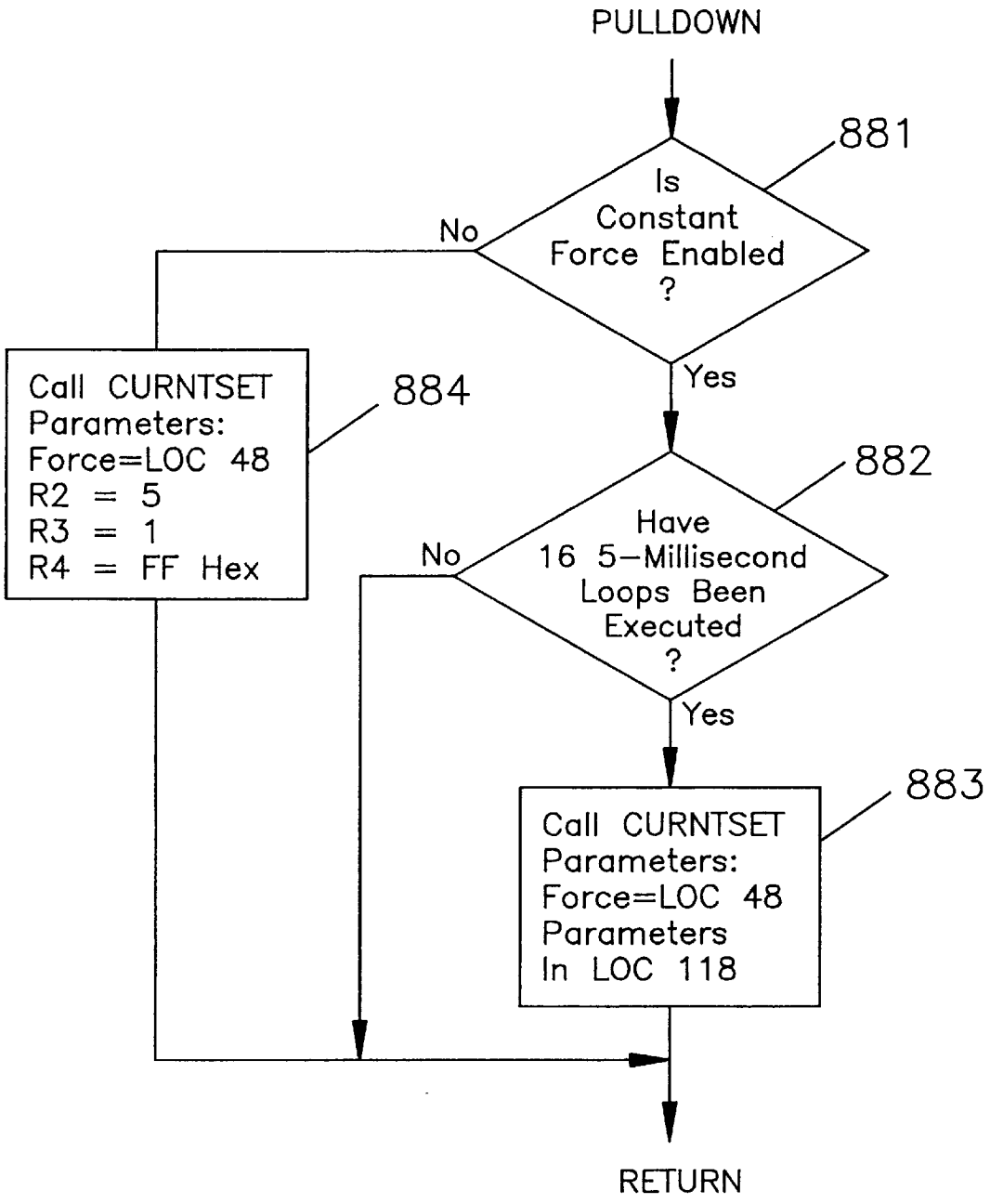

FIG. 7A1-3
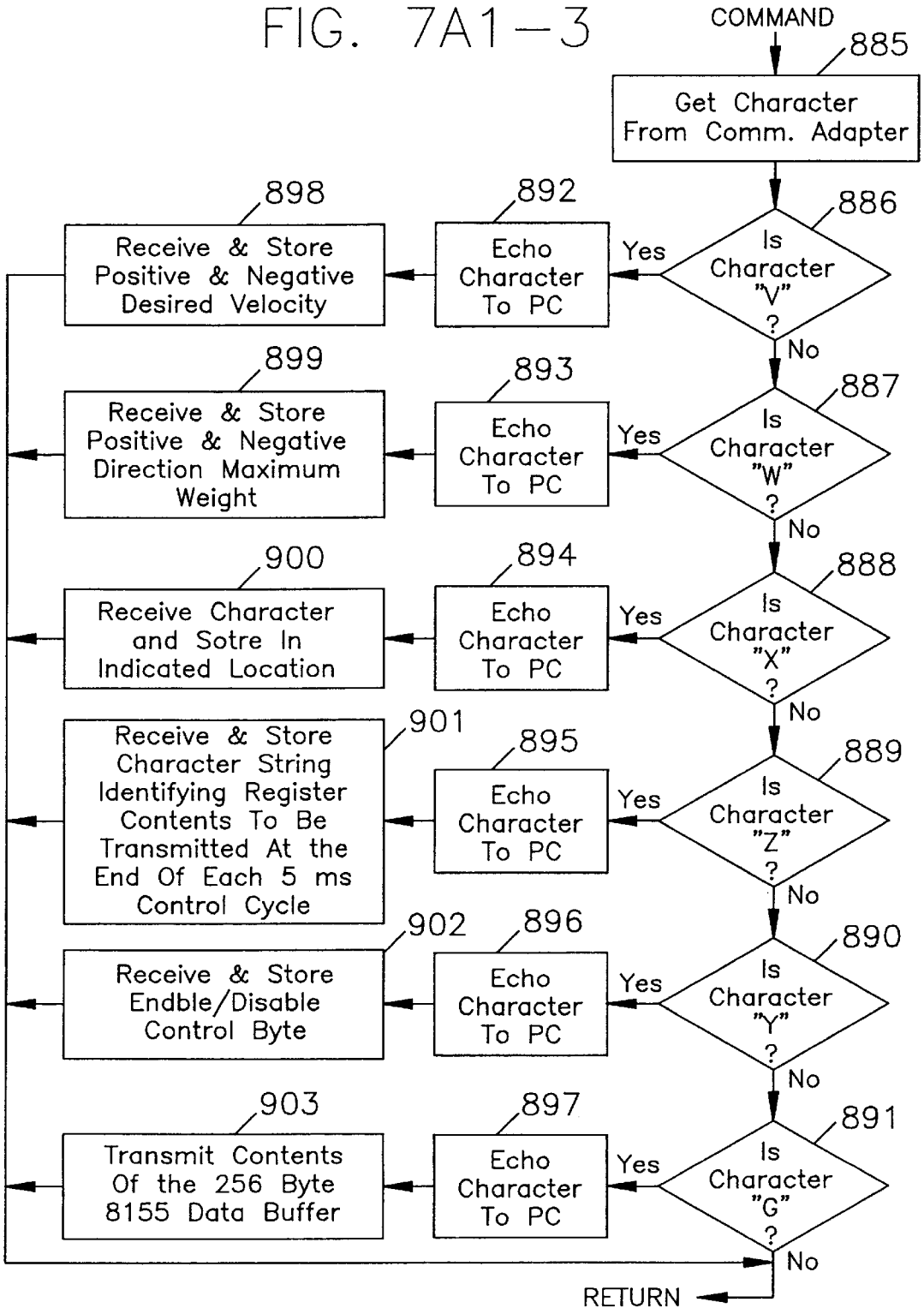

FIG. 7A1-4
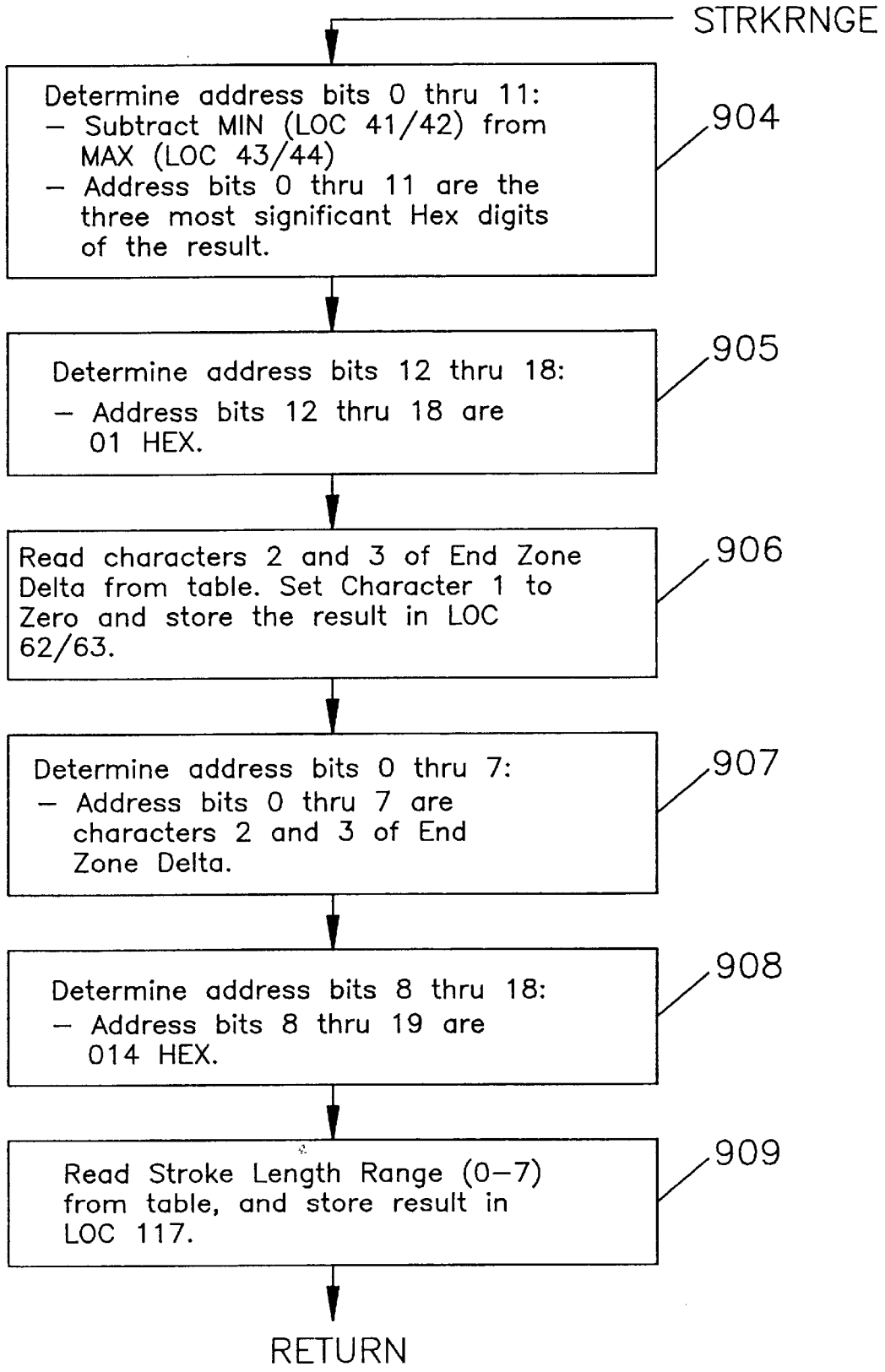

FIG. 7A1-5
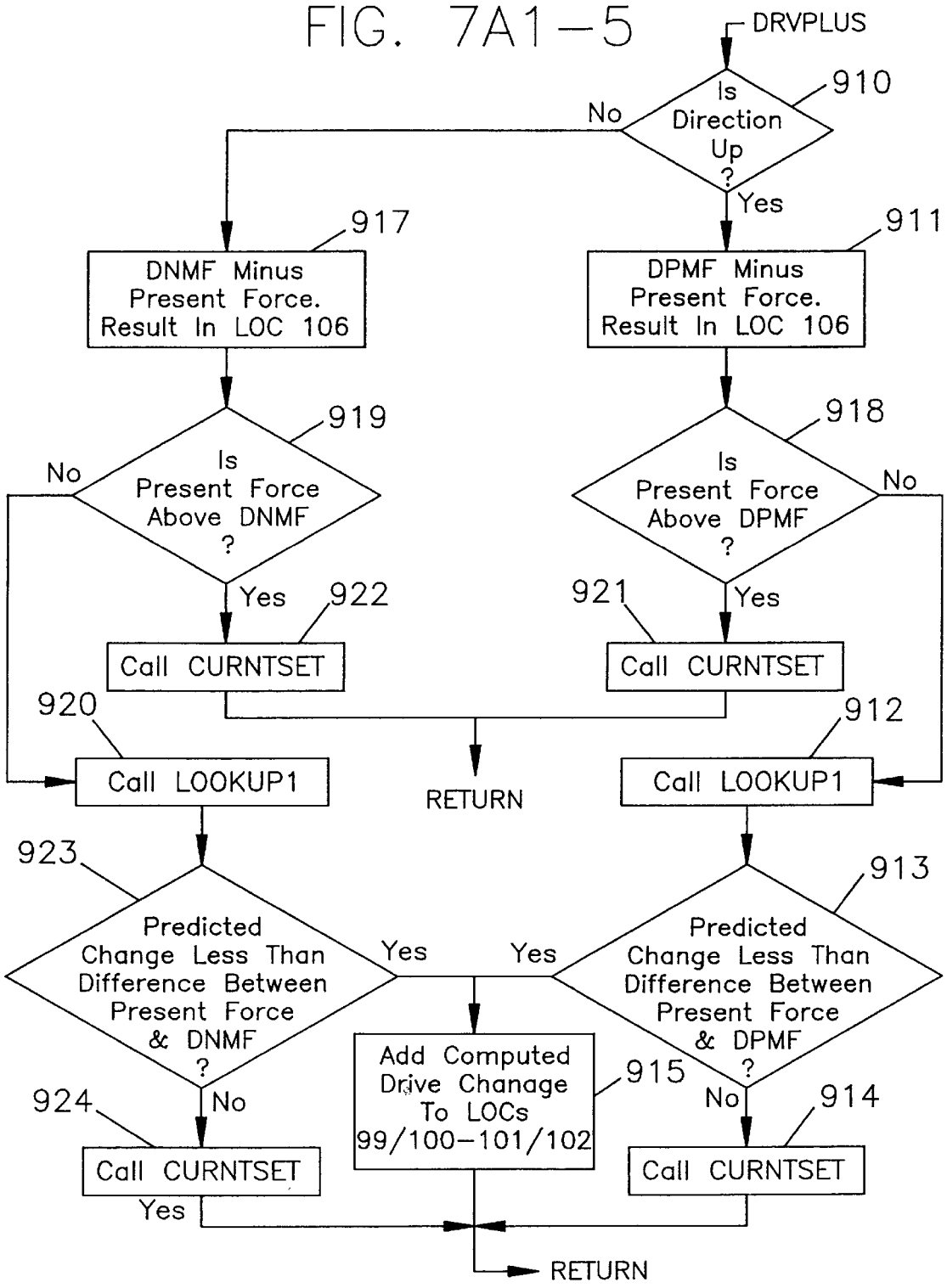

FIG. 7A1-6
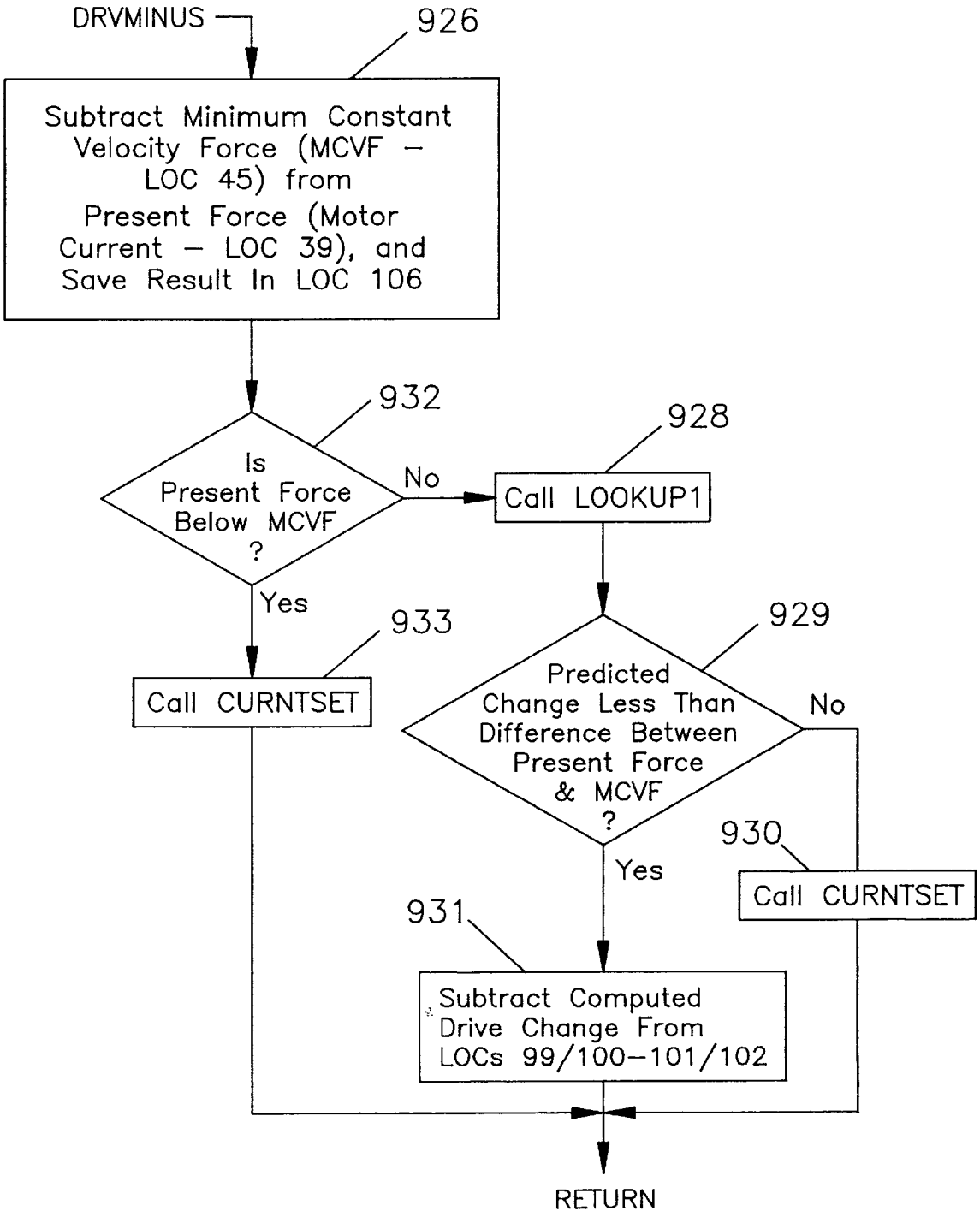

FIG. 7A1-7
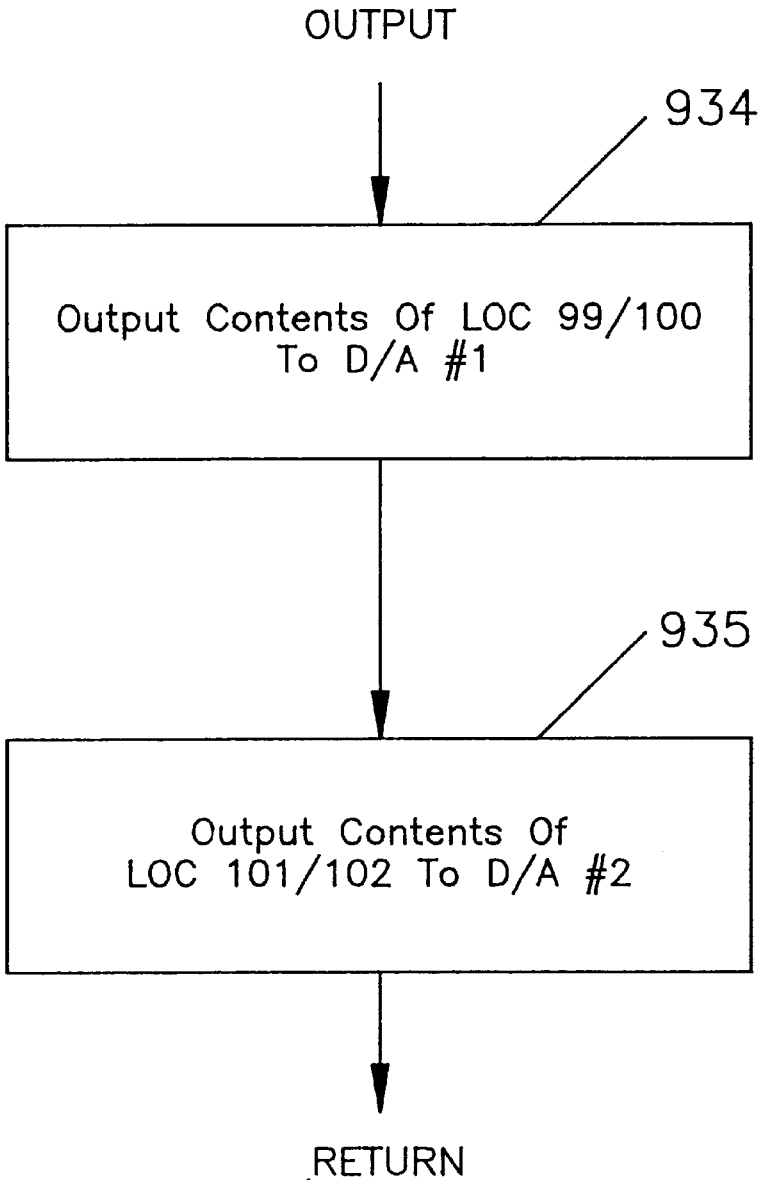

FIG. 7A1-8
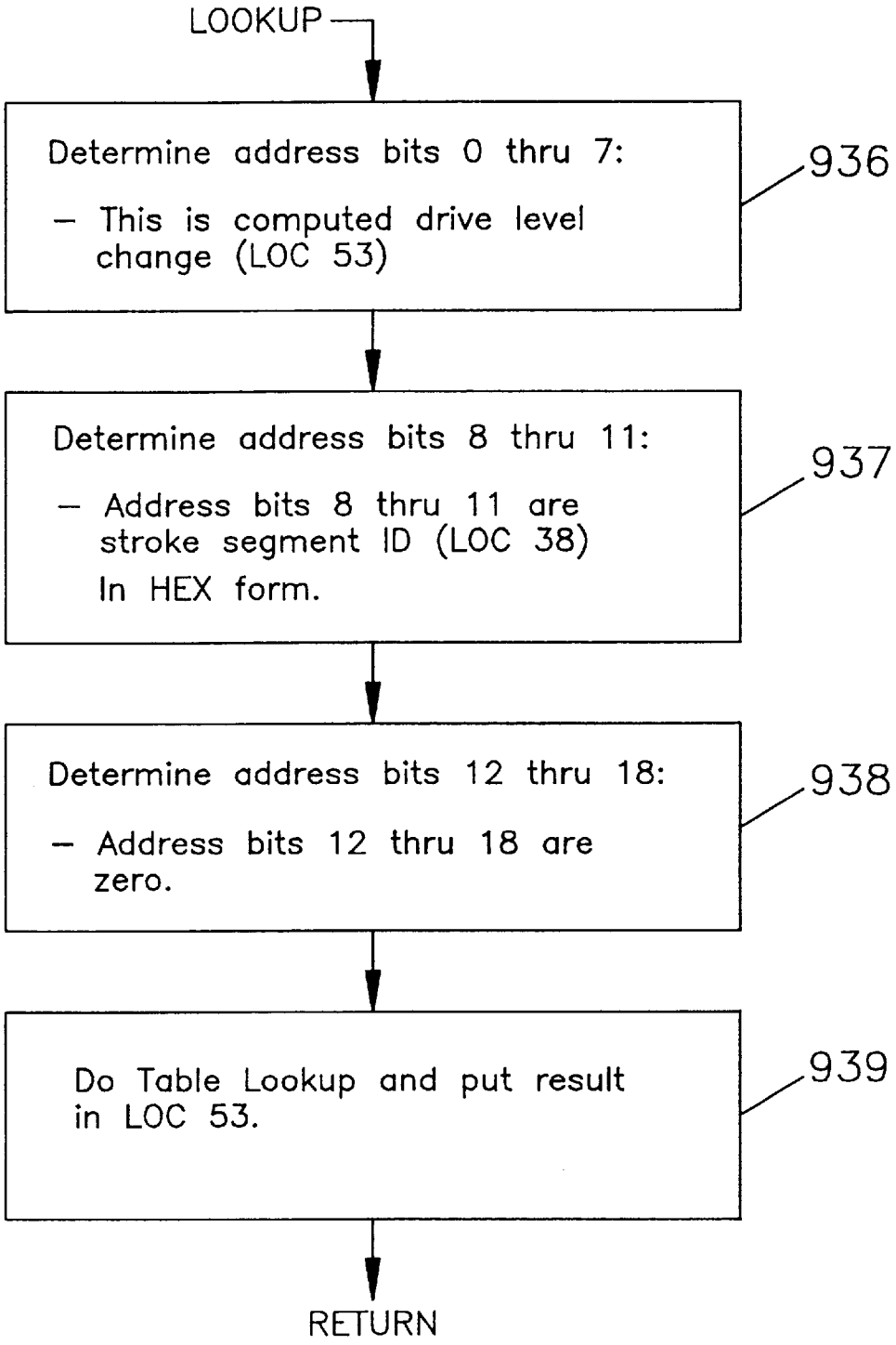

FIG. 7A1-9
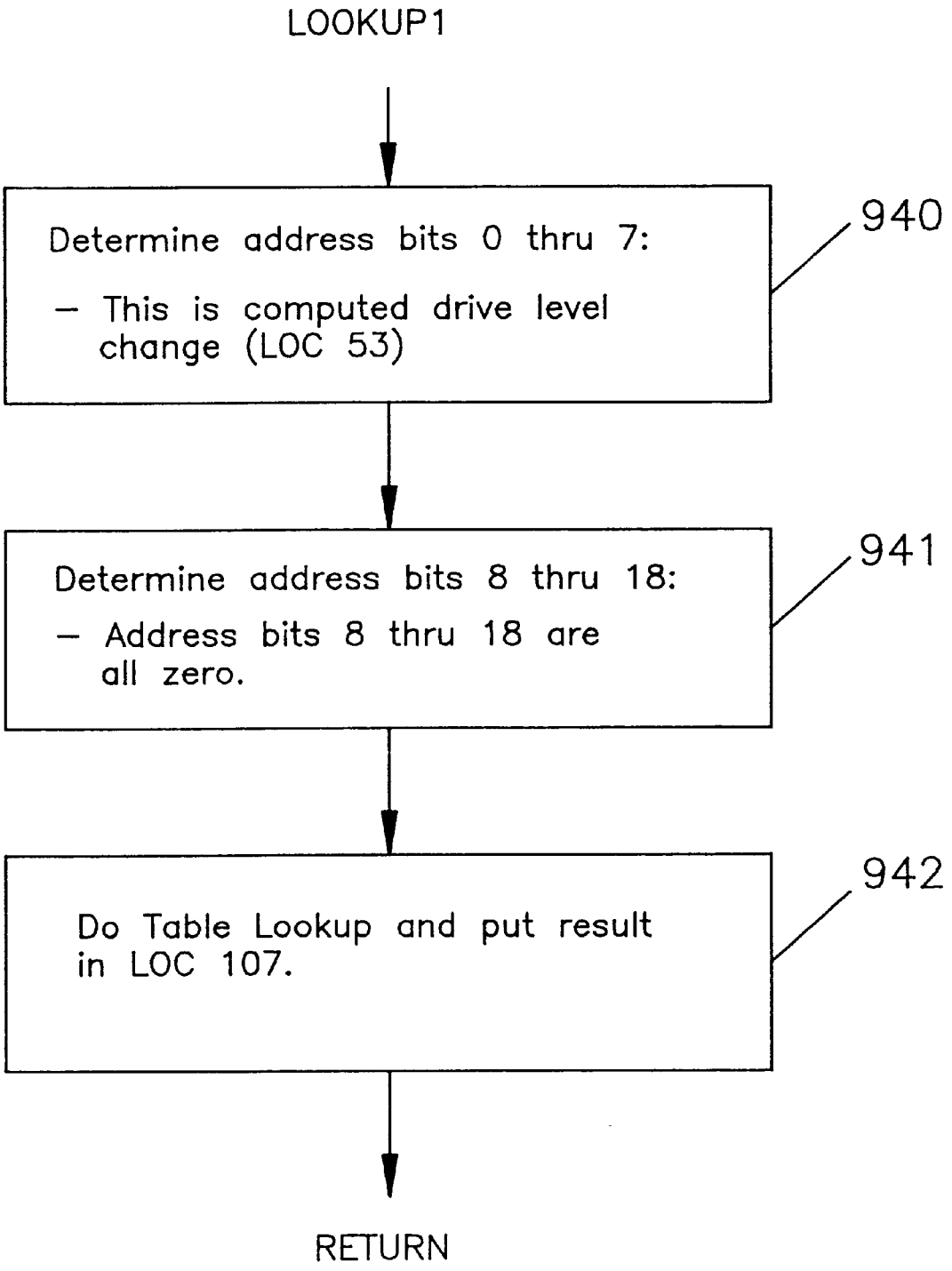

FIG. 7A1-10
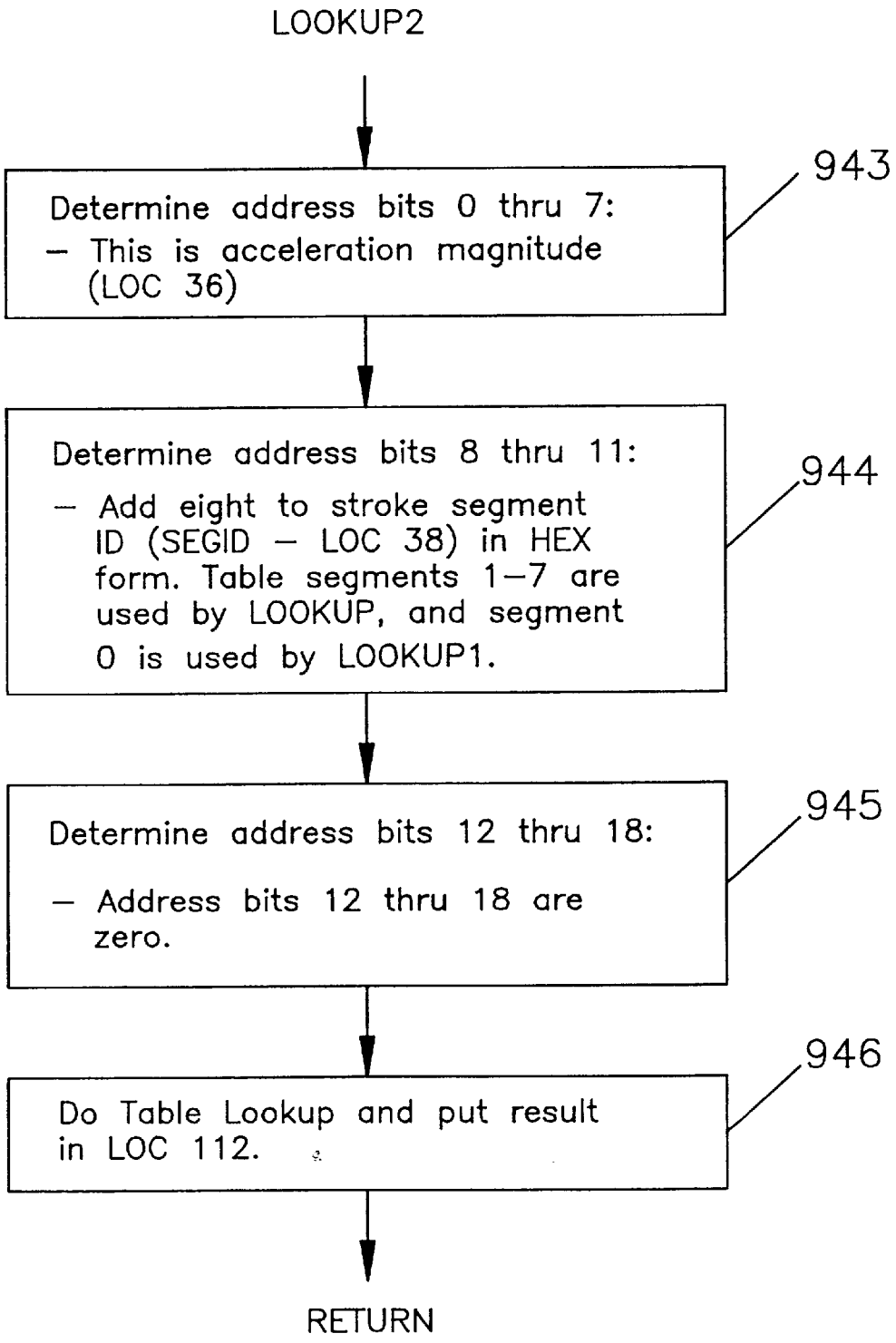

FIG. 7A1-11
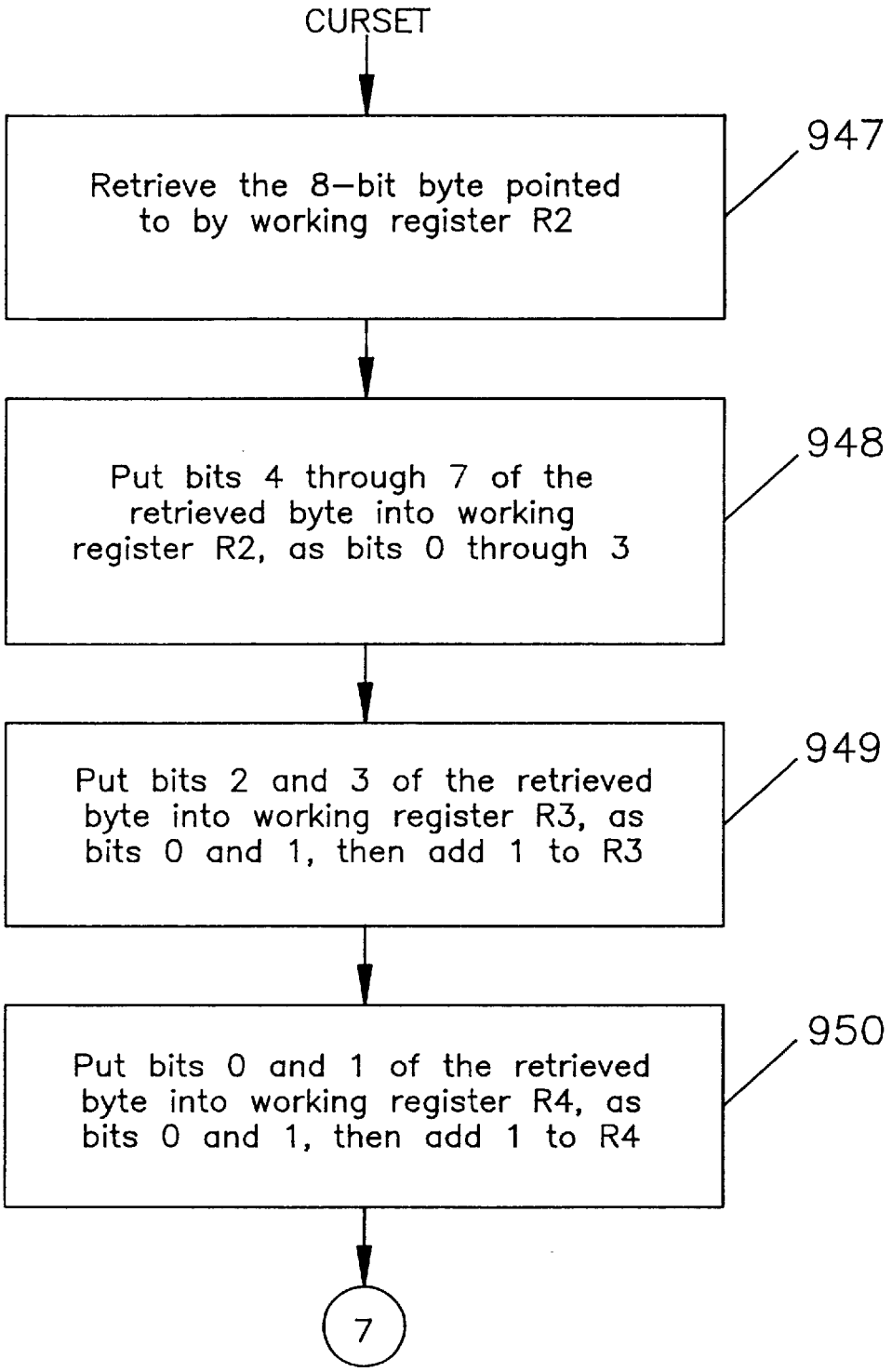

FIG. 7A1-12
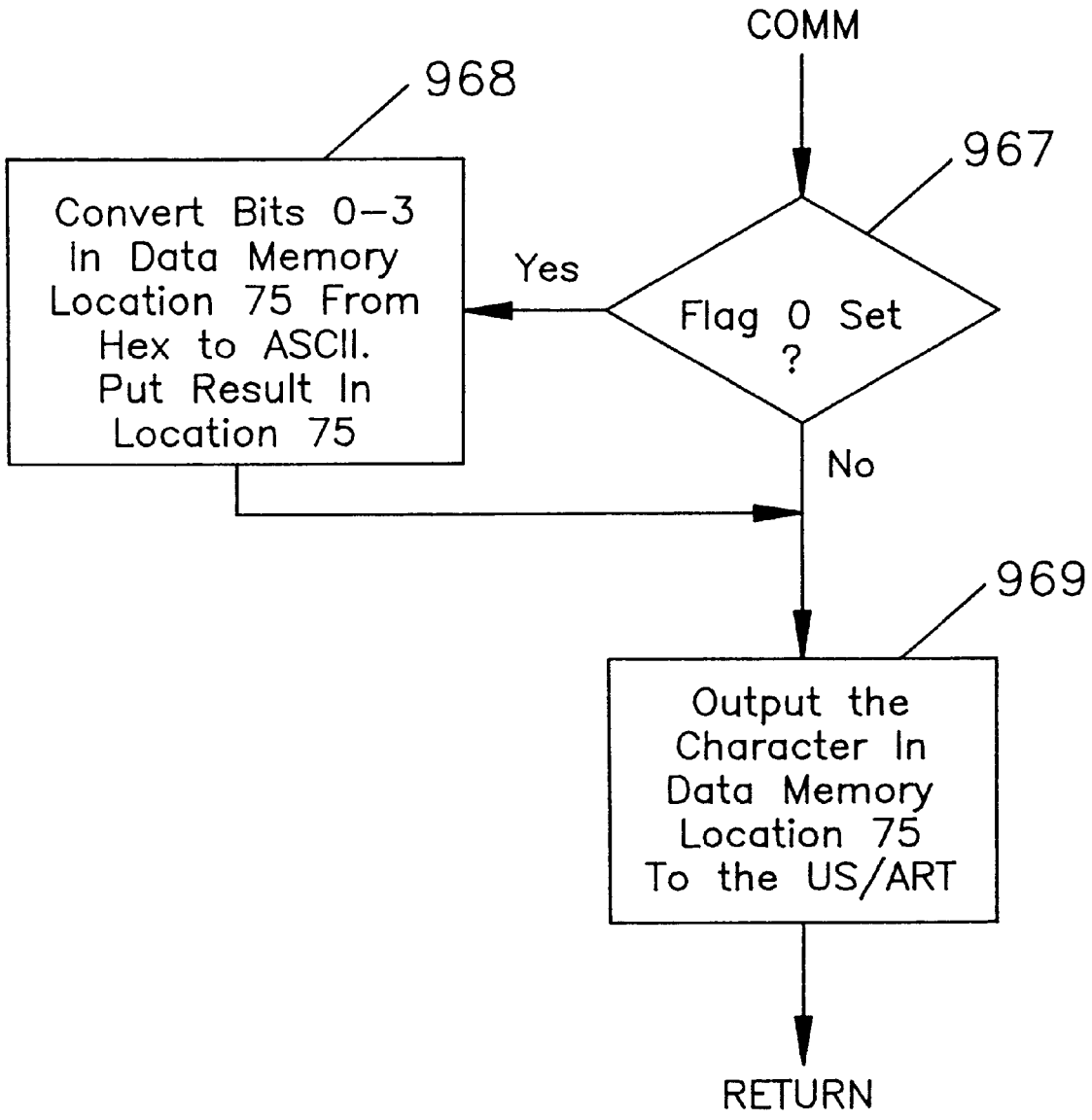

FIG. 7A1-13
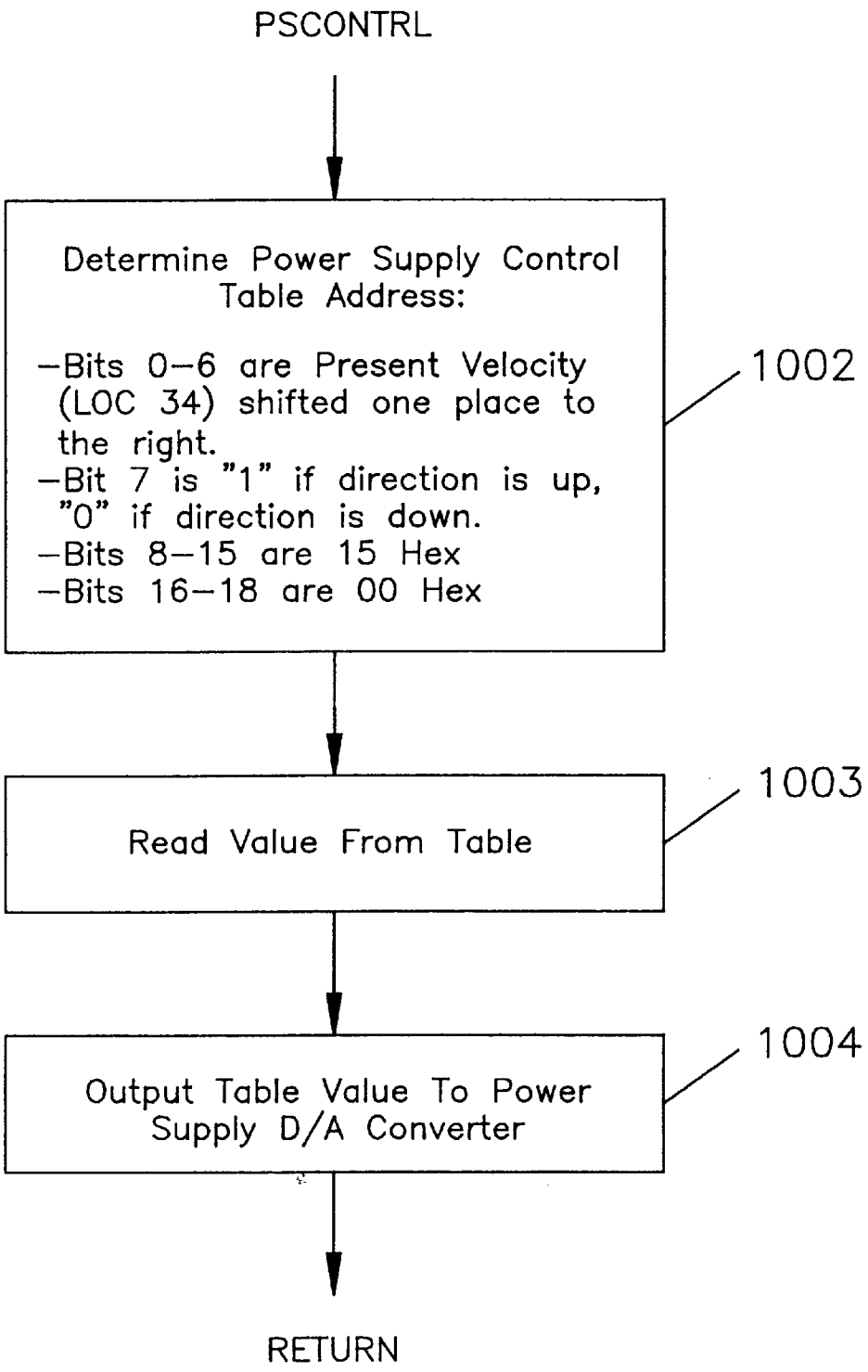

FIG. 7A1-14
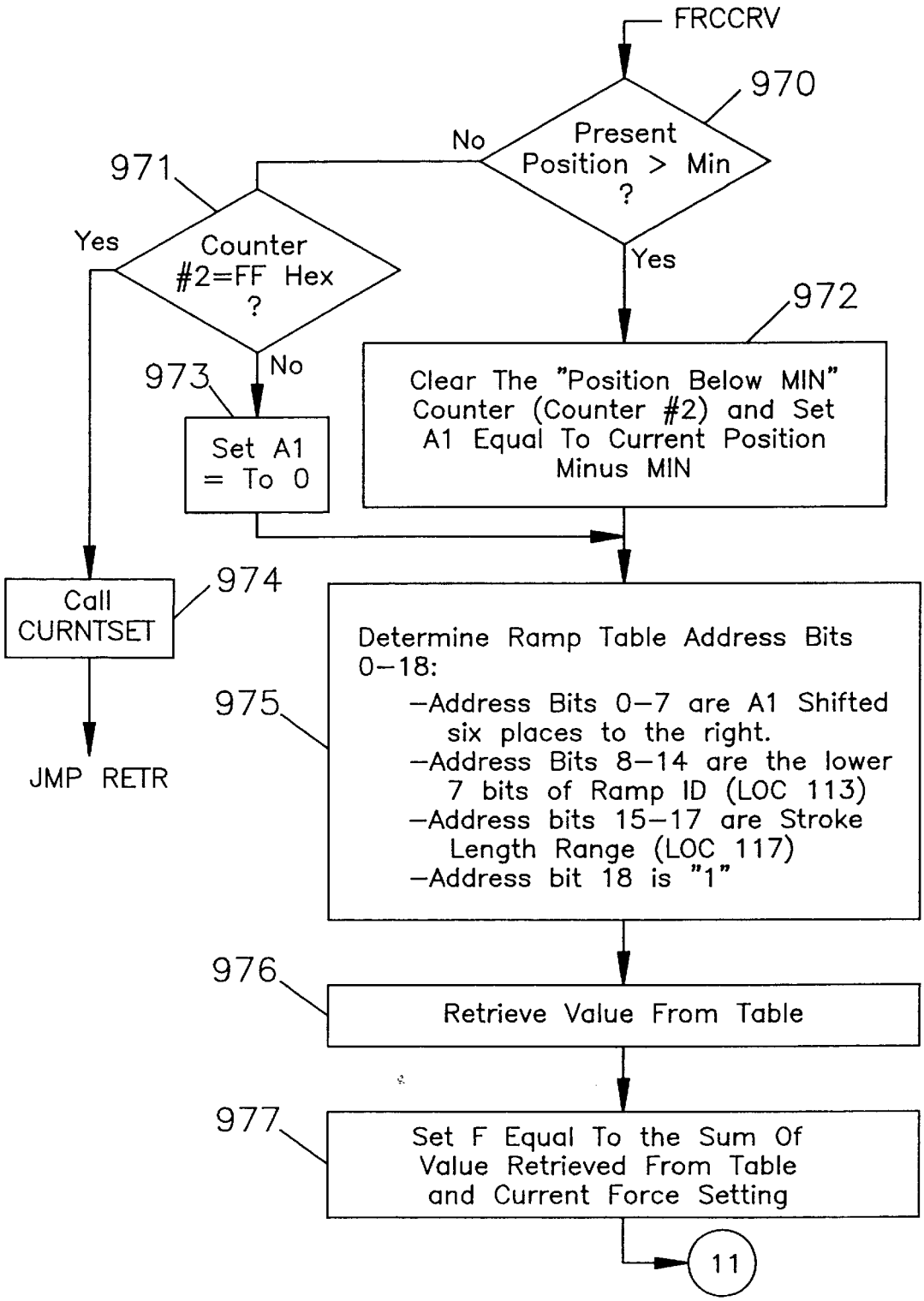

FIG. 7A1-15
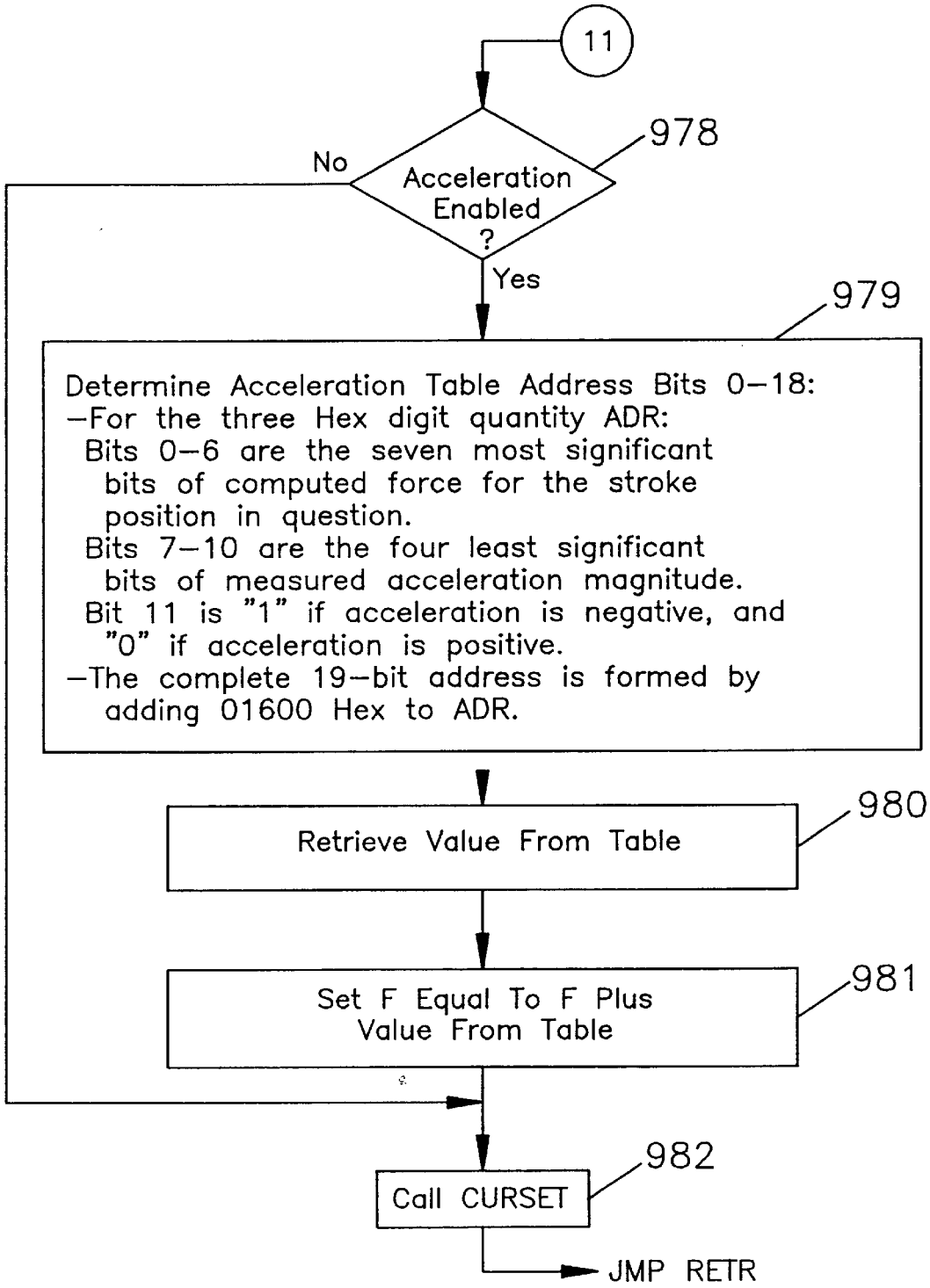

FIG. 7A1–16
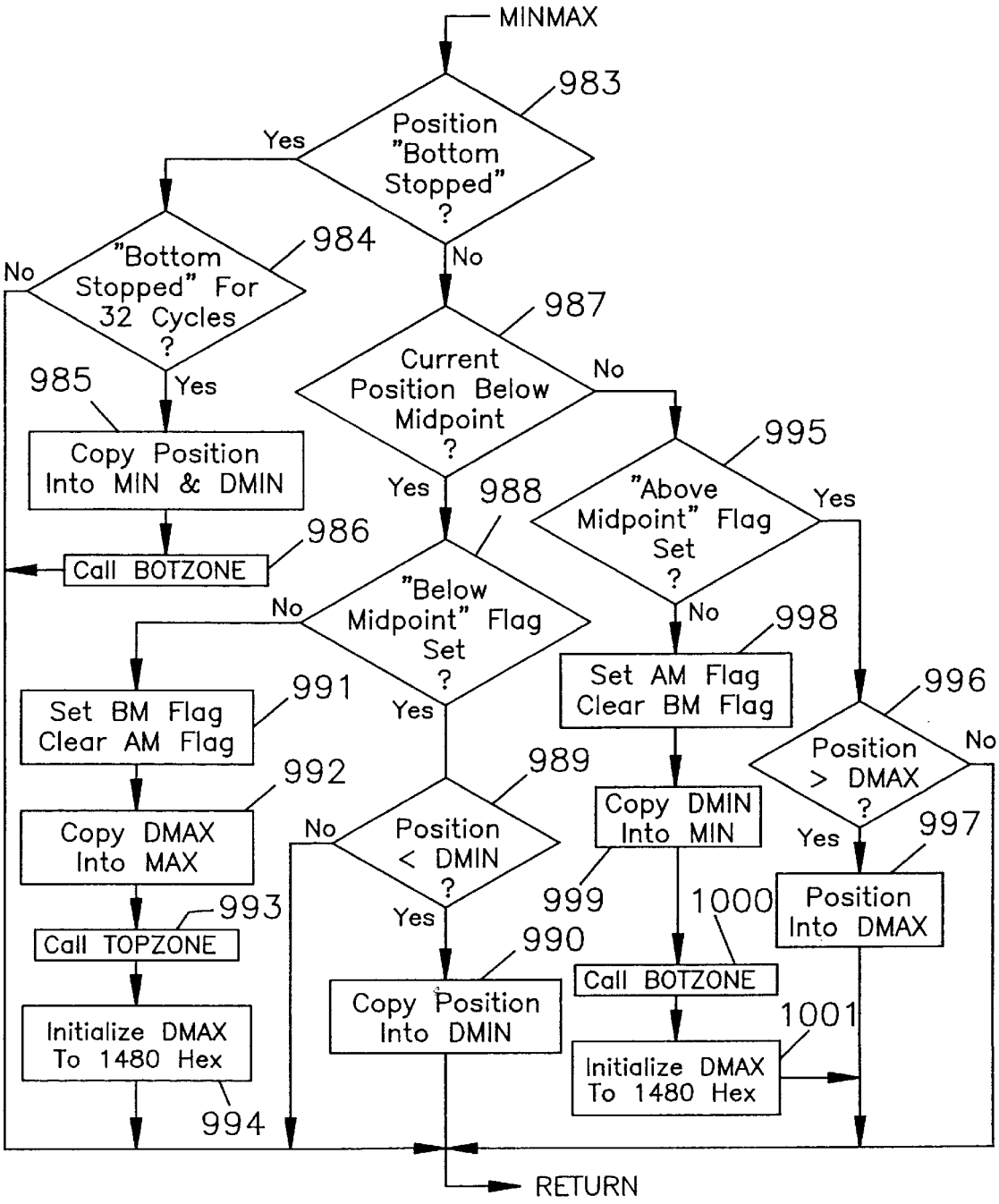

FORCE GENERATION AND CONTROL SYSTEM FOR AN EXERCISE MACHINE

BACKGROUND OF THE INVENTION

The present invention relates generally to various types of physical fitness training equipment which usually employ a weight stack as the force producing element. More particularly, the present invention relates to a method of and apparatus for the force generation and control of such an exercise machine in which the weight stack is replaced by the disclosed force generation and control system which provides better control and a better workout for the user of the physical fitness training equipment.

Typical physical fitness training equipment utilizes a weight stack sliding on vertical rods under the influence of gravity as the force producing element. Movement of the weight stack by the user is caused by tension created in a cable that attaches to the top of the weight stack. In the past, there have been numerous applications of computer technology to the production of physical fitness training equipment. These attempts were typically aimed at overcoming known limitations imposed by the interactions of the weight stack-based, cable-actuated exercise system and the human muscular and skeletal structure. Examples of such prior art devices are the electrically controlled exercise system disclosed in U.S. Pat. No. 4,828,257 to Dyer et al., the exercise apparatus disclosed in U.S. Pat. No. 4,620,703 to Greenhut et al. and the muscle exercise and/or rehabilitation apparatus using linear motion disclosed in U.S. Pat. No. 4,907,797. In addition, two prior art patents which deal with the use of a motor to simulate a weight stack are U.S. Pat. No. 5,020,794, to Englehardt et al., for a motor control for an exercise machine simulating a weight stack and U.S. Pat. No. 5,117,170, to Keane et al., for a motor control circuit for a simulated weight stack.

While each approach of the prior art to exercise system force generation imposes its own special set of undesirable traits, a number of the known advances have improved attainable results by successfully addressing one or more of the known problem characteristics of the interactions of the exercise system and the human muscular and skeletal structure. However, although limited success has been attained, high-technology and exercise equipment have not achieved their ultimate convergence in the marketplace. This is attested by the thousands of exercise machines of various types that continue to rely on rubber and iron as the force producing elements. A user-friendly, high-technology solution, tailored to the exercise system user, and in which the known limitations imposed by the interactions of the exercise system and human muscular/skeletal structure are overcome has not previously been described. Prior art systems have typically failed to fuse the required technical and physiological techniques into a cohesive approach to producing an efficient, easy-to-use exercise system that is also well-suited to the human muscular and skeletal structure.

SUMMARY AND OBJECTS OF THE INVENTION

In view of the foregoing, it is apparent that there still exists a need in the art for a method of and apparatus for providing for force generation and control of an exercise machine, which in the past has typically employed a weight stack to provide a physical fitness training device suitable for efficient use by different users and for different exercises. The techniques disclosed in the present invention are useful with both new design, stand-alone exercise machines; as a retrofit that easily attaches to existing exercise machines that employ a weight stack, and in some cases (e.g., a squat rack) free weights, as the force producing element; as well as in other exercise or physical rehabilitation applications capable of benefitting from computer-based software control.

The ultimate objective in any exercise apparatus is to simultaneously produce an exercise force that appropriately loads the muscle, or set of muscles, being exercised, and an exercise feel that is acceptable to the user. The appropriateness of a given muscle loading approach depends on a variety of factors, including: the type of muscle tissue being developed, the degree to which strength curve tracking/accommodation is desired, whether both positive and negative exercise is desired, desired exercise speed, maximum "weight" load imposed, etc. Some exercise parameters are dictated by the details of the muscle development being pursued, whereas others are driven more by the particular desires of the individual exercise equipment user. In general, manual exercise machines are limited in their ability to offer flexibility in responding to the many exercise variables that could potentially be controlled. For the most part, such machines rely upon relatively fixed mechanical structures for exercise parameter determination. Also, such manual machines suffer the additional inherent limitations of real weights or other force producing mechanisms. Conversely, computer controlled exercise equipment offers the potential for practically limitless variation in exercise parameter modification, and need not necessarily impose the same restrictions as the typical muscle loading approaches currently in widespread use. However, the application of computer automation to the simultaneous achievement of a usable, controllable exercise parameter set, in compunction with an acceptable exercise feel, introduces its own set of implementation challenges.

In considering the application of computer automation to the force generation and control of exercise equipment, there are a variety of problems that must be solved. A reasonable starting place is to assume that any satisfactory solution will ultimately be based upon fairly simple servo control concepts, and will be manifest in the form of a closed feedback loop in which some set of operational parameters is measured, and the results of the measurements are used to determine the manner in which a set of control parameters is to be adjusted. The difference between the measured state of the system and a defined desired state determines the magnitude and direction of the change to be made in the controlled parameter(s). Such a control system could be implemented using analog (continuous) or digital (discrete) techniques, or a combination of the two.

In manual exercise equipment using one or more weight stacks as the force producing element(s), the state of the system can be determined from knowledge of two parameters: the force in the cable that moves the active weight stack and the velocity of the active weight stack. Other parameters, such as acceleration of the weight stack, that might be useful in implementing a control algorithm, can be determined from force and/or velocity measurements. The disclosed force generation and control system, which can be used to replace the weight stack in a single- or multiple-exercise machine, incorporates a DC servo control motor as the force producing element. Therefore, the only controllable parameter is DC servo motor current. The control algorithm is able to determine the state of the system by measuring velocity and/or force, and is able to introduce changes in the state of the system by controlling DC servo motor current. It is, therefore, a primary object of this invention to provide a method of and apparatus for force generation and control of physical fitness training equipment which allows different users to readily utilize the equipment as well as the utilization of such equipment for different exercises, without the need for user initiated calibration.

More particularly, it is an object of this invention to provide a force generation and control system suitable for use in a wide range of physical fitness and medical rehabilitation exercise applications.

Still more particularly, it is an object of this invention to provide a force generation and control system that uses a high-performance DC servo motor, as the force producing element, with sufficient torque to obviate the need for a gear reduction between the user and the motor shaft, in order to allow the level of user override essential to production of the desired exercise feel while at the same time avoiding gear reduction-induced stiffness.

It is another object of this invention to provide a force generation and control system that provides Constant Velocity, Constant Force, and Force Curve modes of operation, to fulfill the exercise feel desired of a large percentage of exercise machine users, as well as the special needs of applications such as medical rehabilitation, where jerkiness and other undesirable/unexpected results must be minimized.

It is yet another object of the invention to provide a force generation and control system that divides the exercise stroke into distinct regions and directions and tailors the control algorithms to the needs of each specific case.

More particularly, it is an object of this invention to avoid the need for user initiated calibration otherwise required to determine exercise stroke length, stroke position, and other parameters needed in the production of a satisfactory exercise, by providing a force generation and control system that incorporates full-time, dynamic calibration.

A still further object of this invention is to make maximum use of tables in implementing the control algorithms, in order to minimize the need for real-time mathematical computations, thereby allowing the use of a simple, inexpensive microprocessor as the control element.

Even more particularly, it is an object of this invention to provide, as part of the control circuitry of the invention, downloadable flash memory to hold the many tables that are utilized by the control algorithms that are part of the invention, and to provide for table downloads, over a serial communications interface that is part of the invention, from an attached personal or other computer.

Yet more particularly, it is an object of this invention to provide for real-time software controlled current sharing/balancing of the multiple semiconductor devices that control the current delivered to the DC servo motor that is the force producing element of the disclosed invention.

Still more particularly, it is an object of this invention to provide for computer software control of the output voltage of the DC power supply that provides the power for force production in the disclosed invention, in order to compensate for the dynamic changes in magnitude and polarity of the voltage produced by rotation of the DC servo motor force producing element as it undergoes changes in direction of rotation and rotational speed during the course of the exercise stroke.

Still more particularly, it is an object of this invention to provide a force generation and control system that, when attached to an existing or new design, multi-position or single-position exercise machine, or when used in a standalone mode, and when additionally connected, via an integral serial communications interface to a suitable programmed external personal or other computer, provides the capability to communicate with and respond to an external software program to provide more comprehensive control of the force generation and control system for the purpose of simplifying the user control interface, developing and controlling exercise programs, collecting and storing data concerning exercise results of one or more users, and storing and later outputting specific exercise parameters to the force generation and control system for control of individual or sets of exercises in support of one or more users.

Briefly described, these and other objects of the present invention are accomplished by utilizing a system that can replace the weight stack of a conventional exercise machine, using the rods on which the weight stack normally slides as the attachment medium. The system of the present invention incorporates a force generation and feedback system which utilizes a high-performance DC servo motor, a shaft encoder, a device for sensing motor current, and a means for controlling the output voltage of the power supply that supplies current to the DC servo motor. On the forward stroke, that is, the stroke in which the motor is turning in the counterclockwise direction in which rotation is resisted by the motor, the DC servo motor operates as a generator, with output voltage adding to the voltage of the attached DC power supply. On the reverse stroke, that is, the stroke in which the motor is turning in the clockwise direction and rotation is forced by the motor, the output voltage of the DC servo motor subtracts from the voltage of the attached DC power supply. In both cases, the instantaneous torque output of the DC servo motor is controlled by means of multiple, high-current semiconductor devices in which current sharing/balancing is forced by firmware executing on the microprocessor that is part of the disclosed invention; and the output level of the attached DC power supply is controlled by the same microprocessor to keep that total voltage available to the DC servo motor circuit relatively constant during the course of the exercise stroke. Power supply output level control simplifies the control algorithms that execute on the microprocessor, and greatly enhances the achieved control results.

In the present invention, linear motion, which duplicates the motion of a weight stack, is produced using a combination of sprockets and chains driven directly from the DC servo motor shaft. Gear reduction between the motor shaft and the user is avoided, in order to eliminate the stiff and unnatural feed produced by such structural elements.

The present invention also provides the capability for a flexible feed-forward control system, consisting of a personal or other computer that communicates with the microprocessor-based controller mounted within the force generation and control system. The internal controller includes separate memories for an operating program and associated data tables, both of which can be updated and/or upgraded via a download from an appropriately programmed external personal or other computer. Software executing on the personal computer can also provide for implementation of a variety of weight training programs, and support creation of special exercise programs by the user, or others.

In some of its operational modes, the present invention intentionally avoids weight stack simulation in order to provide a different and more desirable exercise feel, while at the same time allowing circumvention of the disadvantages associated with the use of real weights. The control algorithms utilized by the present invention are based upon a combination of force control and velocity control, with a number of refinements required to accommodate the particular "exercise feel" desires of a large segment of the user population and the special requirements of applications such as medical rehabilitation.

In all modes of operation, the disclosed invention avoids the gear reduction-induced stiffness that represents a major shortcoming of many prior art attempts to apply technology to exercise hardware. Additionally, in its Constant Velocity mode of operation, the present invention successfully addresses the end point (of the exercise stroke) effects that have not been fully addressed in prior art devices. These refinements are achieved by avoiding the use of a gear reduction between the DC servo motor shaft and the user, and division of the exercise stroke into distinct regions and directions and by tailoring the control algorithms to the needs of each specific case. Positive only, negative only, and combination positive/negative exercises are supported by the present invention.

The present invention automatically accommodates stroke-length and absolute stroke position variations imposed by differences from exercise-to-exercise and user-to-user, and does not require user initiated calibration. This is accomplished through the incorporation of full-time "dynamic calibration," which is discussed in detail below.

BRIEF DESCRIPTION OF THE DRAWINGS

FIG. 6 shows only four velocities, 20, 21, 22, and 51. For reasons of clarity, the intermediated values are not shown;

FIGS. 7A through 7A1–16 are diagrams of a flowchart of the controller program used in connection with the present invention; and FIG. 8 is a high level flowchart of the software which forms part of the present invention.

DETAILED DESCRIPTION OF THE PREFERRED EMBODIMENT

Figure 1:
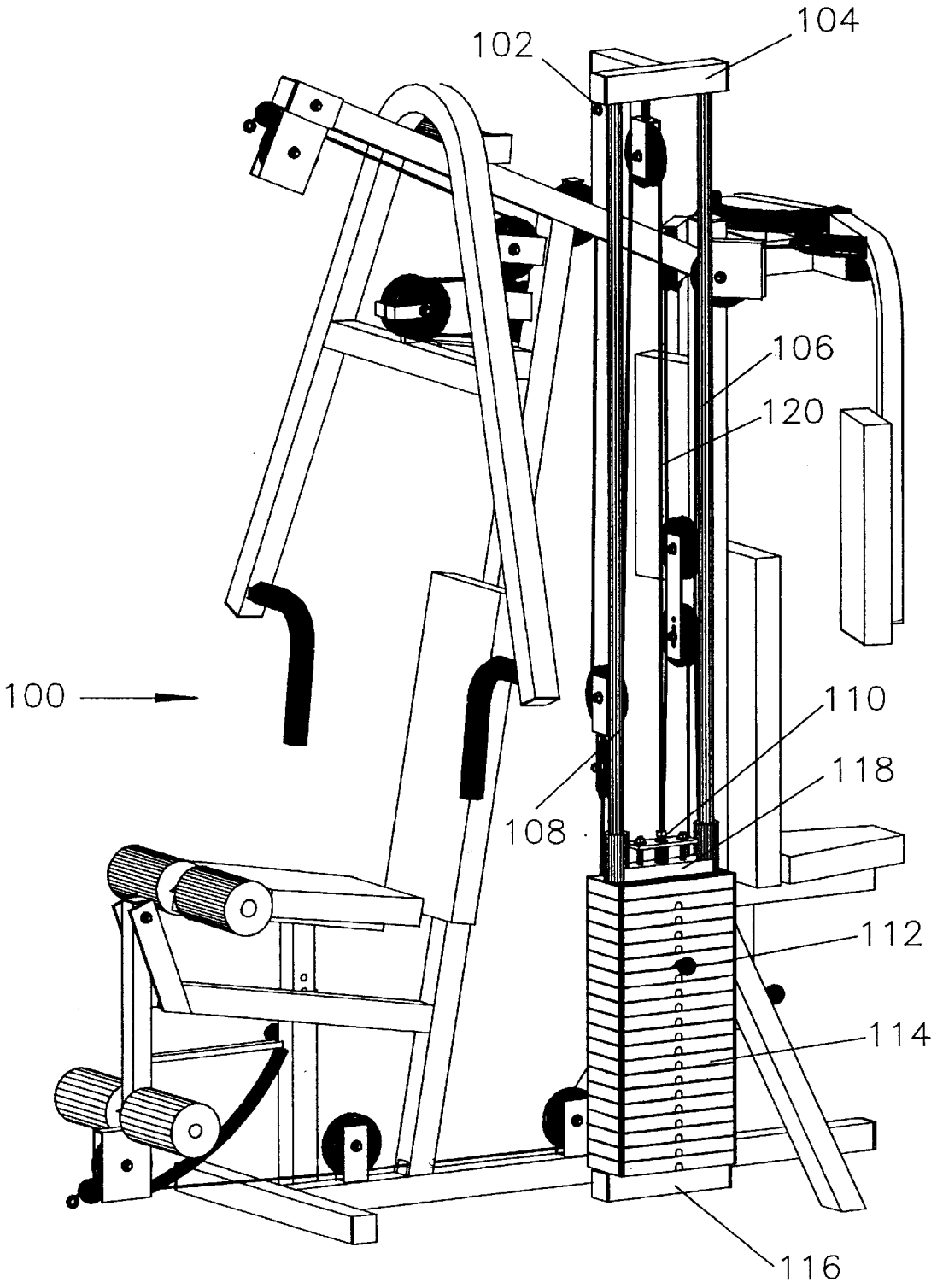
FIG. 1 is a side perspective drawing of a prior exercise machine utilizing a stack of weights sliding on vertical rods as the force producing element.

Referring now in detail to the drawings wherein like parts are designated by like reference numerals throughout, there is illustrated in FIG. 1 a prior art exercise machine 100 suitable for performing a number of exercises using a common weight stack 114. The weight stack 114 slides along two parallel vertical rods 106, 108 when the user of the exercise machine 100 pulls on the cable 120 during the course of performing an exercise routine. The cable 120 is connected at one end to a cable attachment bolt 110 which serves to secure the cable 120 to a weight support assembly 118 which is part of the weight stack 114. A weight selection pin 112 may be inserted into one of a plurality of holes in the weight stack 114, in order to select the amount of weight in the stack which will be moved during the performance of the exercise routine by the user. The other end of the cable 120, after passing through various pulleys, may be connected to various attachments (not shown) for use in performing the selected exercise, all in a known manner.

The vertical rods 106, 108 are secured to the exercise machine 100 by means of a bottom weight support rod bracket 116 and a top weight support rod bracket 104. An attachment bolt 102 is used to secure the top weight support rod bracket 104 to the frame of the exercise machine 100.

Figure 2:
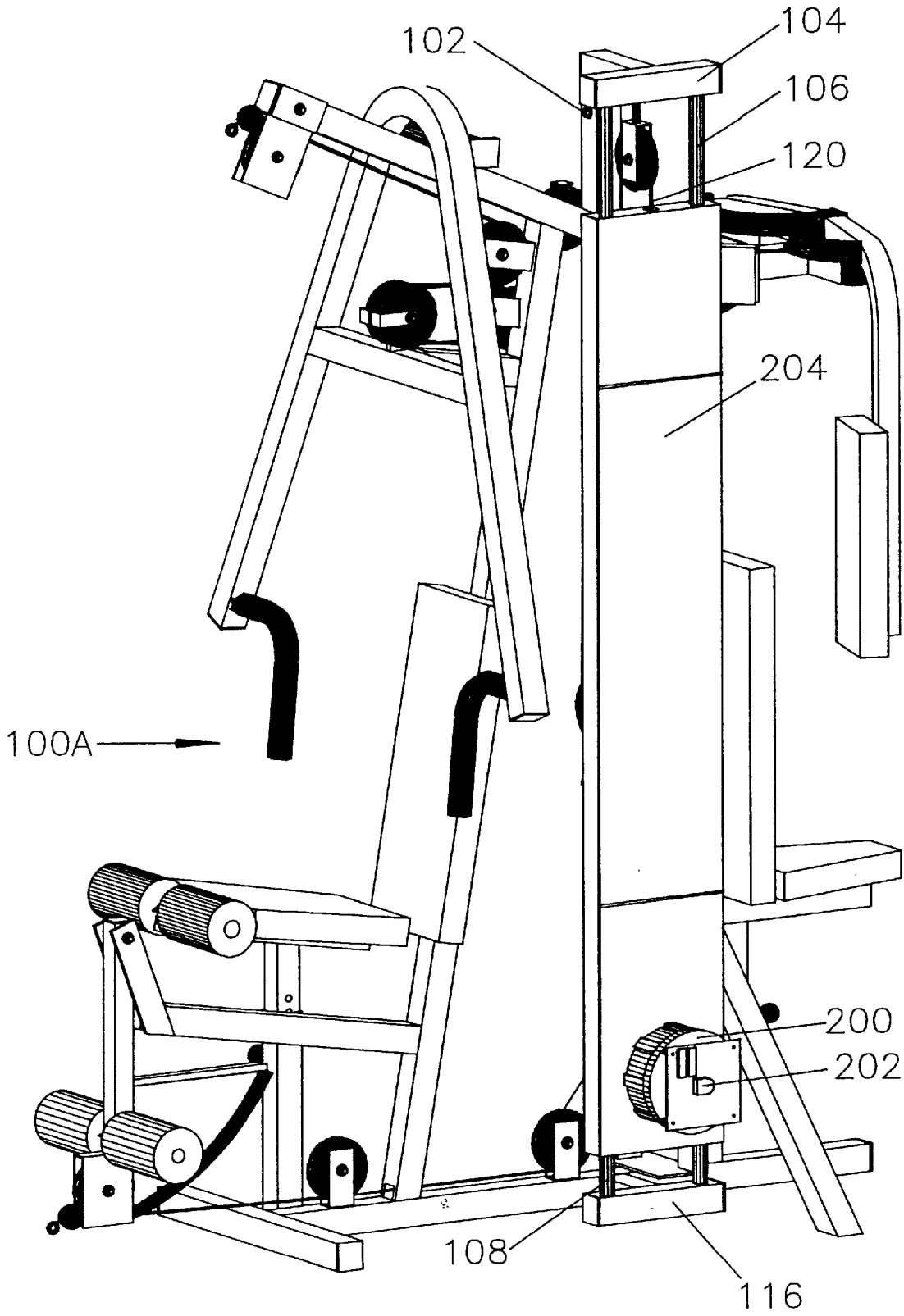
FIG. 2 is a side perspective drawing of the exercise machine shown in FIG. 1 in which the weight stack has been replaced by one instance of the force generation and control system of the present invention.
Figure 3A:
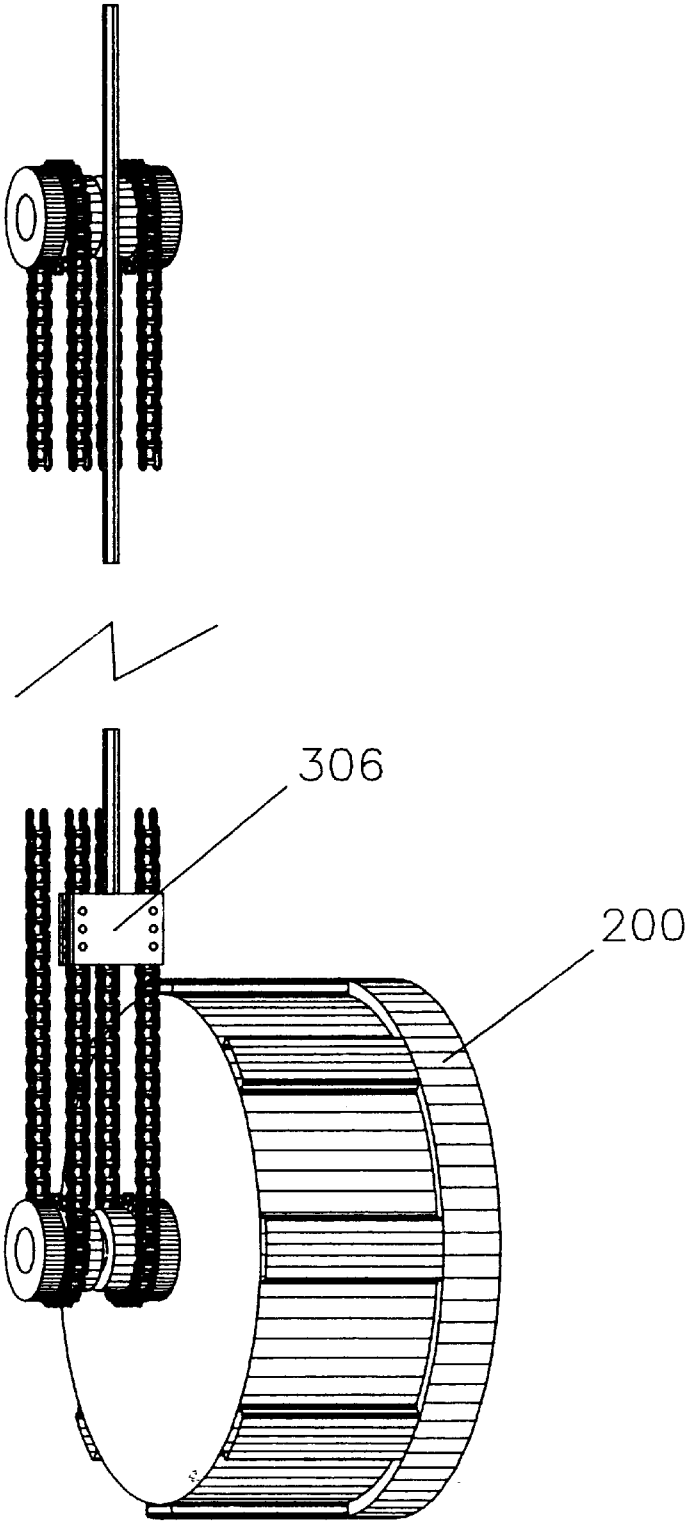
FIG. 3A is a front perspective drawing of the DC servo control motor, chain, and sprocket assembly, showing the connection of the exercise machine cable to the force generation and control system of the present invention.
Figure 3B:
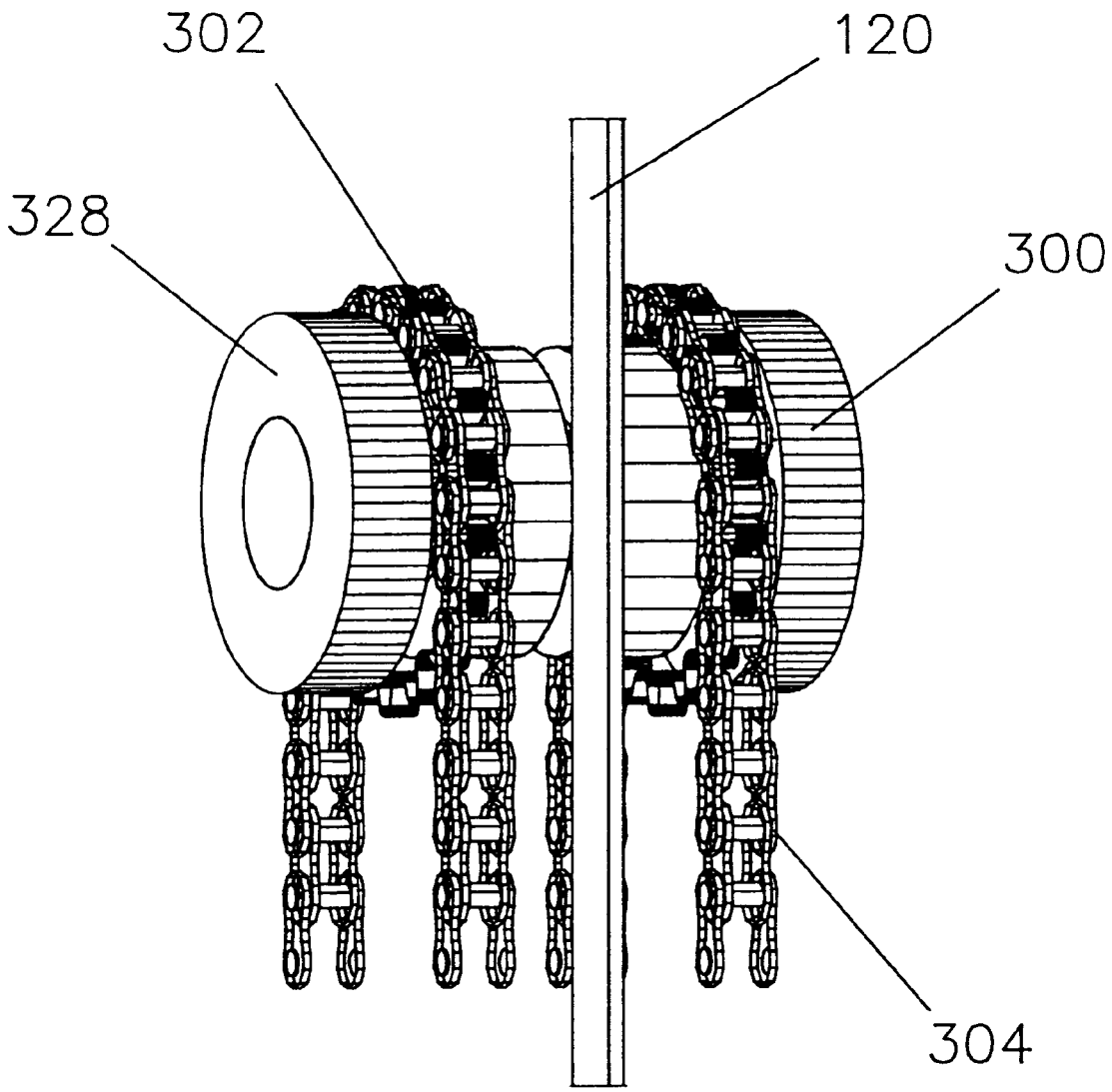
FIG. 3B is a magnified view of a portion of FIG. 3A showing the exercise machine cable, sprockets, bearings, and chain components of the force generation and control system of the present invention.
Figure 3C:
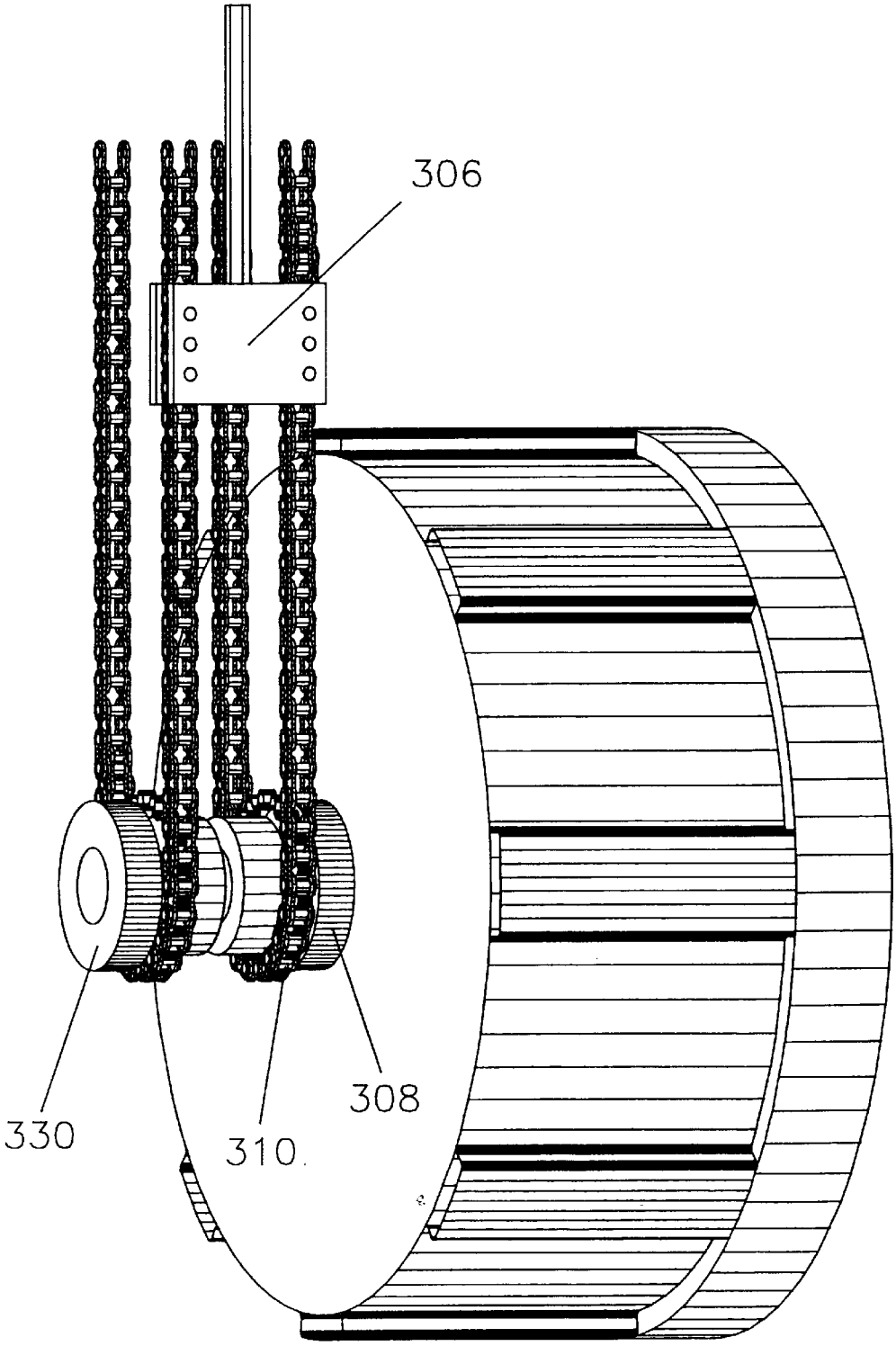
FIG. 3C is a magnified view of the bottom portion of FIG. 3A, showing in greater detail the connection of the chains of FIG. 3A to the shaft of the DC servo motor and the attachment of the cable attachment device to the lower part of the chains.
Figure 3D:
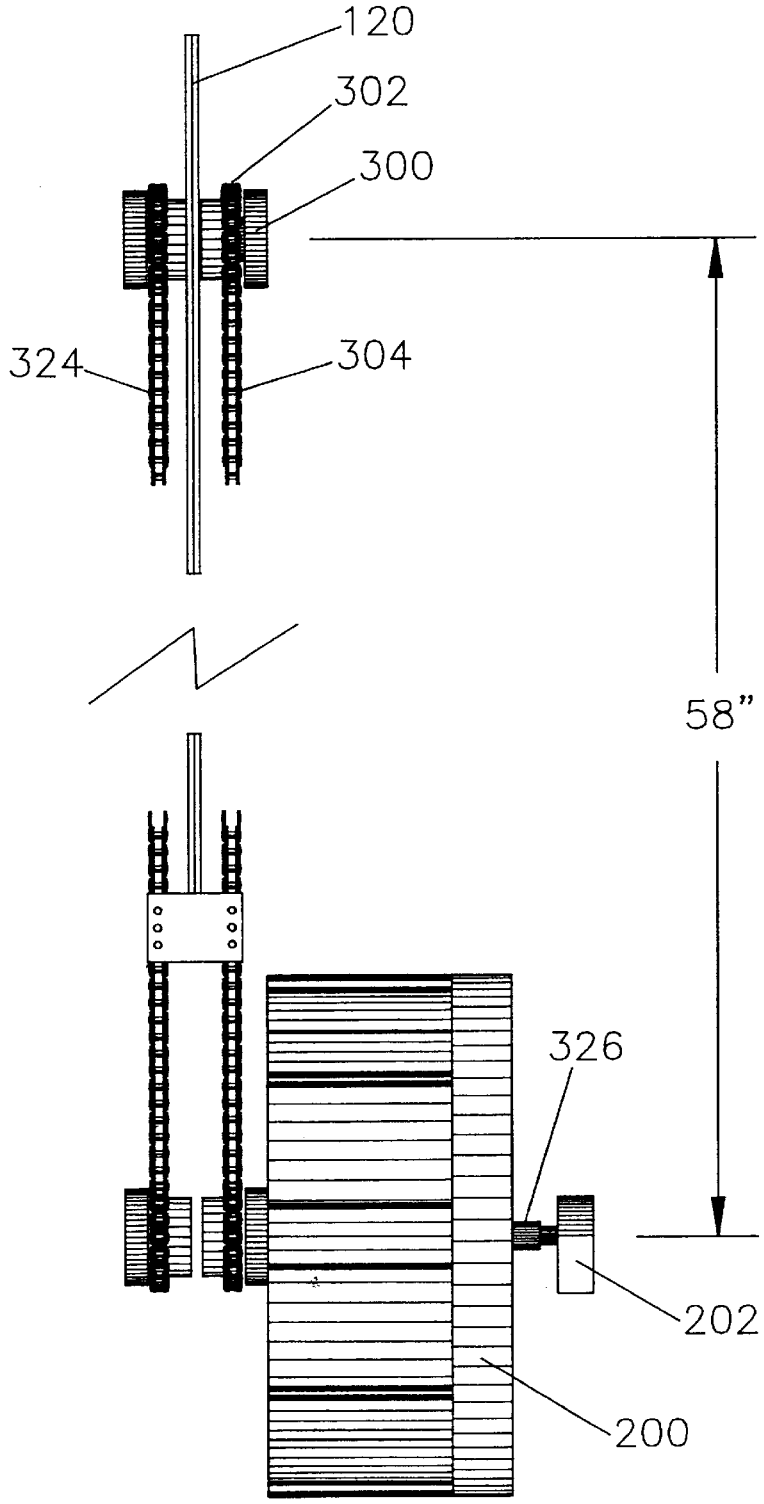
FIG. 3D is a side perspective drawing of the apparatus shown in FIG. 3A.
Figure 3E:
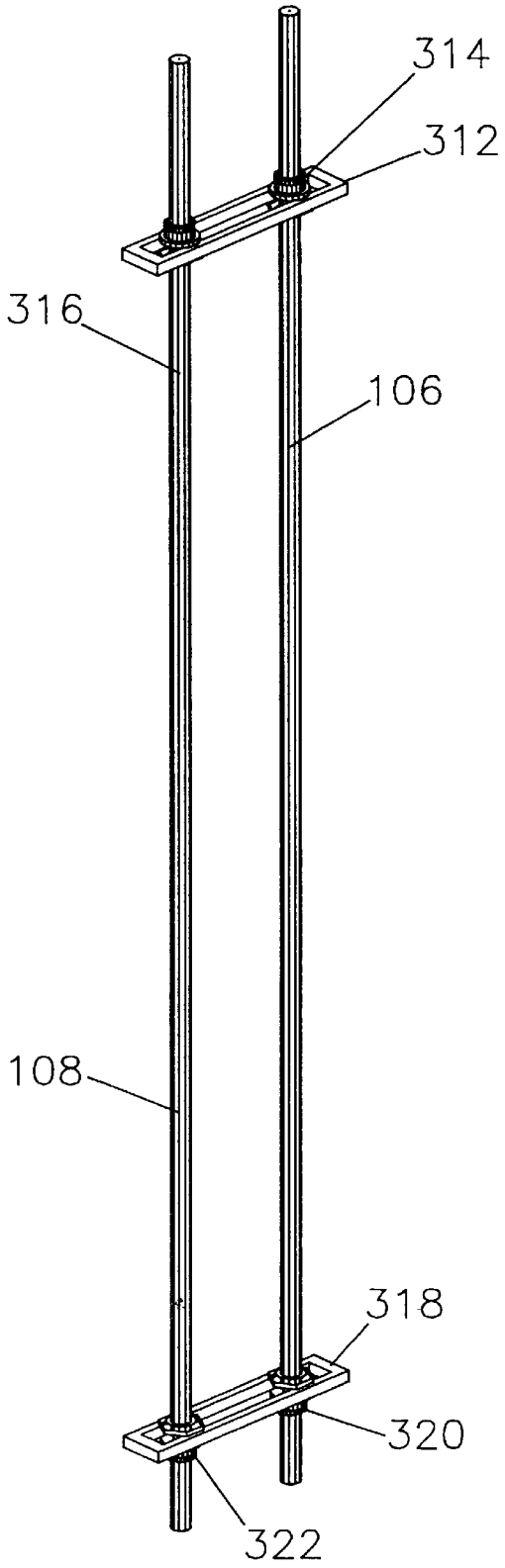
FIG. 3E is a perspective drawing of the two slide rods shown in FIG. 1 for attaching the force generation and control system shown on the exercise machine in FIG. 2 to the prior art exercise machine shown in FIG. 1.

Referring now to FIG. 2, there is shown the exercise machine of FIG. 1 in which the weight stack 114 has been replaced by the force generation and control system of the present invention. The instant force generation and control system may either be retrofitted to existing exercise equipment as shown, for example, in FIG. 2, or may be incorporated in as yet to be designed exercise equipment. Additional details of the retrofit version of the instant invention are shown in FIGS. 3A–E. As shown in FIGS. 3A–3, the weight stack 114 from the prior art exercise machine is replaced by a set of sprockets 302, 310 with accompanying bearings 300, 308, which are interconnected by means of a chain 304. Each of the upper and lower of the sprocket and bearing combinations 302, 300 and 310, 308 are formed from a set of two bearings and two sprockets 328, 330 mounted together on a shaft. The chains 304, 324 each connect a set of the upper and lower sprockets 302, 310. A suitable cable attachment device 306 is secured to the two chains 304, 324 and forms the attachment point for the exercise machine cable 120. Preferably, the upper and lower sprocket/bearing assemblies 328, 330 are vertically spaced apart by approximately 58 inches. Note that the output force/weight capability (pounds per ampere) of the mechanical configuration is directly proportional to the torque constant of the DC servo motor (4.3 Lb-In/Amp in the JR16M4CH-1, available from PMI of Commack, N.Y., used in the prototype of the instant invention) and the radius of the sprockets (302, 310) utilized. The sprocket-motor combination utilized in the disclosed invention produces an output force/weight of 11.8 pounds per ampere. However, other results (larger or smaller) can be obtained by using different motor-sprocket combinations.

The lower sprocket/bearing assembly 330 is mounted to the shaft 326 of the DC servo motor 200. The upper sprocket/bearing assembly 328 is mounted directly to the elongate case 204 of the force generation device of the present invention, which may preferably be formed from either sheet or molded metal or plastic. The case 204 is secured to the exercise machine 100*a* by means of the two vertical rods 106, 108. As shown FIG. 3E, upper and lower brackets 312, 318 are secured to the vertical rods 106, 108 by means of upper and lower collars 314, 316, and 320, 322. The elongate case 204 is in turn secured to the upper and lower brackets 312, 318, by any suitable means. The DC servo motor 200 is secured to the lower portion of the elongate case 204, which is provided with a hole through which the shaft 326 of the DC servo motor 200 protrudes such that the lower sprocket/bearing assembly 330 can be secured to the shaft 326 of the DC servo motor 200 so that it is directly beneath the upper sprocket/bearing assembly 328. In that manner, the chains 304, 324 can be secured between the upper and lower sprocket/bearing assemblies 328, 330 such that the chains 304, 324 are essentially vertical and parallel to the vertical rods 106, 108. The DC servo motor 200 is provided with a shaft encoder 202 which is mounted directly to the opposite side of the DC servo motor shaft 326 as that of the lower sprocket/bearing assembly 330.

Figure 4:
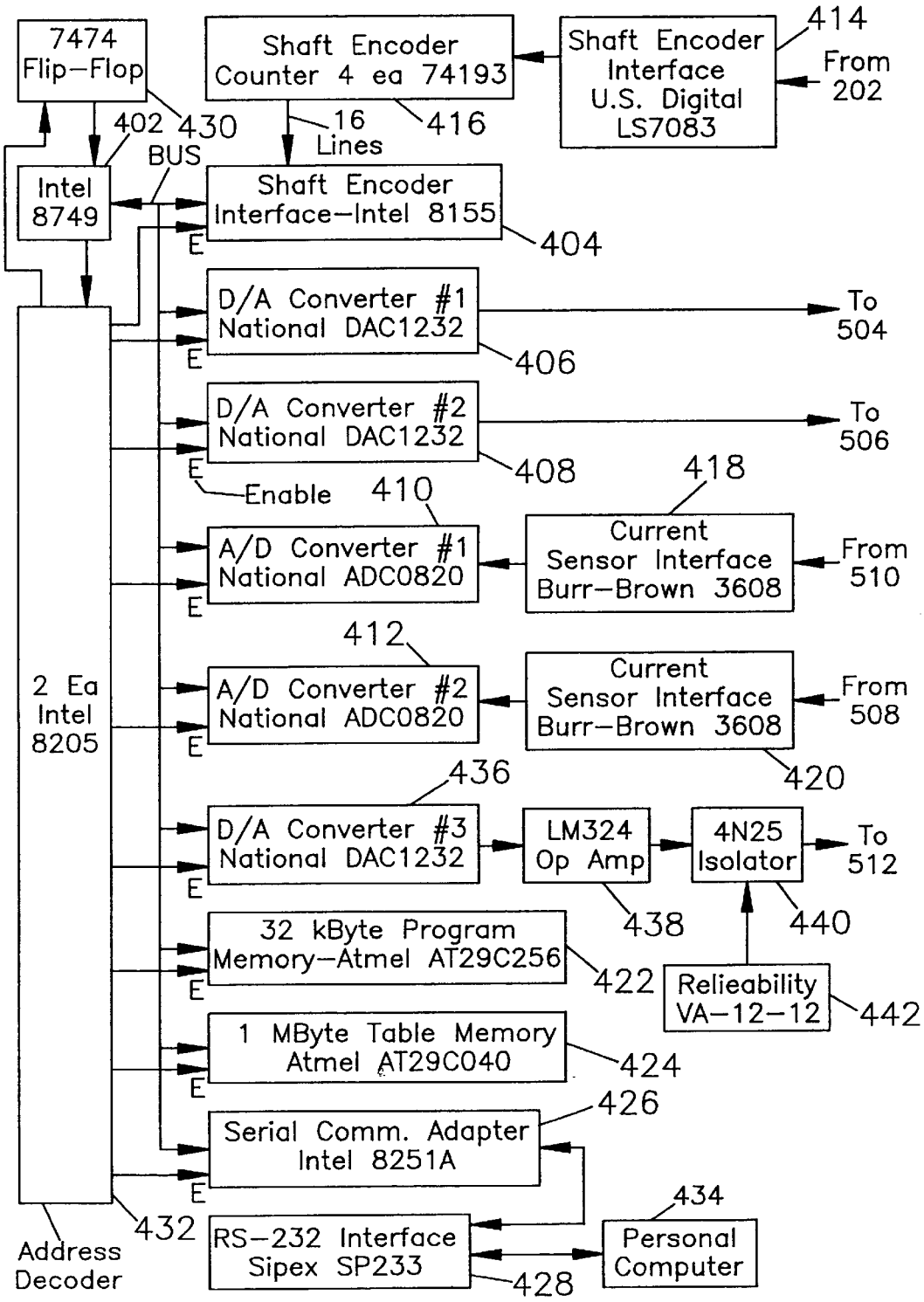
FIG. 4 is a schematic block diagram of the electrical force generation and control circuit used with the present invention.

Turning now to FIG. 4, there is shown, in schematic block diagram form, the control unit 400 of the present invention. The control unit 400 of the present invention utilizes a microprocessor 402 to collect various types of data and to produce the required outputs to control the force generation, based upon that data. The microprocessor or controller 402 may preferably be a model 8749 microprocessor, available from Intel Corporation. That microprocessor 402 includes built-in EPROM program memory.

The controller (control processor) 402 is preferably configured to collect two types of data from the circuitry of the force generation and control unit 400. The first type of data collected is the linear position of the cable adapter 306, which serves to connect the exercise machine cable 120 to the force generation and control system of the present invention. The second type of data collected is the current passing through the DC servo motor 200. Two semiconductor devices are used to control total current to the DC servo motor. Therefore, current is measured separately in the two semiconductor devices, requiring two separate analog-to-digital interfaces. The collection of position and motor current data requires a total of three interfaces to the control processor 402 that is part of the invention. Note that the use of two semiconductors produces a current balance problem that is addressed in the firmware program that executes on the control processor 402.

The controller 402 is preferably configured to provide three control outputs. These are analog signals of preferably between 0 and 10 volts, two of which are supplied to the gates of the FETs 504, 506 that are used to control the current passing through the DC servo motor 200. The third control output controls the output voltage of the DC power supply 512 that is the power source for the DC servo motor that is the force producing element of the disclosed invention. Each of the foregoing functions of the controller 402 utilizes a separate interface 404, 406, 408, 410/418, 412/420, and 436/438/440.

In addition to being connected to those six interfaces, the controller 402 is also connected to a serial communications adapted 426 which is in turn connected to an RS-232 communications interface 428, to which a personal computer 434 may be connected. Obviously, any other processor-based device programmed to communicate with the controller 402 may be utilized in place of the personal computer 434. The personal computer 434 is utilized to communicate with the controller 402 for performing a variety of functions, such as the downloading of new, improved and/or modified software that executes on the controller 402, and the downloading of new, improved and/or modified table data to be used by the software program that executes on the controller 402, the downloading of various control parameters, such as forward and reverse velocities, force/weight settings, etc. to the controller 402.

In addition, the communications interface function performed by the serial communications adapter 426 and the RS-232 communications interface 428 can also be used for the collection of information via an external device, such as the personal computer 434, or other device, regarding calories burned, maximum force generated, etc., in order to document exercise progress by one or more individual users. The serial communications adapter 426 may preferably be a model 85251A available from Intel and the RS-232 communications interface 428 may preferably be a model SP233, available for Sipex, of Billerica, Mass.

In addition to the communications interfaces 426,428 and the five other interfaces briefly discussed above, the controller 402 is also connected by means of its processor bus to an external program memory 422, which may preferably be a flash memory chip of 32 kilobytes in capacity, available, for example from Atmel, of San Jose, Calif. as model number AT29C256. That external program memory is utilized to store the software program executed by the controller 402. The controller 402 is also connected to an external table memory 424, which may preferably be of 1 megabyte capacity, consisting of two Atmel model AT92C040 chips of 0.5 megabyte capacity each. The external table memory 424 is utilized to store tables used by the control program 402 which provides instructions to the controller 402. The external program memory may preferably be implemented in a known manner using a multiplexed interface to accommodate the connectivity differences between loading the memory and executing the program it contains. The external table memory 424 includes a relatively simple address/data interface to the controller 402, that serves for both loading and reading the contents of the memory.

Turning now to a description of the seven main interfaces briefly discussed above, reference is now made to the shaft encoder I/O interface 404, which may preferably be an Intel model 8155 integrated circuit. In addition to having its enable pin connected to receive an output from the I/O address decoder 432 in a known manner, the shaft encoder I/O interface 404 receives as an input the parallel output from the shaft encoder counter 416. The shaft encoder 202 may preferably provide 2000 pulses per revolution of the DC servo motor shaft 326. The output from the shaft encoder 202 is connected to a shaft encoder interface 414 which senses the direction of the rotation of the shaft encoder 202 and generates the data and control signals necessary for the proper operation of the 16-bit up-down counter 416. The output from the shaft encoder interface 414 is fed to the shaft encoder counter 416 whose 16-bit parallel output is fed to the shaft encoder I/O interface 404.

The shaft encoder 202 may preferably be a model S1-2000-B available from US Digital of Vancouver, Wash. The shaft encoder interface 414 may preferably be an integrated circuit LS7083, also available from US Digital. The shaft encoder counter 416 is preferably formed from four 74LS193 integrated circuits, which are available from many suppliers. By utilizing the shaft encoder 202, the shaft encoder interface 414 and shaft encoder counter 416, the controller 402 has available to it at the output of the shaft encoder I/O interface 404 the state of the 16-bit shaft encoder counter 416 which indicates the position of the cable attachment device 306 along its total travel length of approximately 40 inches.

The second data sensing interface is the first analog-to-digital converter 410. That interface provides the values of the current passing through one of the two FETs 504, 506 that control the current delivered to the DC servo motor 200 in the following manner. An active, Hall affect current sensor 510, which may preferably be a Micro Switch CSLA2CD, is connected in series with the FET 504. The output of the current sensor is a small DC voltage that is directly proportional to the current passing though the FET 504. The current sensor output voltage is amplified by the current sensor interface amplifier 418, which may preferably be a Burr-Brown 3606 instrumentation amplifier, to a level falling the 0–5 volt range, which is sufficient for operation of the 8-bit analog-to-digital converter 410. This allows the microprocessor 402 to read the level of the current passing through the FET 504 to a resolution of approximately 140 milliamps.

The third data sensing interface is the second analog-to-digital converter 412. That interface provides the value of the current passing through the second FET 506, which controls the current delivered to the DC servo motor 200 in a manner identical to that described above for the FET 504. This is accomplished in conjunction with current sensor interface 420 and current sensor 508. In combination, the analog-to-digital converters, 410 and 412, allow the processor 402 to read the total current being delivered to the DC servo motor 200.

The controller 402 controls the operation of the force generation and control system of the present invention by means of the three remaining interfaces 406, 408, and 436/438/440. The first interface 406 is controlled by the microprocessor 402 so that a 0–10 volt analog signal is applied to the gate of the FET 504 so that half the current passing through the DC servo motor 200 can be specified by the controller 402. A 12-bit digital-to-analog converter 406 is used to connect the microprocessor 402 directly to the FET 504. The 12-bit D/A converter produces a 0–10 volt level at the gate of the FET 504, with a resolution of approximately 2.5 millivolts. Because of the very high gate input resistance of the FET 504, no current amplification (impedance conversion) is required between the D/A converter 406 and the FET 504. The D/A converter 406 may preferably be a model DAC1232, available from National Semiconductor. The second interface 408 operates in a manner identical to that described for the interface 406 to control the current passing through the FET 506, which also accounts for the half the current passing through the DC servo motor 200.

The third interface 436/438/440, under control of the microprocessor 402, controls the output voltage level of the DC power supply 512 that provides current to the DC servo motor 200. The 8-bit D/A converter 436, in conjunction with the operational amplifier 438, produces a 0–10 volt signal level. The D/A converter may preferably be a model DAC0830, available from National Semiconductor, and the operational amplifier may preferably be one-fourth of an LM324, also available from National Semiconductor. The programmable DC power supply 512 requires a control signal with a ground isolated from the power supply output. For that reason, the 4N25 optical isolator 440, available from many sources, and the 12-volt power supply 442, perform the isolation function, in a known manner. The 12-volt power supply 442 may preferably be a VA-12-12 from Reliability, Inc. of Houston, Tex.

Figure 5:
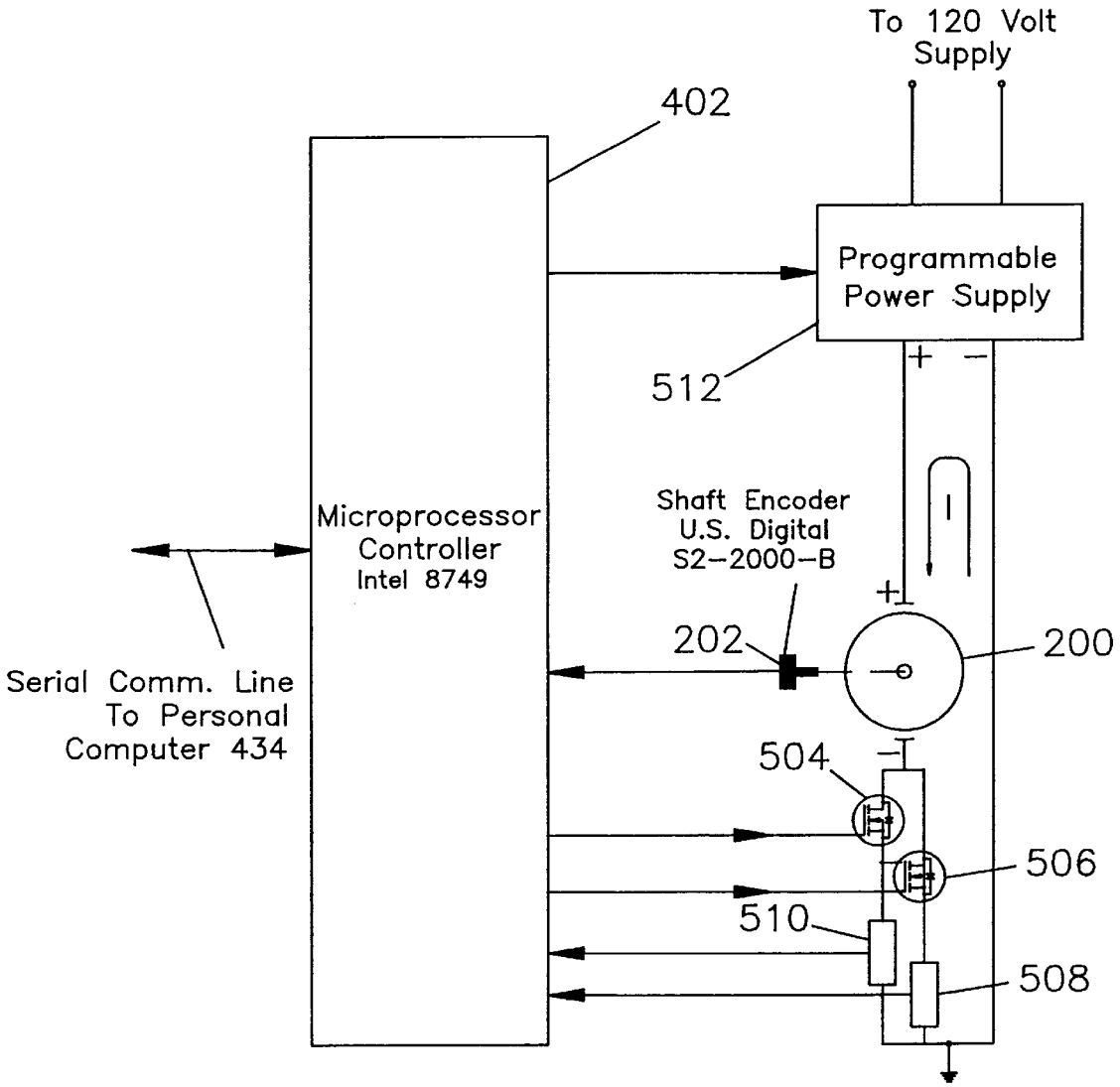
FIG. 5 is a simplified schematic block diagram of the electrical circuitry of the control processor, DC servo motor, FET semiconductor motor current control devices, current sensors, and programmable DC power supply that are part of the disclosed invention.

The force generation and control system of the present invention, utilizing the high-performance DC servo motor 200, the shaft encoder 202, the high-current field effect transistor motor current control described in connection with FIG. 5, the microprocessor-based control unit 400, and the sprocket 302, 310, bearings and mechanical components shown and described in connection with FIGS. 3A–E used to convert the rotary motion of the DC servo motor 200 to linear motion over a distance of several feet, is designed to achieve the natural feel desired by the user of the exercise machine to which the instant force generation and control system is attached, or which embodies the instant force generation and control system described herein.

Operational Modes and Supporting Capabilities/Features Provided By the Disclosed Invention The manner of operation of the three primary modes of the disclosed invention are briefly described here. An understanding of the details of the operational modes can be gained from the flow charts, flow chart descriptions, and table descriptions. In addition to the three modes of operation, the disclosed invention provides three additional capabilities/features that can be enabled/disabled via the RS-232 communications interface: Force Track, Auto Force, and Acceleration. These additional capabilities/features are also briefly described here, with operational details provided in the flow charts, flow chart descriptions, and table descriptions.

Constant Velocity Mode

In the disclosed invention, the Constant Velocity mode of operation is controlled by an algorithm that attempts to maintain velocity at a value (desired/target velocity) that is dynamically modified (based on values read from tables provided as part of the disclosed invention, and which are modifiable via a download from the external personal or other computer) as a function of position within the exercise stroke. An opportunity to change the desired/target velocity occurs every 5 milliseconds, and whether or not a change is made is determined by the particular one of the six exercise stroke segments that is currently occupied, and, in the case of the end zones, the particular position within the stroke segment. When in the end zones, a table lookup is performed to determine the desired/target velocity, and the particular table used is determined by the mid-zone desired/target velocity setting and the particular one of eight stroke length ranges occupied by the current exercise. Use of end-zone tables, and the actual configuration of the tables, to control the "feet" of the exercise are discussed elsewhere herein. Over the entire mid-zone, the desired/target velocity is constant at a preset value, with the capability to set different velocities in the positive and negative directions. As also discussed elsewhere herein, testing has shown that velocity override is required to enhance the natural feel of the Constant Velocity mode of operation of the disclosed invention. Otherwise, the stiffness exhibited by hydraulic cylinder-based exercise machines results. In the disclosed invention, override is implemented by setting an upper force limit, beyond which the algorithm reverts to the constant force mode. That is, velocity is controlled up to a preset force limit, beyond which force is held constant and velocity is allowed to reach a value controlled only by the capabilities/desires of the user.

The disclosed invention provides two additional capabilities/features when being operated in the Constant Velocity mode: Force Track and Auto Force, both of which can be independently enabled and disabled.

In the disclosed invention, Force Track operates to limit the maximum force delivered in the negative portion of the exercise stroke to no more than the maximum force achieved/delivered during the positive portion of the exercise stroke. The provision of this feature simplifies control of the disclosed invention in supporting positive and negative exercises, singularly or in combination, and guarantees that gentle positive force (initiated by the user) produces gentle negative force, when this feature is enabled.

In the disclosed invention, Auto Force operates to gradually (at a rate set in the firmware program, and therefore modifiable in the program) increase the maximum force setting, as a function of the combination of the degree to which the actual velocity is above the desired/target velocity, and the length of time the "excess velocity" condition exists. In the disclosed invention, this feature effectively allows the user to dynamically increase the maximum force delivered, during the course of the exercise.

Constant Force Mode

In the disclosed invention, the Constant Force mode of operation is controlled by an algorithm that attempts to maintain the force at a preset value. The Constant Force algorithm controls the onset and release of force in a manner that delivers an exercise feel quite different from that associated with real weights. That is, as the "weight" is moved out of the "at rest" position, force increases gradually (at a rate set in the firmware program, and therefore software modifiable) and smoothly up to the preset value. Once the preset value is reached, the force remains constant as long as the "weight" is being moved at a velocity above a preset small value (also setable in the firmware). When the velocity falls below the preset value, the "weight" is removed (at a rate set in the firmware program, and therefore software modifiable). This weight removal approach gives the user a "way out" when he/she gets more weight in the air than he/she is able to put down, without outside help (e.g., a trainer). The Constant Force algorithm produces a "gentle" exercise, suitable for medical rehabilitation and other exercise applications where jerkiness and other undesirable/unexpected results, that could possibly result from poor exercise form produced by inexperienced users, must be minimized or totally eliminated.

Auto Force, as described above, is also operative in the Constant Force mode of operation of the disclosed invention.

Force Curve Mode

In the disclosed invention, the Force Curve mode of operation is controlled by an algorithm that attempts, during each measurement cycle, to set the force delivered to the user to a value that is the sum of a "constant" (does not change dynamically) preset value and a value retrieved from a table. The Force Curve mode of operation allows virtually any force/weight (within limits set by the DC servo motor and associated control circuitry provided as part of the disclosed invention), as a function of absolute position within the exercise stroke, to be imposed upon the user of the exercise equipment. A large number of tables are provided in order to accommodate a range of stroke lengths and force curve shapes. In the disclosed invention, any one of 101 tables can be selected to operate in conjunction with any preset force from 0 to 200 pounds. The selected table contains values representing a linear ramp from zero to N pounds, where N ranges from zero to 100 pounds. The addition of the preset force and the value read from the table produces a force curve that changes linearly over the length of the exercise stroke from the preset value at the bottom of the stroke to the preset value plus the selected ramp value at the top of the stroke. A total of eight hundred and eight (808) tables are provided, 101 (covering the range from 0 to 100 pounds) for each of eight stroke lengths. Since all tables used by the disclosed invention are downloadable from an attached PC or other computer, the Force Curve tables can be changed to accommodate any desired force curve shape, and values read from the tables can be either positive or negative.

When operating in the Force Curve mode, the disclosed invention provides the capability to adjust the instantaneous force (during each 5 millisecond measurement and control cycle) in response to acceleration. Provisions are made for the user of the exercise equipment to enable and disable the acceleration function, depending upon the exercise fell he/she desires. The acceleration function uses the combination of instantaneous force and measured acceleration (positive or negative) to access (address) a set of tables that provide a force/weight value to add to or subtract from the force setting that would be imposed in the absence of the acceleration function. Conversion from the acceleration units generated by the disclosed invention to "real" acceleration in feet per second per second, conversion of force/weight to equivalent mass, and the multiplication required to produce the acceleration related force parameter is accomplished during creation of the tables. This reduces the multiplication, division, and other mathematical manipulations, that would otherwise be required, to a simple table lookup, which is more suited to the capabilities of the relatively simple microprocessor that is part of the disclosed invention.

In order to achieve the desired exercise feel, the control software utilized in connection with the system of the present invention divides the exercise stroke into three zones; bottom, middle, and top, and two directions; positive and negative. Thus, for control purposes, seven exercise stroke segments/conditions are produced. They are:

Bottom end zone, positive direction, Segment ID 1

Mid-segment, positive direction, Segment ID 6,

Top end zone, positive direction, Segment ID 4,

Top end zone, negative direction, Segment ID 5,

Mid-segment, negative direction, Segment ID 7

Bottom end zone, negative direction, Segment ID 2, and

Bottom Stopped, Segment ID 3.

Division of the exercise stroke into three zones, bottom, middle, and top, as previously described, is a key consideration in creation of the natural exercise feel produced in the Constant Velocity mode of operation by the disclosed invention. Since stroke segmentation is used as an element in the application of computer automation to the exercise force generation capabilities of the present invention, several issues arise that must be fully addressed. First, use of the force generation and control system of the present invention on multiple-position exercise machines introduces large variations in total stroke length and the absolute position of the stroke within the total movement range of the system, from one exercise position to another. Second, variations in bone length and other physical characteristics of individual users introduce additional stroke length and stroke position variations. Third, even for a specified user doing a particular exercise, stroke length and stroke position both vary to some extent during the course of an exercise set because of changes in the mood of the user and variations in his/her force output capabilities, primarily as a result of varying degrees of fatigue.

Obviously, for satisfactory operation of the force generation and control capability of the present invention, the software program implementing the control algorithm must have instantaneous access to current information regarding stroke length, stroke position, and the starting points of the bottom and top end zones. The control situation is further complicated by the fact (derived from experimentation) that creation of the desired exercise feel requires that the length of the end zones not be fixed, but that they be a percentage of the total stroke length.

In the present invention, the information required to describe the spatial characteristics of the exercise stroke (length, position, end zone start points, and end zone lengths) is obtained through full-time "dynamic calibration". "Dynamic calibration" operates continuously, and can not be disabled by the user. In the disclosed invention, the "dynamic calibration" function recomputes the bottom and top end zone start points and the length of the end zones each time the exercise stroke direction changes from down-to-up (the minimum point) or from up- to-down (the maximum point). The end zone lengths are each approximately 15 percent of the total stroke length. The disclosed invention uses multiple end zone data tables tailored to each of eight end zone lengths between approximately 2.6 and 5.8 inches, accommodating total stroke lengths between 16.5 and 40.5 inches.

In order to produce the natural exercise feel and force curve accommodation desired by the majority of users of exercise equipment, the software used by the instant force generation and control system incorporates four characteristics. Those characteristics are force limiting, response time control, acceleration tracking, and positive force tracking. Prior to discussing each of those characteristics, some background is provided with regard to the two basic control approaches applicable to exercise machine automation, namely, force control and velocity control.

In its simplest form, an exercise machine automation approach based on force control includes three elements: a controllable force generation element, a force indicator element, and a measurement and control element. In operation, the measurement and control element takes a force reading from the force indicator element, compares the reading to a desired force level, and then controls the force generation element in the manner that drives the system in the direction of the desired force. Those operations can be done either continuously, using analog elements, or discreetly, using digital elements. In that simple form described, the control software would attempt to maintain the force constant over the entire exercise stroke. However, that approach produces less desirable results than a real weight stack, since it does not accommodate the strength curve capabilities of the human body.

An improved force control algorithm, capable of providing a force curve more closely tailored to the capabilities of the human body, would attempt to track a predefined force versus position function. In that way, the force generated by the control algorithm could be made smaller in those portions of the exercise stroke where the human body is less capable, and larger in those portion of the stroke where the human body is more capable.

An exercise machine automation approach based on velocity control also includes three elements, namely, a controllable force generation element, a velocity indicator element, and a measurement and control element. In operation, the measurement and control element takes a velocity reading from the velocity indicator element, compares the reading to the desired velocity, and then controls the force generation element in the manner that drives the system in the direction of the desired velocity. There are two major advantages of a control approach based on velocity control over one based on force control.

The first advantage is the automatic accommodation of the varying force output capabilities of the human body in the different portions of the exercise stroke. That is based upon the observation that, in portions of the exercise stroke where the human body is capable of exerting less force, the velocity tends to decrease and where the human body is capable of greater force, the velocity tends to increase. The velocity control algorithm converts those attempts at velocity change into changes in force.

The second major advantage of a control approach based on velocity control over one based on force control is that without any calibration or any modification of the control program parameters, a velocity control algorithm automatically produces an infinite range of force curves (that is, force versus distance/position in the exercise stroke). Thus, different users with large variations in maximum force output capability can be accommodated automatically.

However, the user of pure velocity control or Constant Velocity does not produce the optimum exercise feel. For example, the hydraulic cylinders that have been used as the force producing elements in a variety of prior art exercise machines can be controlled to easily provide Constant Velocity. Unfortunately, such exercise machines produce an exercise feel that is far too "stiff." Therefore, in order to realize the advantages of velocity control, modifications must be introduced into the control algorithm in order to produce the desired natural exercise feel. Through extensive testing, the inventors have determined that the desired feel is achieved through the introduction of four additional parameters into the control algorithm:

force limiting,
response time control,
acceleration tracking, and
positive force tracking.

Force limiting is introduced by placing an upper limit on the signal (current/force in the instant invention) that the control element is allowed to deliver to the force producing element. That force limit is a modifiable control program parameter, but, for a given setting, the user (assuming he/she can deliver the required force) can override the force producing element. Testing has shown that this override feature adds significantly to smoothness and natural feel of the exercise.

In the instant force generation and control system, response time is controlled in two ways. First, by limiting the rate at which the microprocessor-based control element 402 takes samples and modifies the control signal delivered to the force producing element. Second, by limiting the magnitude of the changes that can be made in the signal delivered to the force producing element (that is, the drive signal) in a single measurement/control cycle. In the instant invention, control samples are taken at a rate of 200 per second, and the "velocity control" drive signal changes produced by a given error signal (that is, the difference between the actual velocity and the desired velocity) is determined by a look-up table. A look-up table implementation produces three desirable features. First, it allows for simple response time modification in the process of optimizing the feel of the machine. Second, it allows complex functions to be implemented using simple microprocessors and programming techniques. Third, it allows the gain (or force change as a function of drive signal change) of different force generation elements (that is, the DC power supply 502, the FET 504 and the DC servo motor 200) to be accommodated through simple changes in table values.

The third additional parameter, acceleration tracking, is introduced by computing acceleration, in addition to velocity, at each sample time. The drive signal change, computed on the basis of velocity error, is modified as a function of acceleration. In the instant invention, both velocity and acceleration are determined using the single shaft encoder 202. The difference between Last Position and Present Position determines the velocity (since the measurements are taken at fixed intervals), and the difference between current velocity and last velocity determines the acceleration. As in the case of response time control, a look-up table is used to determine the magnitude of the modification to be introduced into the velocity error signal in response to a given acceleration. These acceleration tracking techniques improve the response of the control software utilized by the microprocessor 402 by minimizing the overshoot/undershoot or overcompensation for a given velocity error and by shortening the settling time of the control software, that is, the time required for a given velocity error to be reduced to zero. The acceleration parameter, as used in the Constant Velocity mode of operation of the disclosed invention, is not for the purpose of directly modifying the force produce by the disclosed invention in response to Newton's second law (F=ma). Instead, the acceleration parameter is used to a velocity "predictor" to modify the change in DC servo motor current that would otherwise be made in the absence of acceleration information. Conversely, in the Force Curve mode of operation of the disclosed invention, the capability is provided (can be enabled or disabled) whereby measured acceleration is converted to real acceleration, in feet per second per second, and real force changes, proportional to instantaneous force/weight (converted to mass and instantaneous acceleration are introduced.

Table I shows, qualitatively, how the acceleration and velocity error signals are processed to compute the change in the force producing element drive signal, when the disclosed invention is operating in the Constant Velocity mode.

TABLE I

| a (speed) | | | b (slope) (acceleration) | | | |
|---|---|---|---|---|---|---|
| − | + | 0 | − | + | 0 | FET DRIVE |
| | | | POSITIVES | | | |
| Speed Low | | | Negative | | | −[f(a) + f(b)] |
| Speed Low | | | | Positive | | −[f(a) − f(b)] |
| Speed Low | | | | | 0 | −f(a) |
| | Speed High | | Negative | | | +[f(a) − f(b)] |
| | Speed High | | | Positive | | +[f(a) + f(b)] |
| | Speed High | | | | 0 | + f(a) |
| | | Speed On | Negative | | | −f(b) |
| | | Speed On | | Positive | | +f(b) |
| | | Speed On | | | 0 | No Change |
| | | | NEGATIVES | | | |
| Speed Low | | | Negative | | | +[f(a) + f(b)] |
| Speed Low | | | | Positive | | +[f(a) − f(b)] |
| Speed Low | | | | | 0 | +f(a) |
| | Speed High | | Negative | | | −[f(a) − f(b)] |
| | Speed High | | | Positive | | −[f(a) + f(b)] |
| | Speed High | | | | 0 | −f(a) |
| | | Speed On | Negative | | | +f(b) |
| | | Speed On | | Positive | | −f(b) |
| | | Speed On | | | 0 | No Change |

V(actual) − V(desired) = a
V(last) − V(present) = b

The fourth parameter introduced into the Constant Velocity mode control algorithm is that of positive force tracking. Positive force tracking is a process in which the maximum force achieved by the user in the positive portion of the exercise stroke is used as the limiting force during the negative portion of the exercise stroke. This allows the user to determine (up to the currently set force limit) the effective "weight" being used, on a stroke-by-stroke basis. The implementation of positive force tracking also prevents undesirable, high force negative-direction excursions that might otherwise result from "casual movement" (that is, by someone not currently involved in serious exercise) of the user-interface portion of the exercise machine. Thus, positive, force tracking guarantees that gentle positive movement will produce an associated gentle negative movement.

As has been briefly discussed above, a critical consideration associated with the application of computer automation to exercise equipment is the creation of an "exercise feel" that is acceptable to a large percentage of users. The inventors have determined that there are two important factors which must be satisfied in order to create such an exercise feel.

The first important factor in producing computer automated exercise equipment which has an acceptable exercise feel is that it is not necessarily desirable to simulate real weights. For example, real weights have the disadvantage that once they are "in the air," at the end of the positive portion of the exercise stroke, the user has no choice but to supply the required force to get them back to the rest position. Ideally, the user would have a choice in the matter of supplying force during the negative portion of the exercise stroke. Computer automation of exercise equipment can provide the user with this choice, real weights cannot.

The second consideration associated with the application of computer automation to exercise equipment is that it is unlikely that the exercise can be successfully dealt with utilizing a single, simple control algorithm. The most obvious need for differentiation lies in the fact that, as discussed, the exercise stroke clearly must be addressed differently during its positive half and its negative half. In addition, the extremities of the exercise stroke, that is, the end points, must be addressed differently, due to the fact that a change in both velocity and direction must be accommodated in the stroke extremities. For that reason, the present system addresses the exercise stroke in the six segments previously discussed. End zones that are approximately fifteen percent of the total stroke length have been shown to produce good results. The total stroke length, however, varies as a function of exercise type, individual user physical characteristics and, to some extent, differences in the manner in which a given user does a given exercise from one exercise stroke to the next and from one exercise set or session to the next. Dynamic calibration, which is incorporated in the control software of the present invention, continuously compensates for changes in total stroke length and end zone start points.

The Constant Velocity control algorithm utilized by the instant invention is based upon a combination of velocity control and force control to which several modifications/additions are made in order to deal with the extremities of the exercise stroke, as well as to improve the exercise feel produced. The application of the control software to the six segments of the exercise stroke is as described below.

In the first stroke segment, namely the bottom end zone, positive direction, the velocity control algorithm is applied, but the desired velocity is dynamically modified as a function of position, starting with a desired velocity which is lower than the second segment (mid-segment, positive direction) value, which is then gradually increased to the second segment value as the second segment is entered.

In the second stroke segment, namely the mid-segment, positive direction, the velocity control algorithm is applied, with a constant desired velocity.

In the third stroke segment, namely the top end zone, positive direction, the velocity control algorithm is applied, with the desired velocity dynamically modified as a function of position. The dynamic modification of desired velocity as the top end zone is traversed produces the desired natural feel in the upper extremity of the exercise stroke.

In stroke segment four, which is the top end zone, negative direction segment, the velocity control algorithm is applied, but the desired velocity is dynamically modified as a function of position.

In stroke segment five, which is the mid-segment, negative direction, the velocity control algorithm is applied, with a constant desired velocity.

Finally, in the stroke segment six, which is the bottom end zone, negative direction, the velocity control algorithm is applied, but the desired velocity is dynamically modified as a function of position, starting with the mid-zone desired/target velocity. The desired velocity is gradually decreased to a small value over the length of the end segment, which allows both force and velocity to go to zero at the bottom end of the exercise stroke. When the instant force generating and control system is at rest at the bottom of the stroke, the microprocessor 402 causes sufficient current to flow to the DC servo motor 200 to keep the exercise machine cable 120 tight.

The operation of the force generation and control system of the present invention is controlled by a computer program running on the microprocessor 402. The microprocessor 402 executes, in real time, the measurement and control functions associated with the force generation and the feel of the exercise. Optionally, a second program may be running on the personal computer 434 which serves to support exercise selection and the collection, storage, and processing of data from the microprocessor 402 relative to one or more users and specific exercises.

The microprocessor program is responsible for taking position measurements, completing the required mathematical calculations and table lookups, and controlling the force delivered to the user of the exercise machine. These operations are accomplished preferably 200 times per second. A diagram of a flow chart of the microprocessor program is shown in FIGS. 7A–7A1-16, and program execution is described in detail below. But first, some high level information relative to the manner in which exercise stroke control is implemented and the lookup tables that are utilized is provided.

In the disclosed force generation and control unit, the feel of the exercise stroke is a direct result of the manner in which current is controlled in the DC servo motor that is the force producing element—current in the DC control motor and the force felt by the user of the exercise equipment are directly related by the torque constant (inch-pounds per ampere) of the DC servo motor and the physical configuration of the rotary-to-linear motion conversion components (sprockets, chains, etc.). The control program that executes on the microprocessor that is part of the disclosed invention provides two different algorithms for modifying the current flowing in the DC servo motor: relative and absolute. The two current control approaches are required for different reasons, in different parts of the exercise stroke, and in different modes of operation.

Relative current control is used when the required absolute current (or force) level is NOT known, but where knowledge IS available concerning the direction (increase or decrease) of the required current change. Relative current control is used extensively in the Constant Velocity mode of operation of the disclosed invention. In the Constant Velocity mode, the magnitude of the difference between desired/target velocity and actual velocity, modified by acceleration, and the portion (positive or negative) of the exercise stroke that is being executed, determine whether motor current should be increased or decreased. When the Constant Velocity mode of operation is being executed, both minimum and maximum current (force) levels are imposed, and in cases where the current being delivered to the DC control motor is between these two values, the relative current control algorithm is executed.

Absolute current/force control is imposed when the absolute value of the desired current/force level is known. This occurs in the Constant Velocity of operation when current/force is, for whatever reason, outside the range between minimum and maximum (or when the prediction algorithm shows that the projected RELATIVE current/force change will cause the force to fall outside this range), or when the Constant Force or Force Curve modes of operation is being utilized. A further point of clarification is required with regard to the manner of operation of the absolute current/force control algorithm/subroutine. The algorithm/subroutine that implements absolute current/force settings is controlled by the calling routine (via parameters that are passed), in both the rate at which the small current/force changes required to reach the target current/force value are made, and in the number of loops (multiple loops through the subroutine are generally required) allowed during a single CALL to the subroutine. This is associated with implementation of the response time control feature previously identified.

As briefly indicated above, the need for both relative and absolute current/force control in the control program of the disclosed invention, the requirement to switch from one control approach to the other under certain circumstances, and the desire/need to avoid current/force overshoot and undershoot (relative to the maximum and minimum force settings in operation when Constant Velocity mode is being utilized) introduce the need for a mechanism whereby the control algorithm can "identify" that the current/force change that is about to be made by the relative control algorithm will cause current/force to fall outside the range between maximum and minimum. A "prediction" algorithm is provided to accommodate this situation. This algorithm is based upon the relatively linear relationship between the drive voltage delivered to the gates of the FETs that control motor current, and the actual current delivered to the motor (the FET drain current). The slope of the FET gate voltage-drain current relationship is used to predict the result of each anticipated gate drive voltage change. If the resulting current/force is predicted to be above maximum or below minimum, then the absolute algorithm is called, with calling parameters set for maximum or minimum current/force, respectively.

The dynamic calibration function that runs continuously in the disclosed force generation and control unit control program operates as follows. During each 5 millisecond measurement/control cycle, position is tested for maximum or minimum. Maximum is identified by the condition where the last direction (sign of velocity) was positive and the present direction is negative. Minimum is identified by the condition where the last direction (sign of velocity) was negative and the present direction is positive. Each time a maximum or minimum position is identified, the minimum/maximum routine (MINMAX) that completes the dynamic calibration process is called. The MINMAX routine determines stroke length (by subtracting minimum from maximum), does a table lookup to determine stroke length range, does a table lookup to determine end zone delta (the amount to add to minimum and subtract from maximum to determine the start points of the top and bottom end zones—end zone delta is a function of stroke length range), and computes the new top and bottom end zone start points. Dynamic calibration allows the disclosed invention to accommodate large, dynamic (and/or static) variations in stroke length and relative stroke position from one exercise to another and from one user to another. The calibration process identifies which of the end zone tables (of the total of 256) that is currently active.

Table Descriptions

In executing the Force Generation and Control Unit (FGCU) control program, the processor that is an integral part of the disclosed invention requires access to an extensive set of tables. These tables are contained in two 512K Byte flash memory chips 422,424, the contents of which are downloadable from an external personal computer 434, attached to the FGCU via a serial RS-232 communication interface. As the table values are transmitted, byte-by-byte, by the personal computer, they are received and stored in the flash memory chips under control of a program contained in the EPROM memory of the control processor 402. The tables are briefly described here, as an aid to understanding the basic manner of operation of the FGCU control program, and to support the flow chart description provided below.

The first of the two 512K Byte flash memory chips holds the End Zone tables that are used by the FGCU control program to accommodate the velocity and direction changes that are required in the extremities of the exercise stroke. Each End Zone table contains values of desired/target velocity versus position within the end zone. 2048 bytes are set aside (the unused portion, which varies from one set of tables to the next, is filled with 01 Hex) for each table, and a total of 256 (eight sets of 32) tables are utilized. Each of the eight table sets corresponds to a particular stroke length between 18 and 39 inches, in increments of three (3) inches. Each of the 32 tables in a set corresponds to a particular desired/target velocity starting point. Desired/target velocities from 14–33 HEX (20–51 Decimal), inclusive, in increments of one (1) are accommodated. This range corresponds to actual linear velocities of approximately 15 to 38 inches per second. Any desired mathematical function (e.g., circle, ellipse, straight line, etc.) could, of course, be used to generate the tables, and the ability to utilize any desired function allows tailoring of the feel of the exercise in the end zones. The disclosed invention utilizes tables generated using the equation for a straight line, with negative slope equal to the desired/target velocity divided by the particular one of the eight end zone lengths being addressed. This is made clear by FIG. 6, which is an example of the 32 tables for the 39-inch stroke length. Each of the line segments shown in the figure (for clarity, not all 32 are shown) ends in the common point where velocity is zero and position is 1552. The starting point for each of the line segments (at the entrance to the end zone) is at the currently set mid-zone desired/target velocity for the direction in question (up or down).

The second of the two 512K Byte flash memory chips holds several different types of tables. The table segment from address 00000 to 000FF Hex constitutes one 256 Byte table, and is used by the DRVMINUS and DRVPLUS (see flow chart descriptions) routines for the purpose of predicting the force change that will result from a given FET drive change.

The table segment from 00100 to 007FF Hex constitutes seven (7) 256 Byte tables, one for each of the seven stroke segments (including "Bottom Stopped," which is not accessed), and is used to determine the FET drive level change to make in response to a given velocity error (after adjustment for acceleration). The use of a separate table for each stroke segment supports tailoring of the response of the algorithms to the individual needs of each stroke segment, to produce the desired exercise feel.

The table segment from 00800 to 00FFF Hex constitutes seven (7) 256 Byte tables, one for each of the seven stroke segments (including "Bottom Stopped," which is not accessed), and is used to determine the magnitude of the modification to the FET drive level changes (in response to given velocity errors) to account for acceleration. The use of a separate table for each stroke segment supports tailoring of the response of the algorithms to the individual needs of each stroke segment, to produce the desired exercise feel.

The table segment from 01000 to 013FF Hex is a single 1024 Byte table that supports lookup of the End Zone Delta (amount to add to the minimum stroke position [MIN] and to subtract from the maximum stroke position [MAX] to determine the top and bottom end zone start points) that corresponds to a given total stroke length (MAX minus MIN). In using this table, the least significant Hex character of stroke length (which is a total of four characters) is truncated (see the flow chart for the STRKRNGE subroutine). Also, the End Zone Delta obtained from the table is only two Hex characters, whereas three characters are required to accommodate the total End Zone Delta range. A Hex "zero" is added to the looked up End Zone Delta as the least significant character. The truncation and character manipulations reduce the size of the table by a factor of 16, simplify the address calculations accomplished by the table lookup subroutines, and do not materially detract from the results achieved in dynamically tracking and responding to stroke length variations from exercise-to-exercise and user-to-user by the disclosed invention.

The table segment from 01400 to 014FF Hex is a single 256 Byte table, with a total of only eight (8) table addresses used. The index into this table is the End Zone Delta (a total of only eight different values) looked up as described above. The value obtained from this table is one of eight values, 0 through 7, corresponding to the eight stroke length ranges that are accommodated (see the flow charts for the LOOKUP and LOOKUP2 subroutines).

The table segment from 01500 to 015FF Hex is a single 256 Byte table that is used by the control processor 402 that is part of the disclosed invention to control the output voltage of the programmable DC power supply 512 that is the power source for the DC servo control motor 200 that is the force producing element of the disclosed invention. The total loop voltage available to deliver current to the DC servo motor 200 is the algebraic addition of the power supply voltage and the "back EMF" (output voltage) of the servo motor 200, that results from rotation of the motor armature conductors through the motor's magnetic field (produced by the permanent magnets that make up the motor stator). On the forward (positive) half of the exercise stroke, the output voltage of the servo motor 200 adds to the power supply 512 voltage. On the reverse (negative) half of the exercise stroke, the output voltage of the servo motor 200 subtracts from the power supply 512 voltage. The output level of the programmable DC power supply 512 is controlled by the microprocessor 402 that is part of the disclosed invention, to maintain the total voltage available to deliver current to the DC servo control motor 200 nearly constant. The lower eight bits of the table address are produced by shifting the velocity (as read by the control processor) one bit to the right, and setting bit-7 (the most significant of the lower eight bits) to a 1 if the direction is up (positive half of the exercise stroke) and to a 0 if the direction is down (negative half of the exercise stroke).

The table segment from 01600 through 025FF Hex is a single 4,096 Byte table that is used by the FRCCRV (Force Curve mode) algorithm, when Acceleration is enabled, to add to the total force being delivered to the user of the exercise equipment, in response to the combination of instantaneous force and acceleration. The table address is generated by the control processor that is part of the disclosed invention. First, a three Hex digit (12 binary bits) quantity is formed as follows: the seven bits, 0 through 6 are the seven most significant (of a total of eight) bits of computed force for the stroke position in question (force that would be delivered if acceleration were disabled); bits 7 through 10 are the four least significant bits of measured acceleration magnitude (tests show that acceleration never exceeds "0F" Hex); and bit 11 is the sign of acceleration—"1" if acceleration is negative, "0" if acceleration is positive. The complete 19-bit address is obtained by adding the 12 bit quantity just described to 01600 Hex. As pointed elsewhere, herein, measured acceleration is converted to feet per second per second, force/weight is converted to equivalent mass, and the required multiplication (F=ma) are accounted for by the values loaded into the table.

The table segment from 40000 through 7FFF Hex is a 256K Byte table, made up of eight (8) 32K sub-tables. These tables are used by the FRCCRV (Force Curve mode) algorithm to compute the force/weight to be delivered to the user of the exercise equipment, as a function of position, when the Force Curve mode of operation is be used. In the Force Curve mode, the force/weight delivered to the user by the disclosed invention is determined by adding the "base" force setting to a ramp value read from the table being described here. This table size supports changes in force approximately every one-quarter inch during the course of the stroke. Tests show that this resolution produces force changes that are imperceptible in the Force Curve mode of operation of the disclosed invention, and reduces the total table size that would otherwise be required by a factor of 64 (see table address computation description below). Eight tables (of 32K bytes each) are required because of the fact that the dynamic calibration that is accomplished by the disclosed invention produces a total of eight stroke length ranges from 18 to 39 inches, in increments of 3 inches. Tests show that this resolution is completely satisfactory for both the Constant Velocity and force Curve modes of the disclosed invention (the Constant Force mode does not use stroke length data). The tables included in the disclosed invention describe a linear function from 0 pounds at the lower extremity of the exercise stroke to N pounds at the upper extremity of the stroke, where N has values from 0 to 100 pounds. This allows any base force from 0 to 200 pounds to "ramp up," over the course of the exercise stroke, by any amount between 0 and 50 percent. Obviously, the table could as easily contain values to produce any type of "force curve" desired (table values can be positive or negative), and the disclosed invention includes provisions for down-loading any values desired into the tables.

The Force Curve table address is formed by the control processor that is part of the disclosed invention, as follows: bits 0 through 7 are measured position shifted 6 places to the right (divided by 64), bits 8 through 14 identify the particular ramp selected (could accommodate 128 tables—only 101 are utilized), bits 15 through 17 are stroke length range (see the STRKRNGE flowchart, FIG. 7A1-4), and bit-18 is a "1".

Flow Chart Descriptions

Figure 7A:
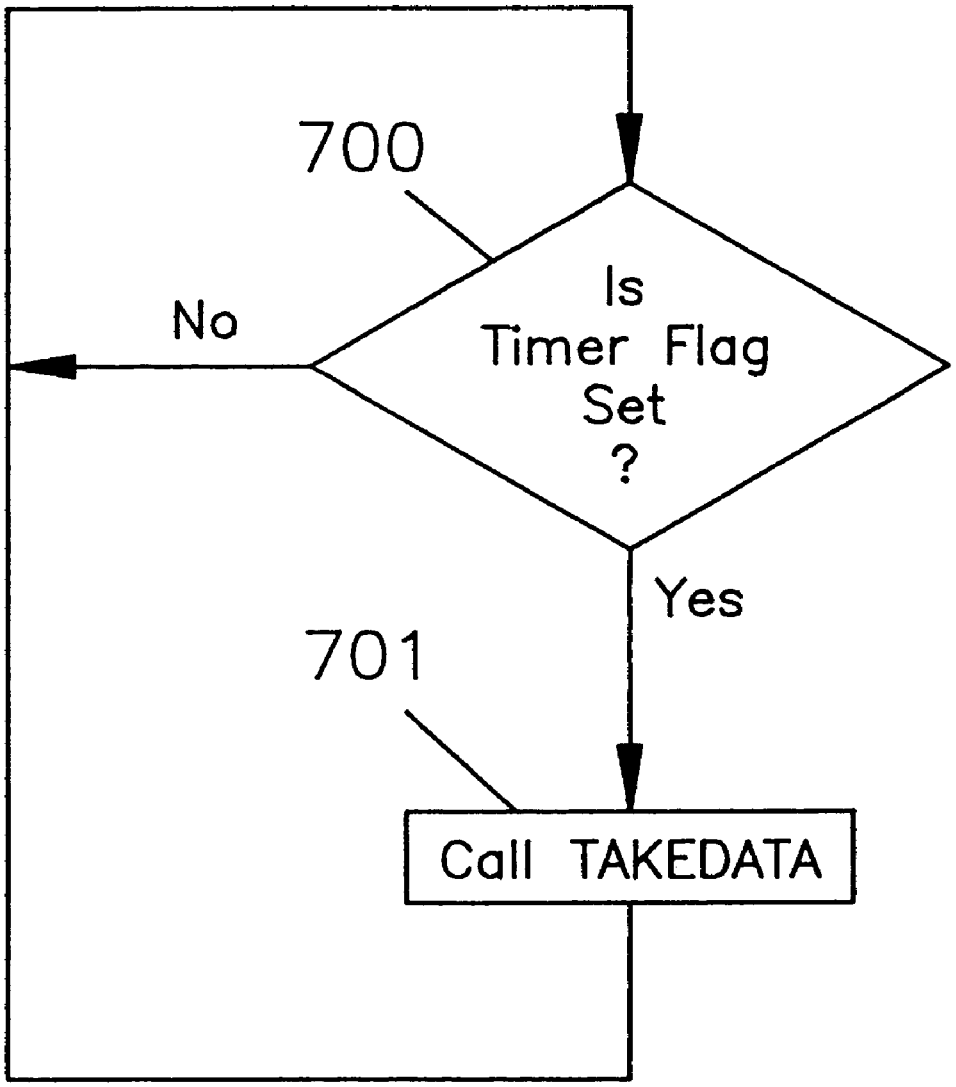
Figure 7B:
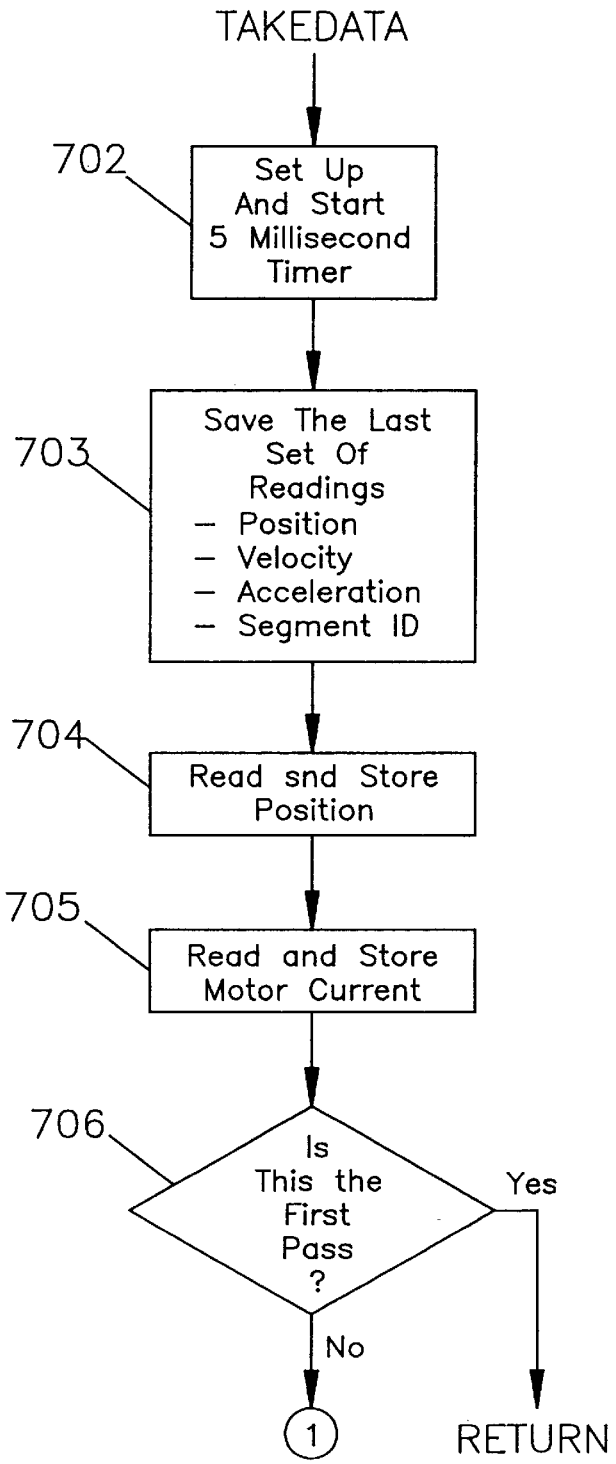
Figure 7C:
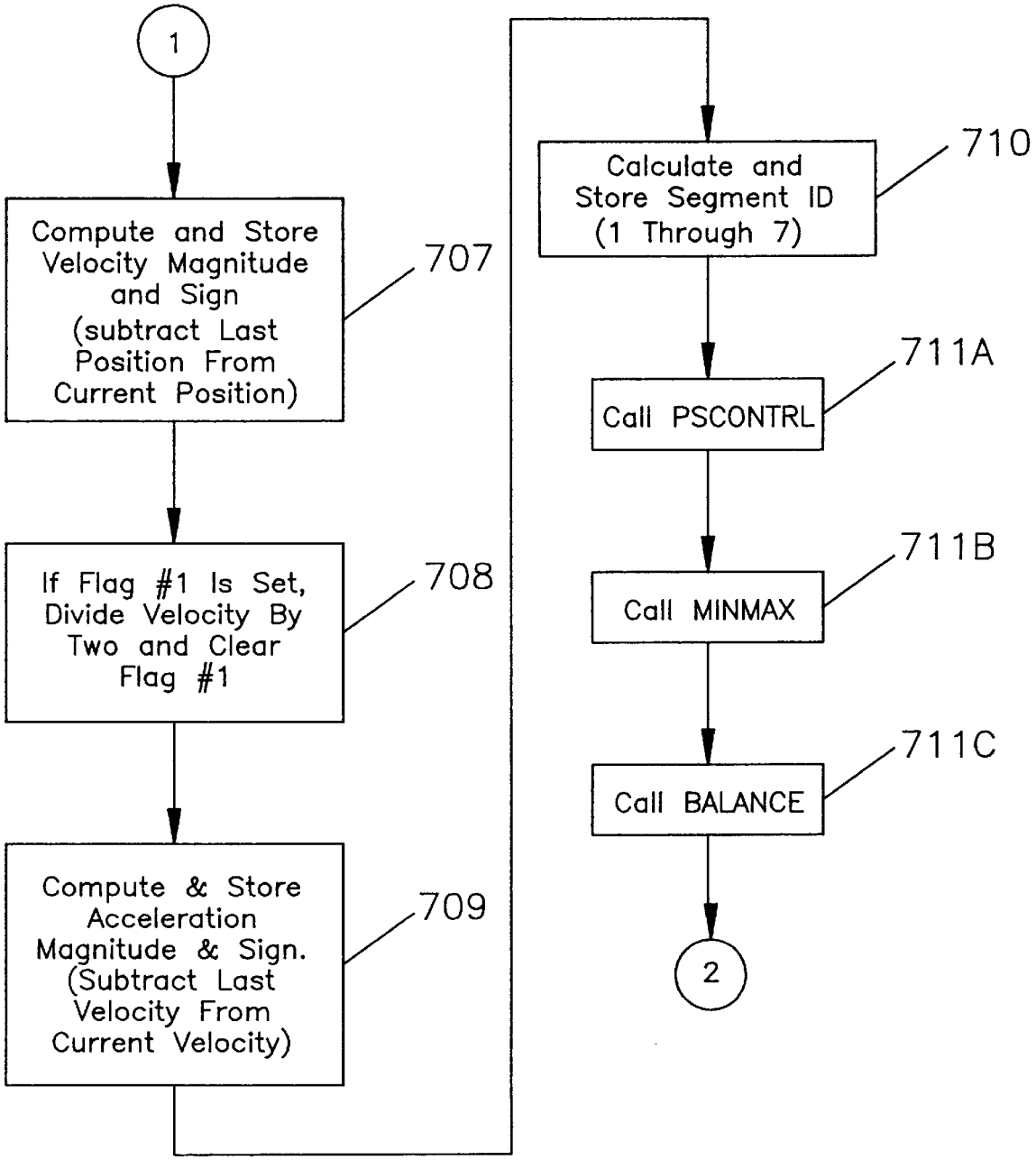
Figure 7D:
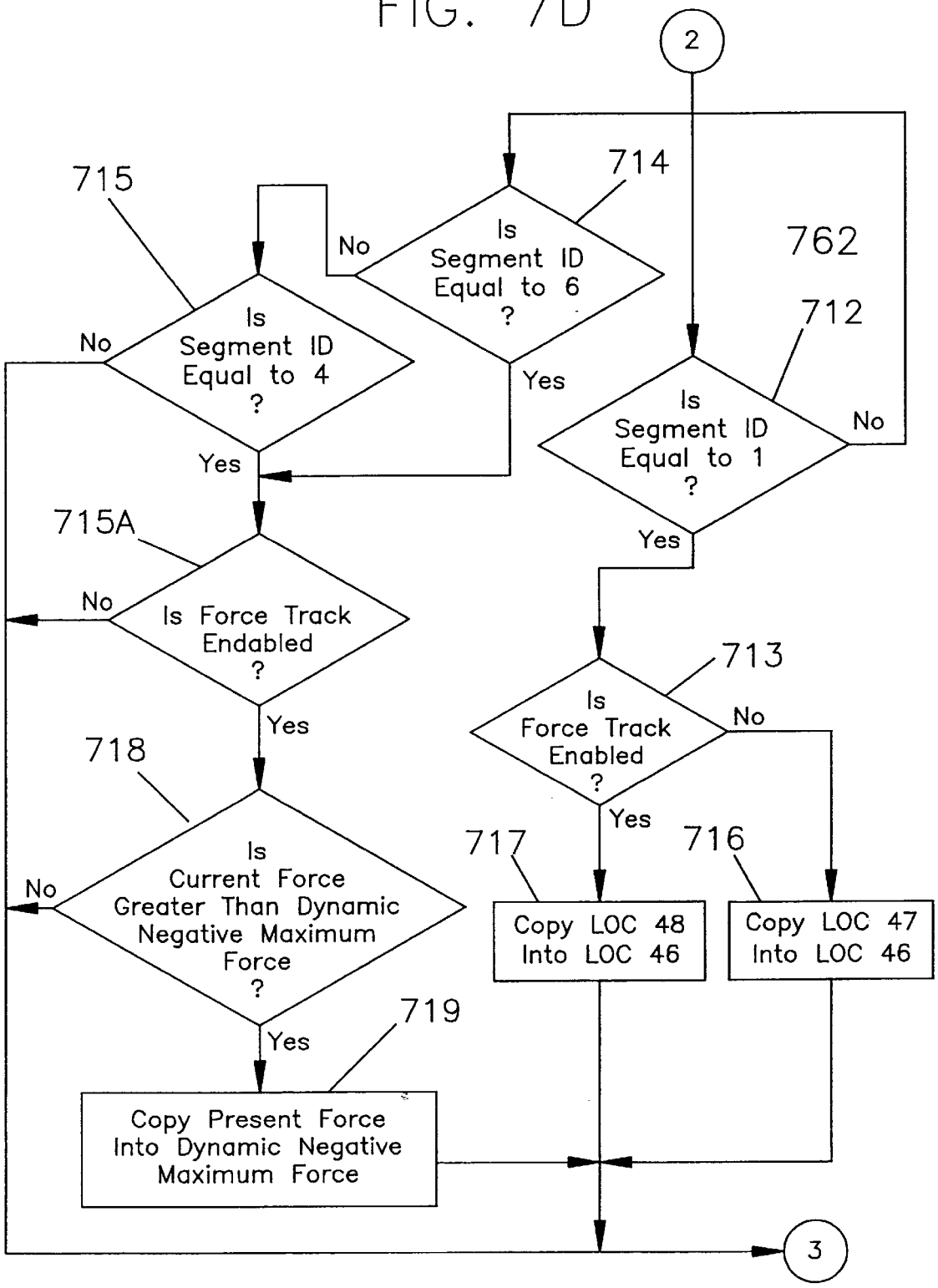
Figure 7E:
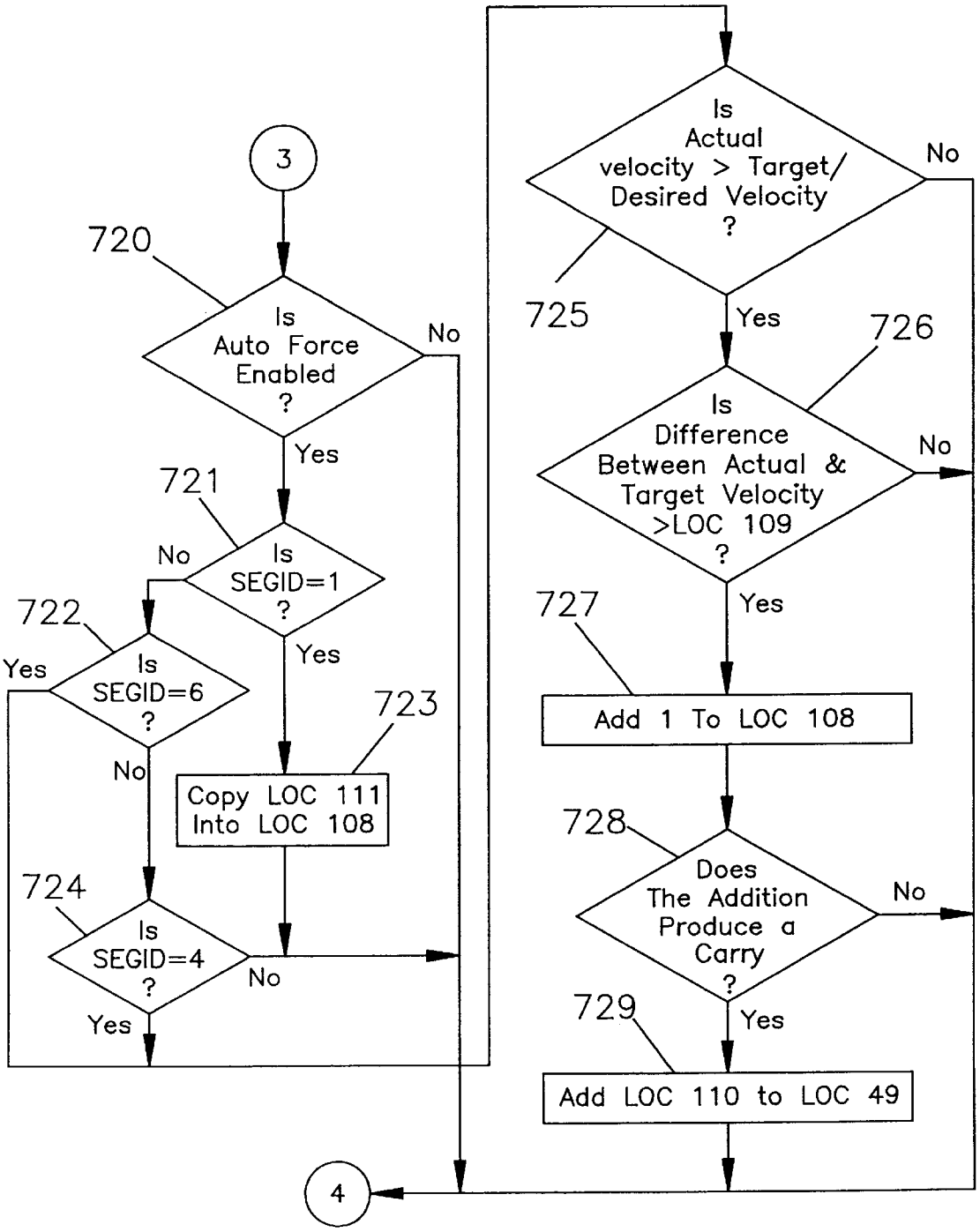
Figure 7F:
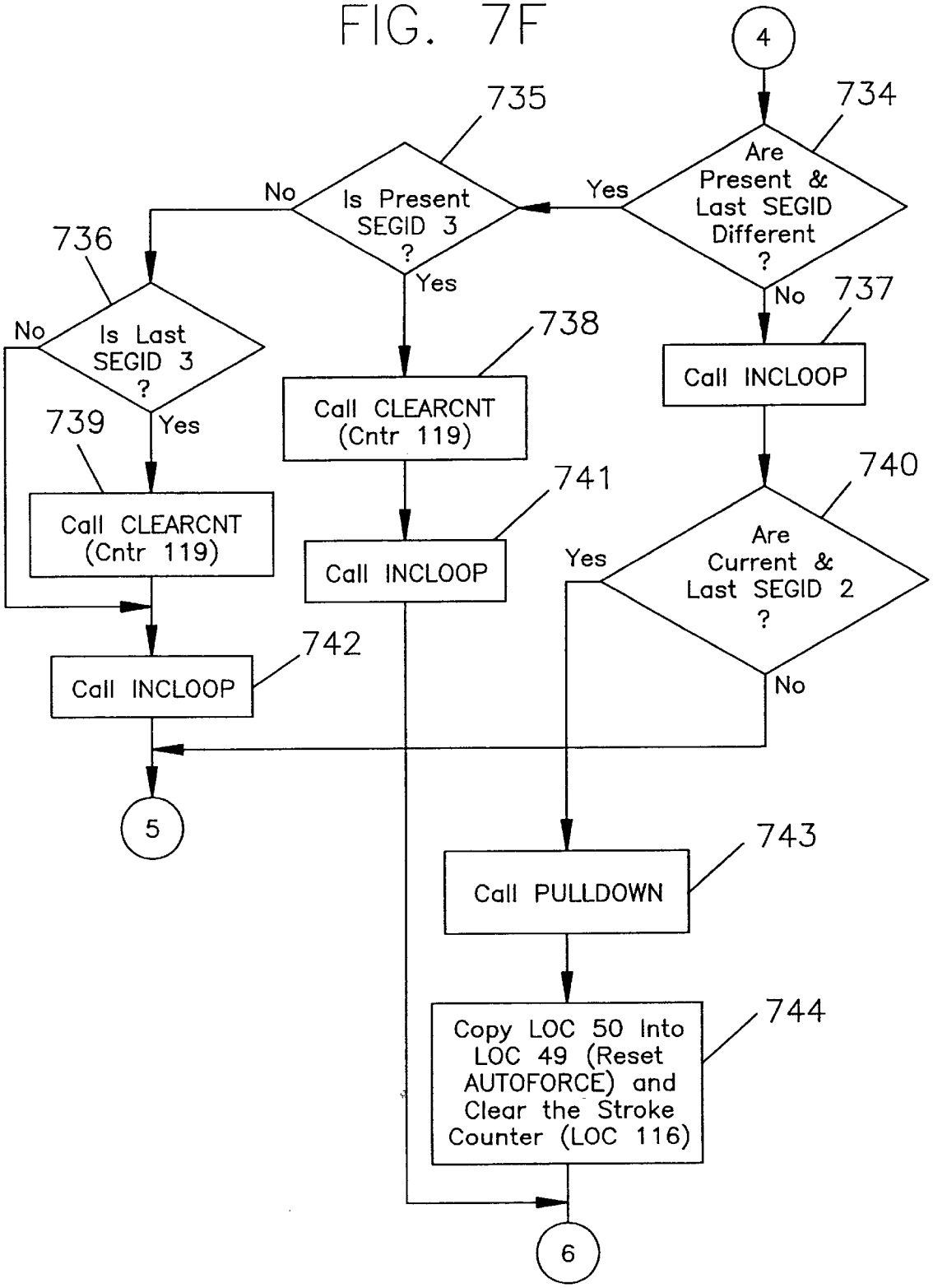
Figure 7G:
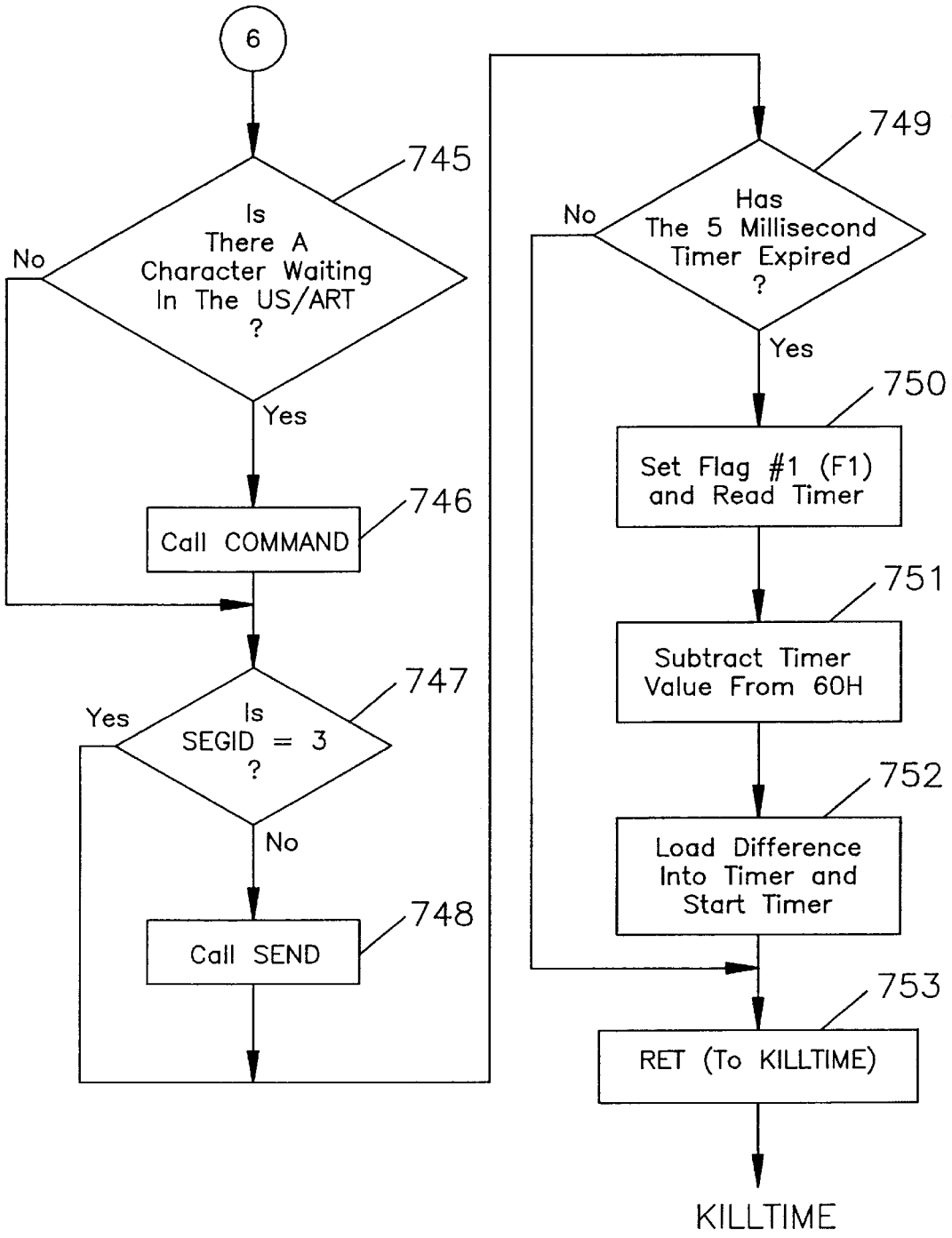
Figure 7H:
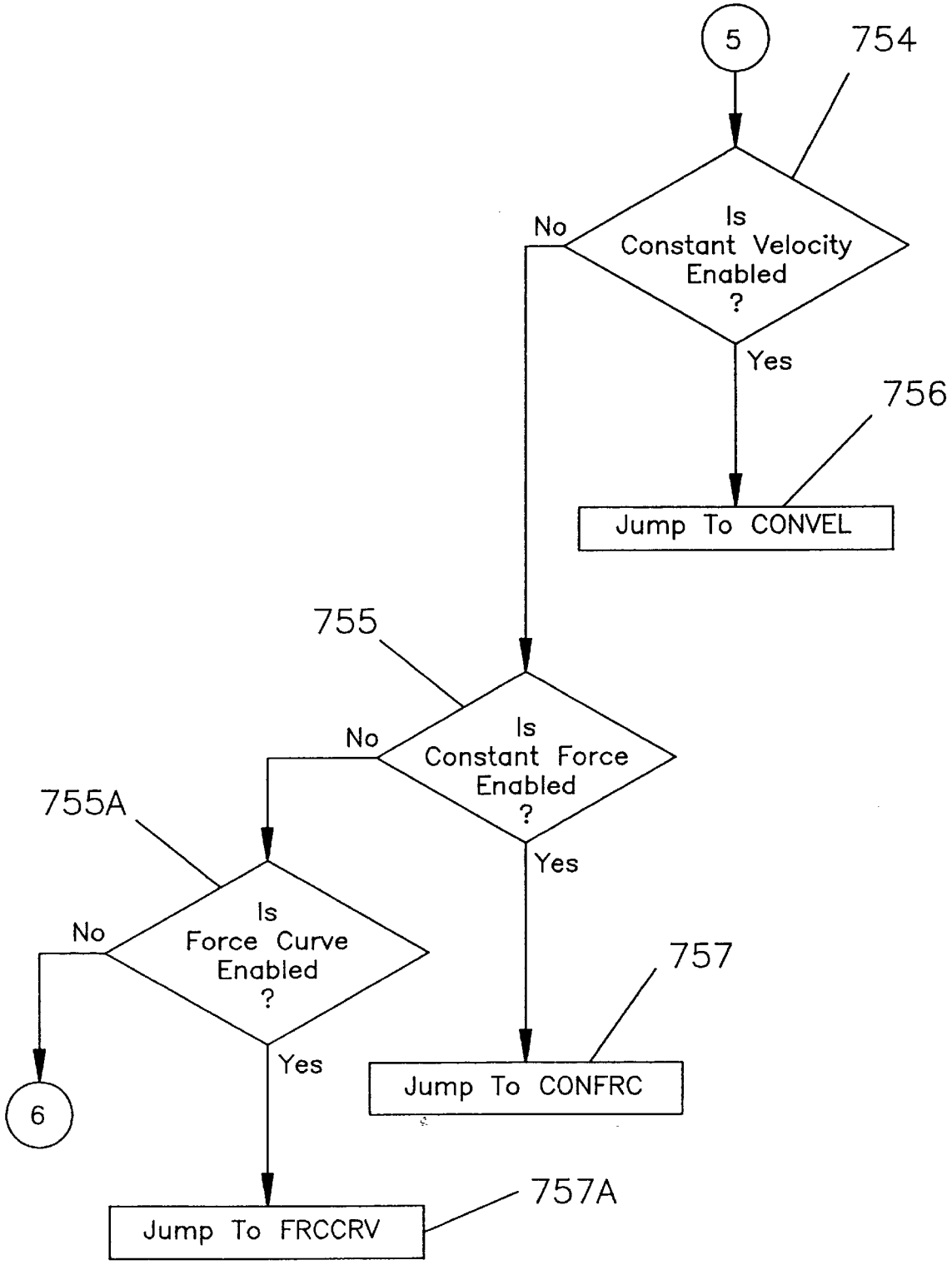
Figure 71:
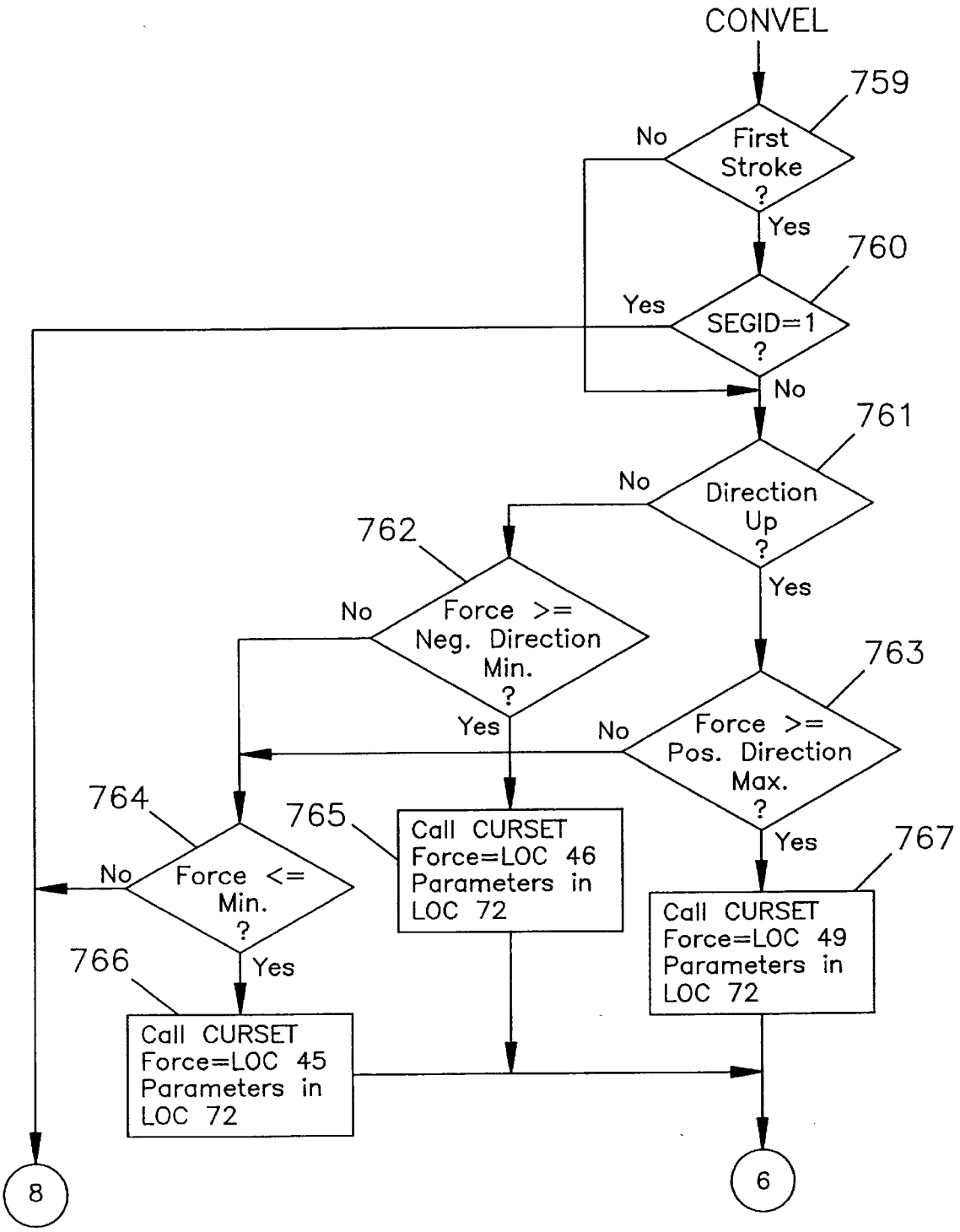
Figure 7J:
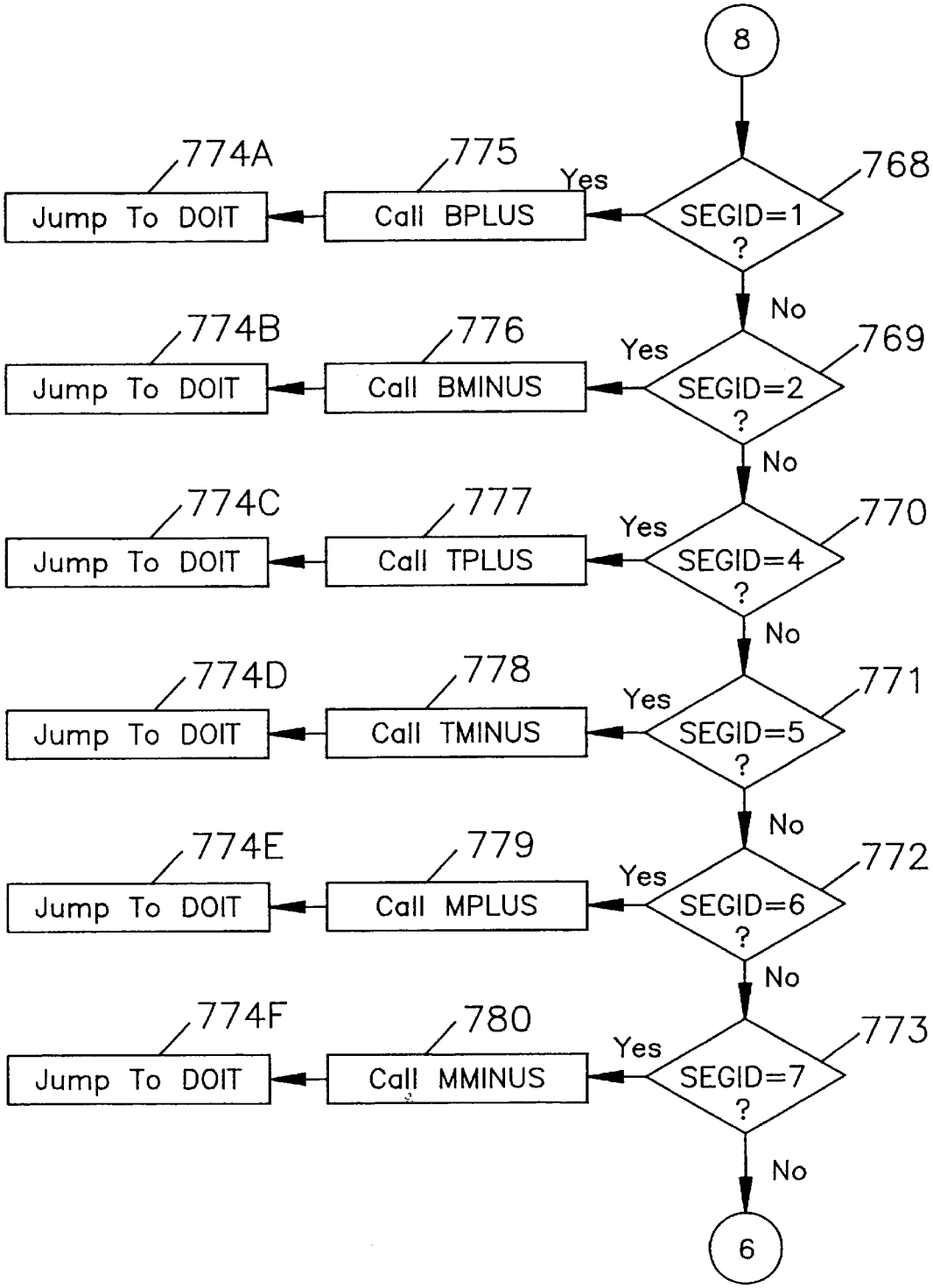
Figure 7K:
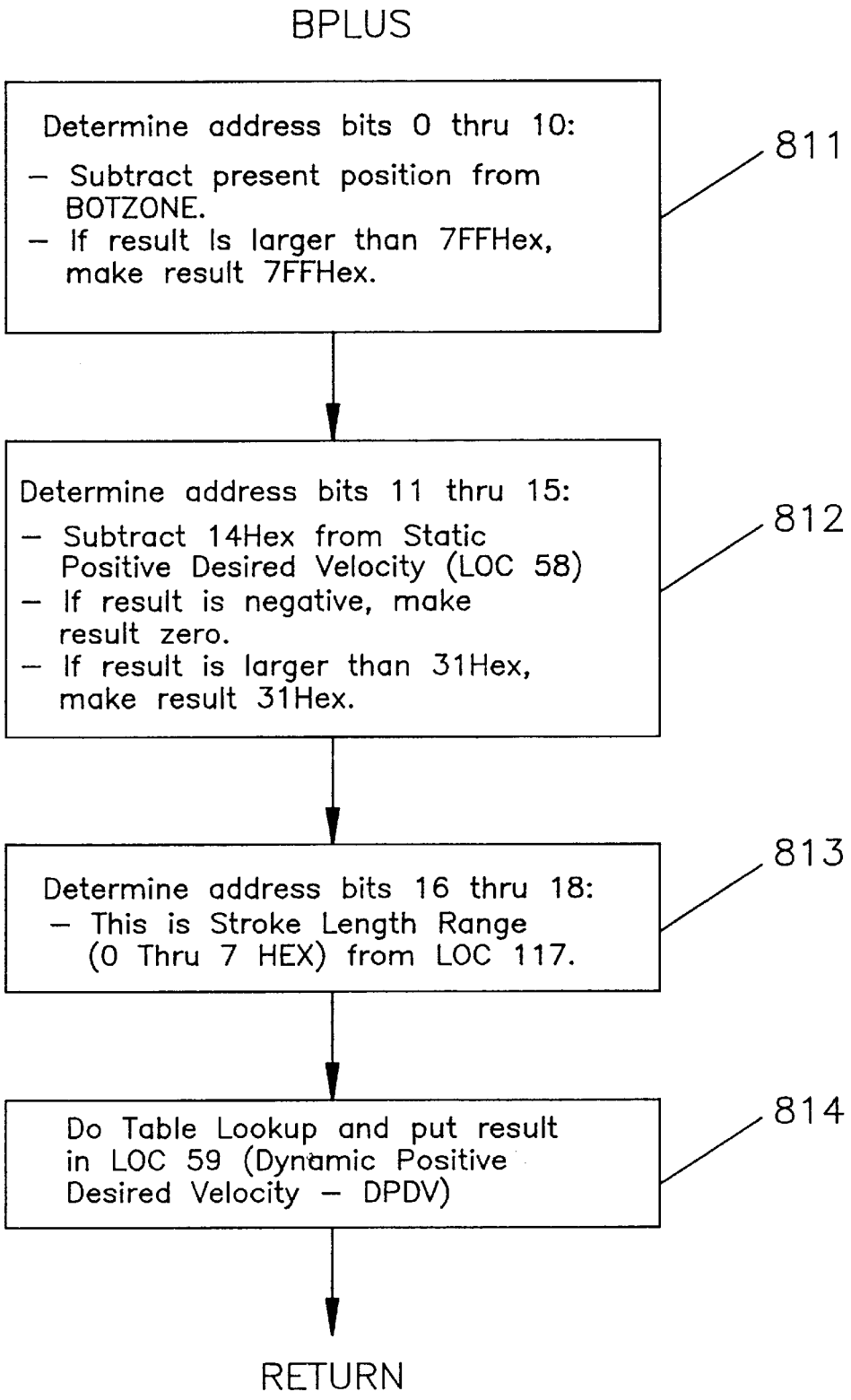
Figure 7L:
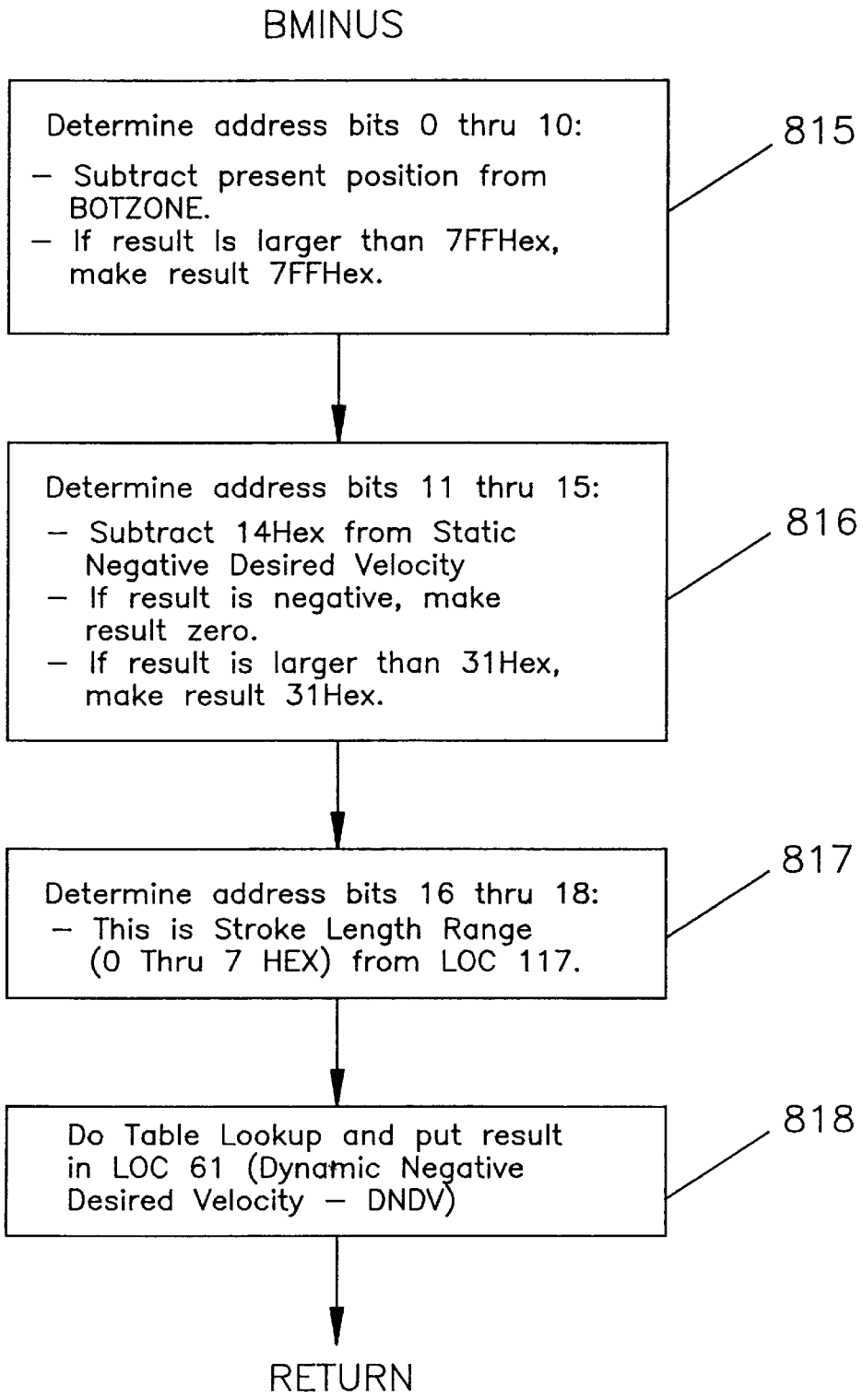
Figure 7M:
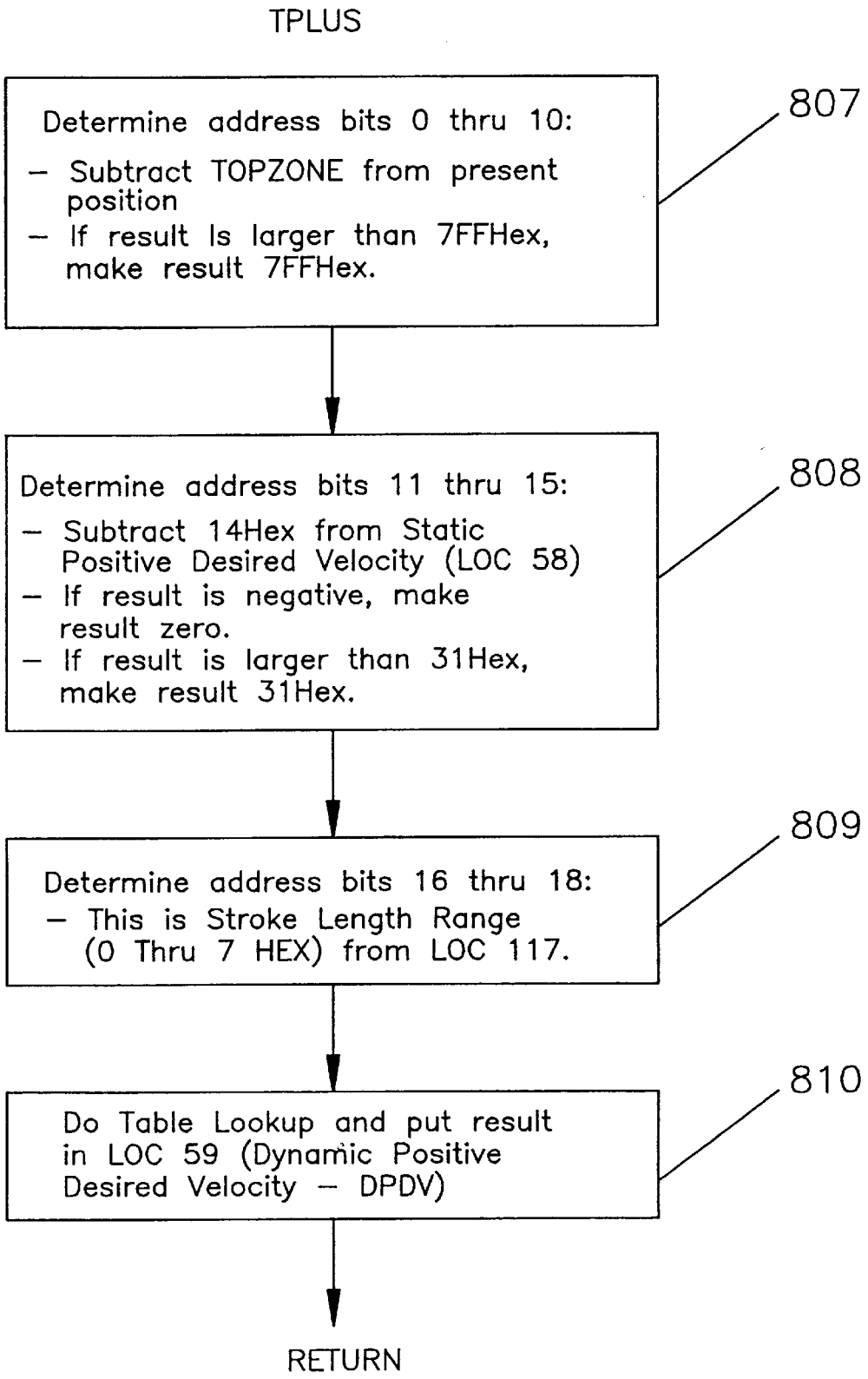
Figure 7N:
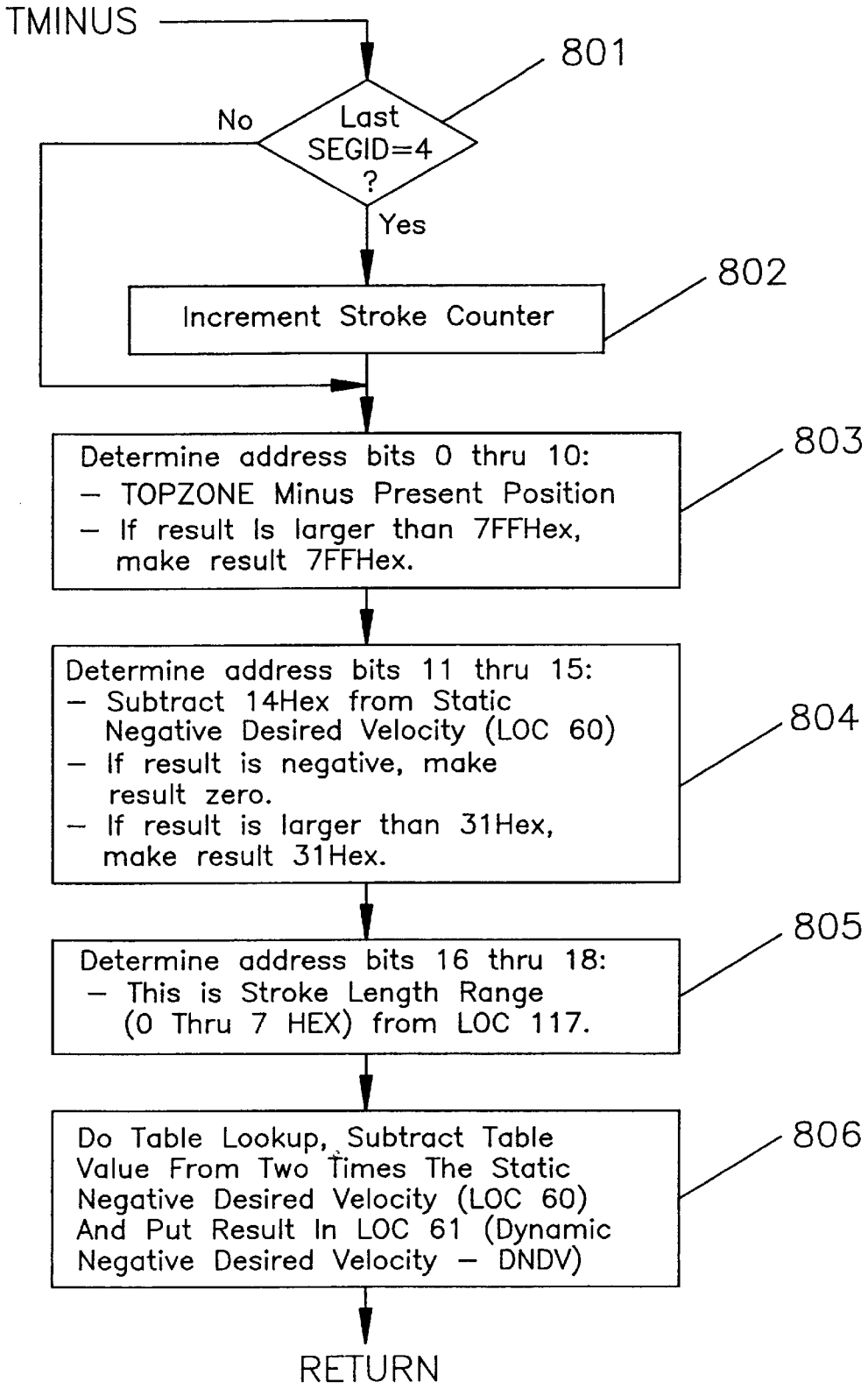
Figure 7O:
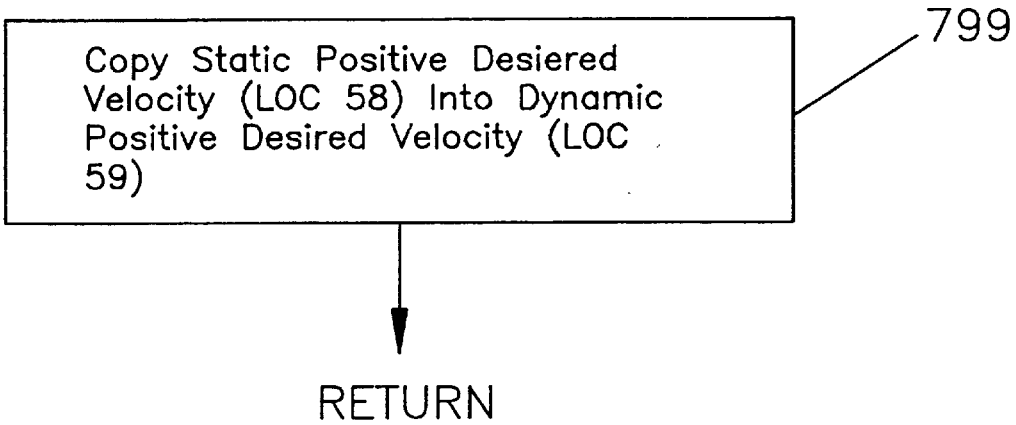
Figure 7P:
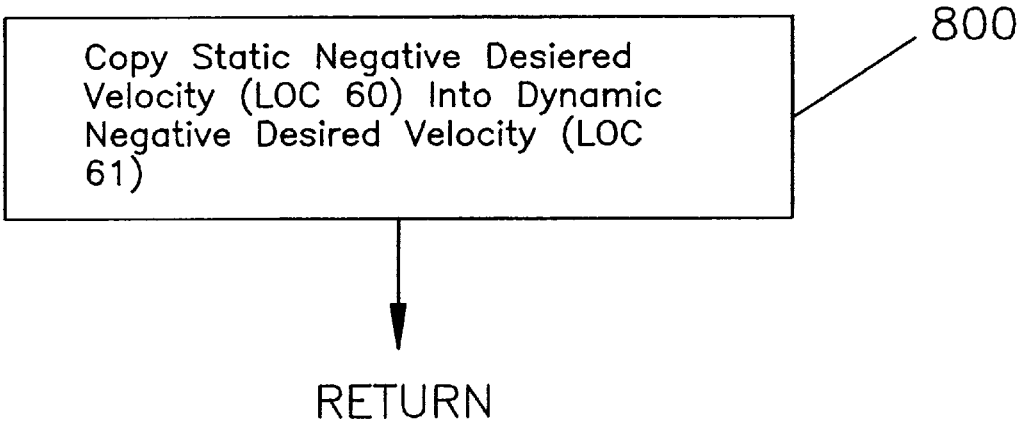
Figure 7Q:
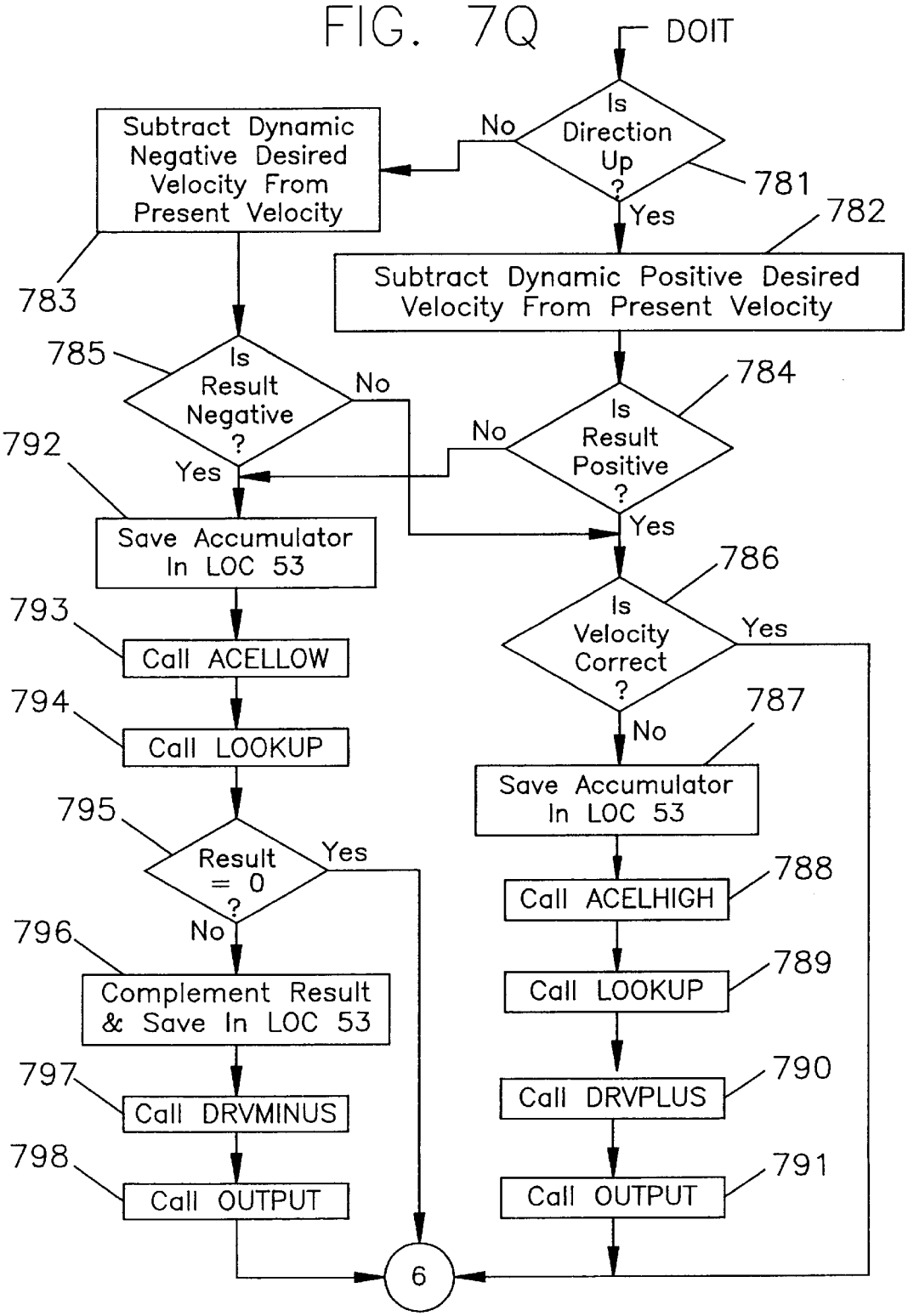
Figure 7R:
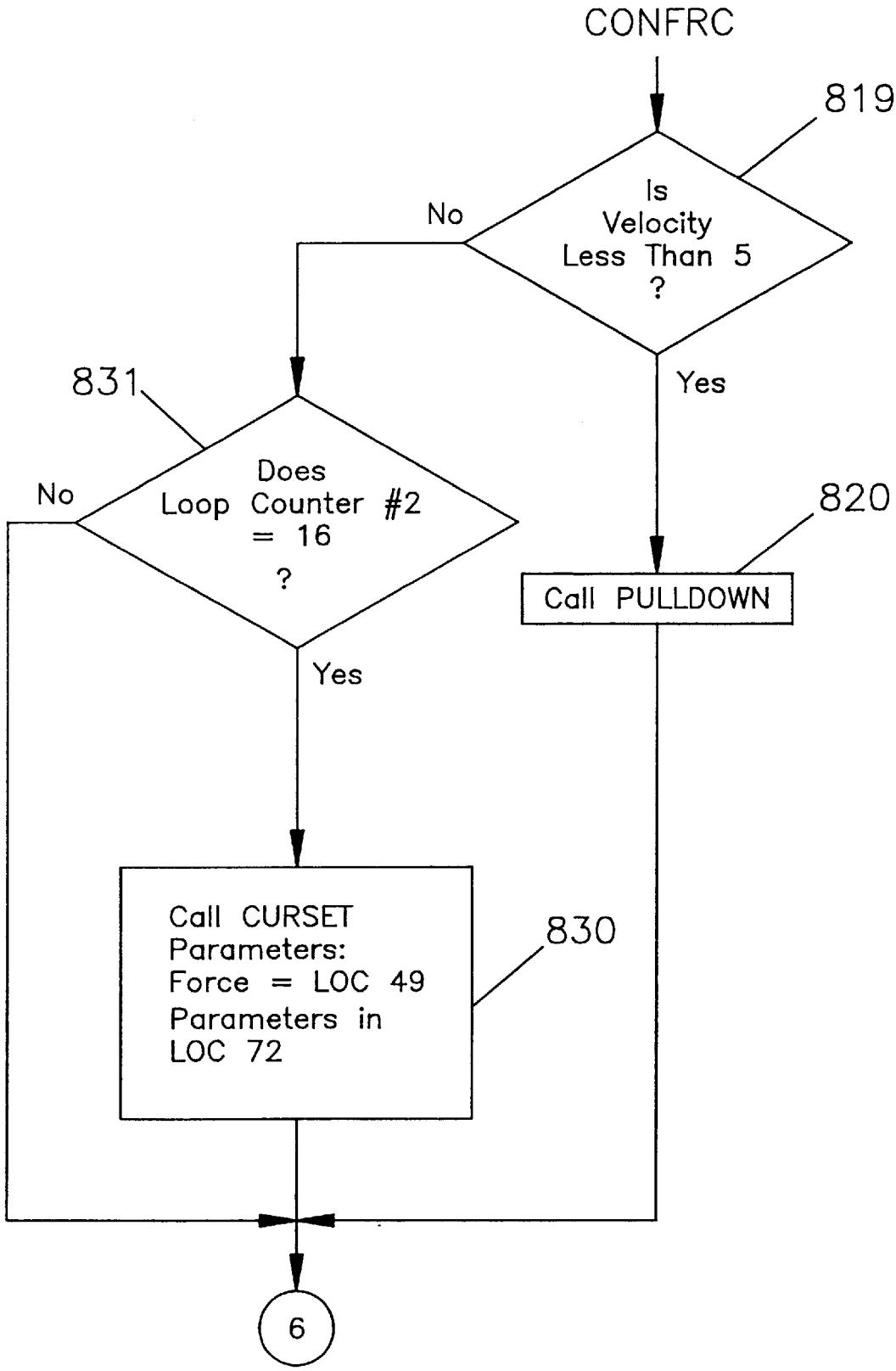
Figure 7S:
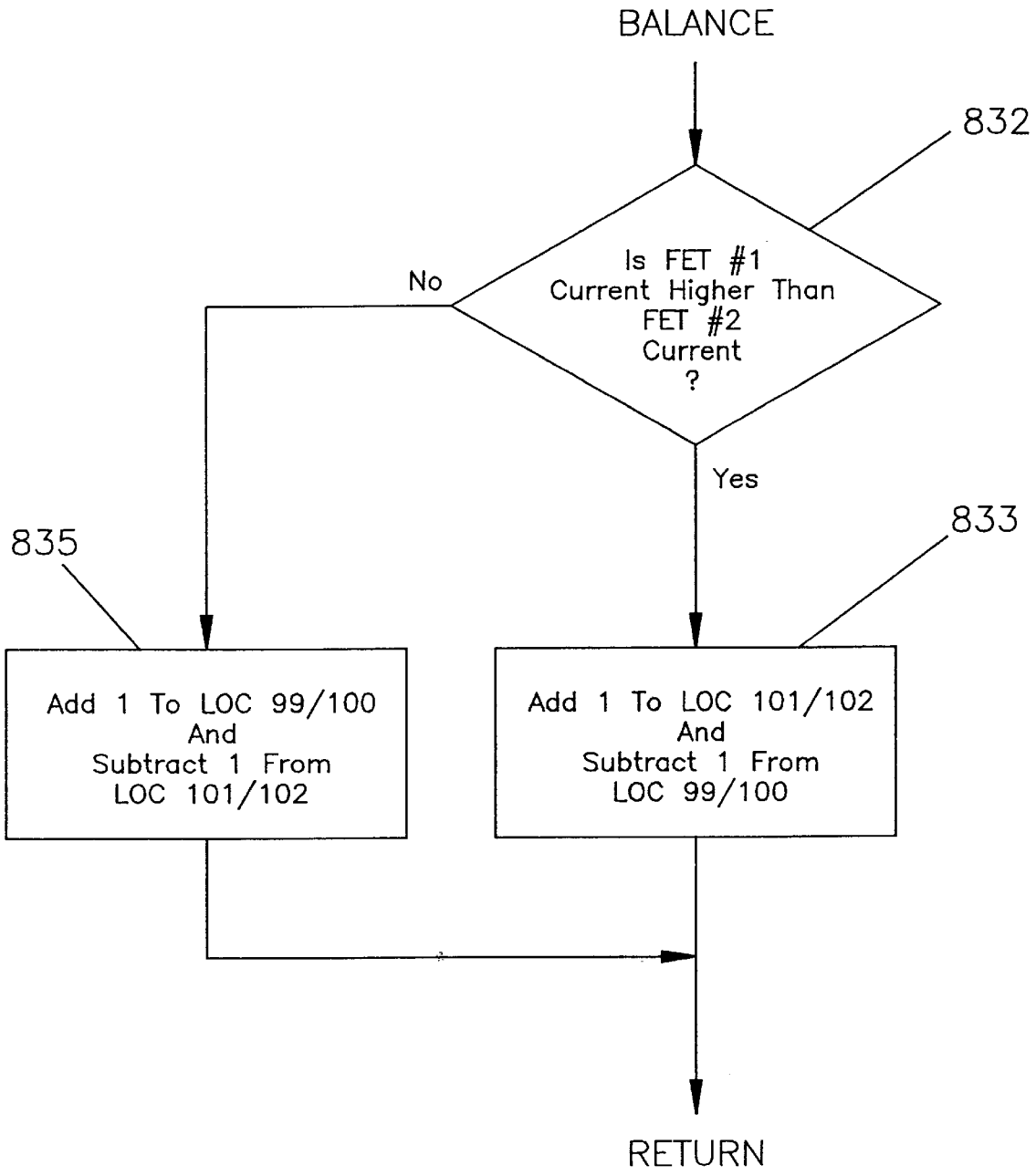
Figure 7T:
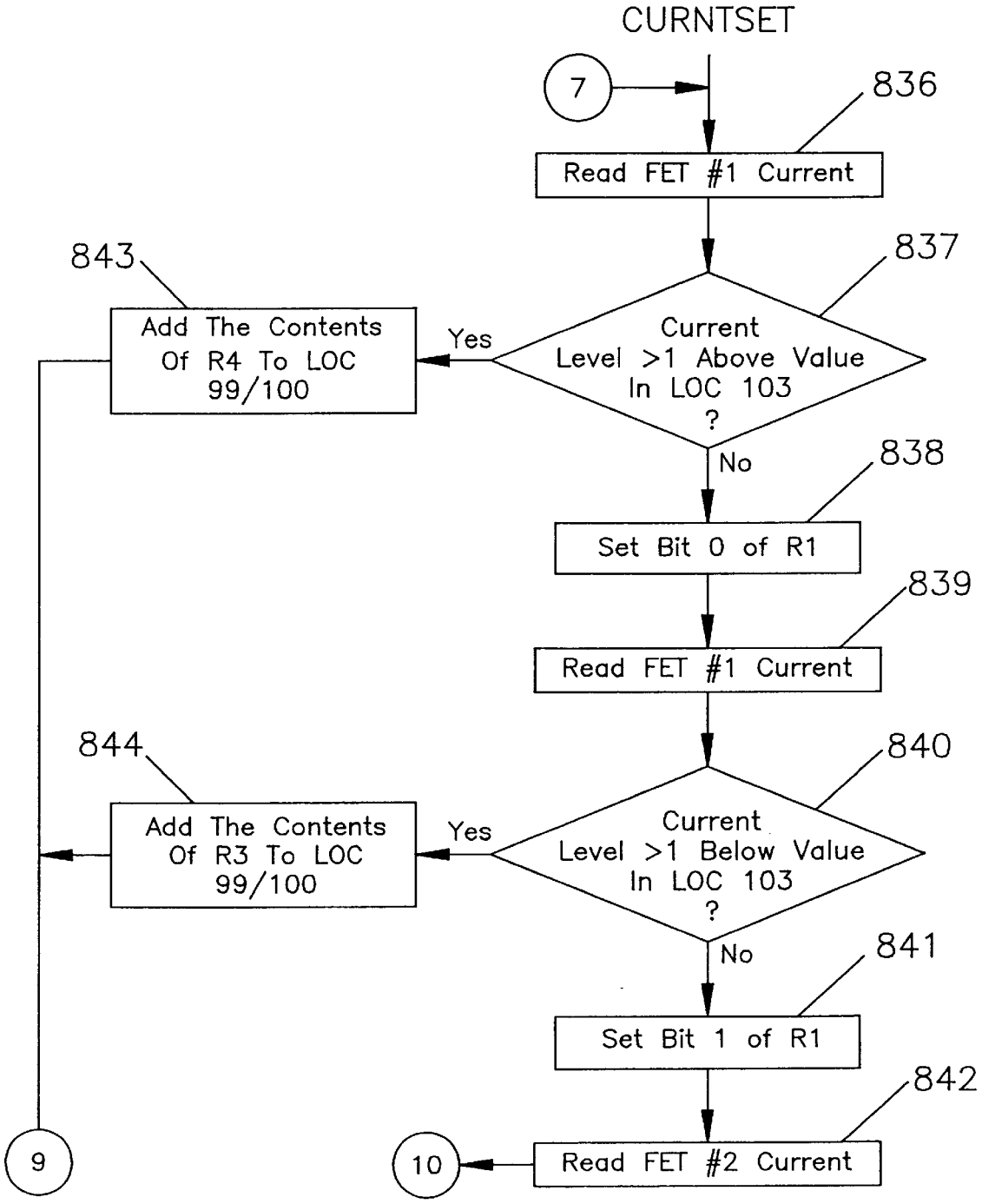
Figure 7U:
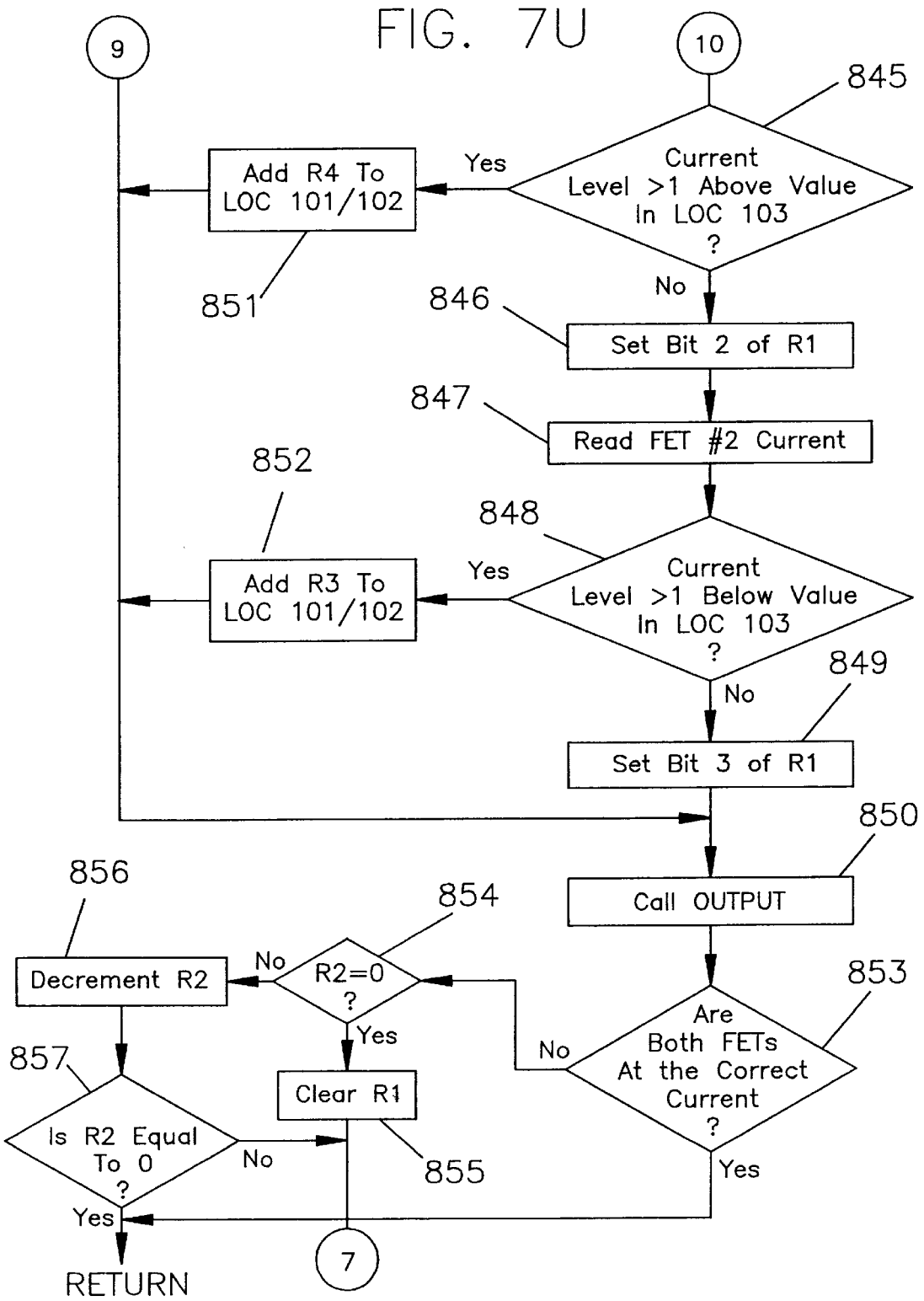
Figure 7V:
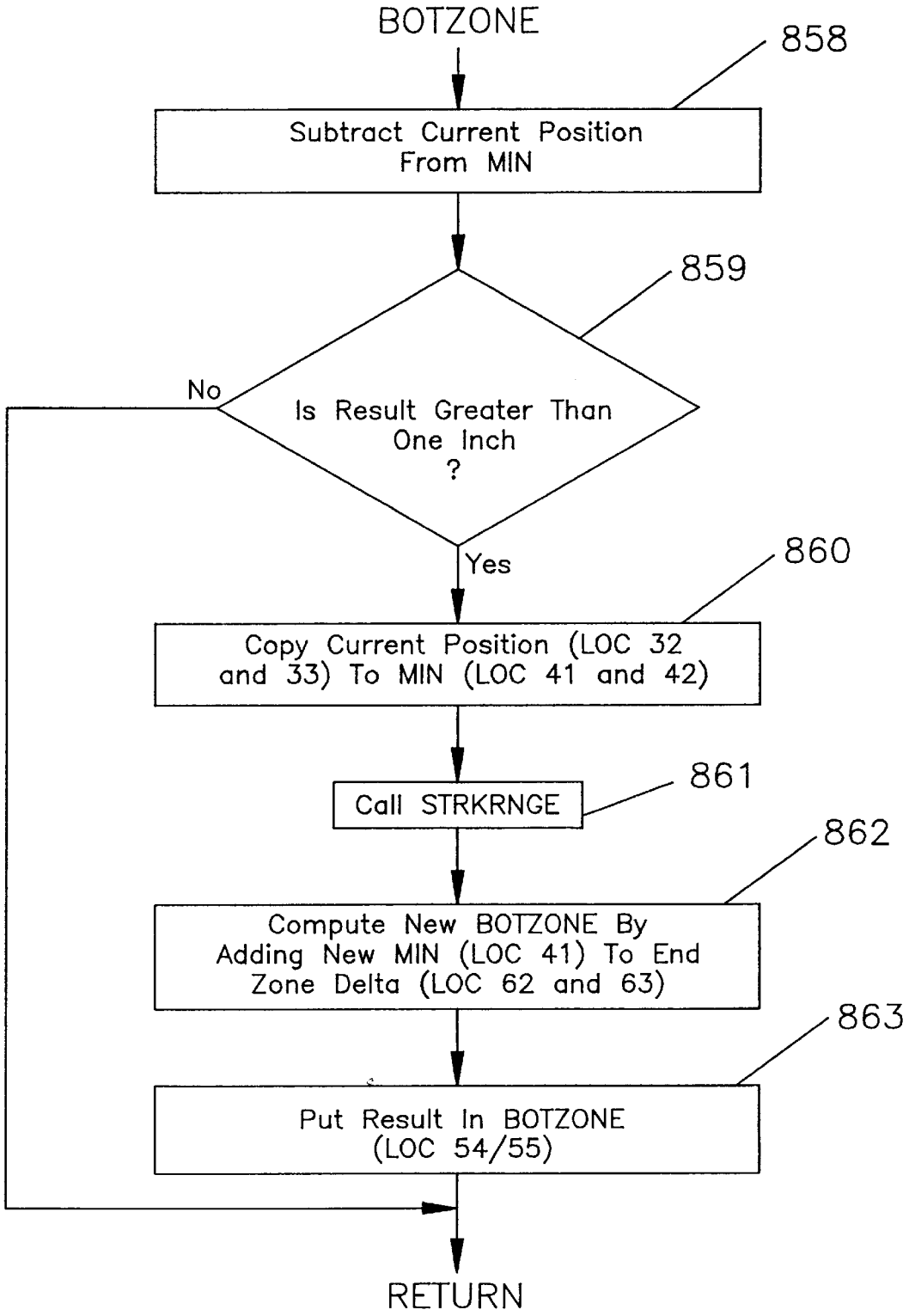
Figure 7W:
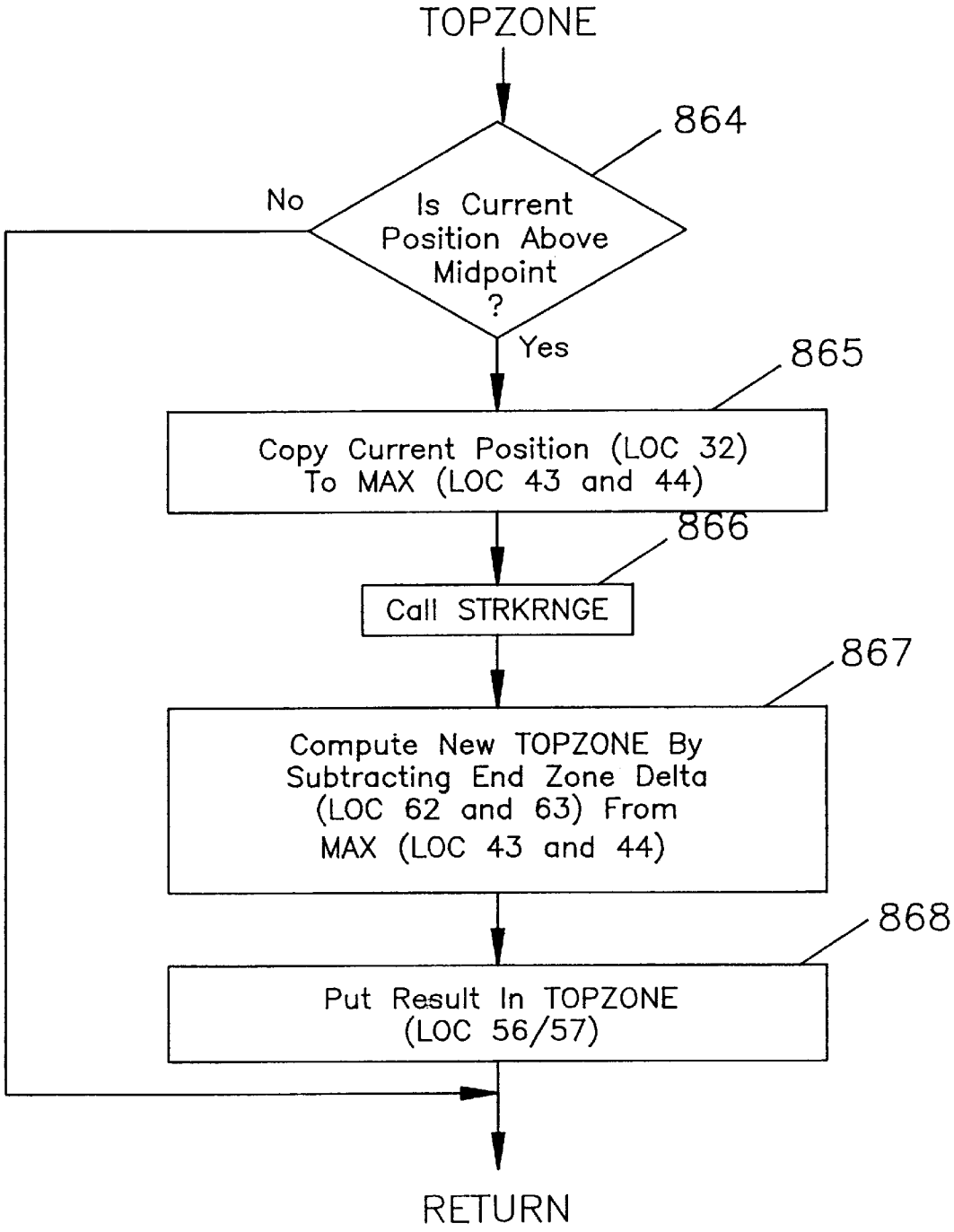
Figure 7X:
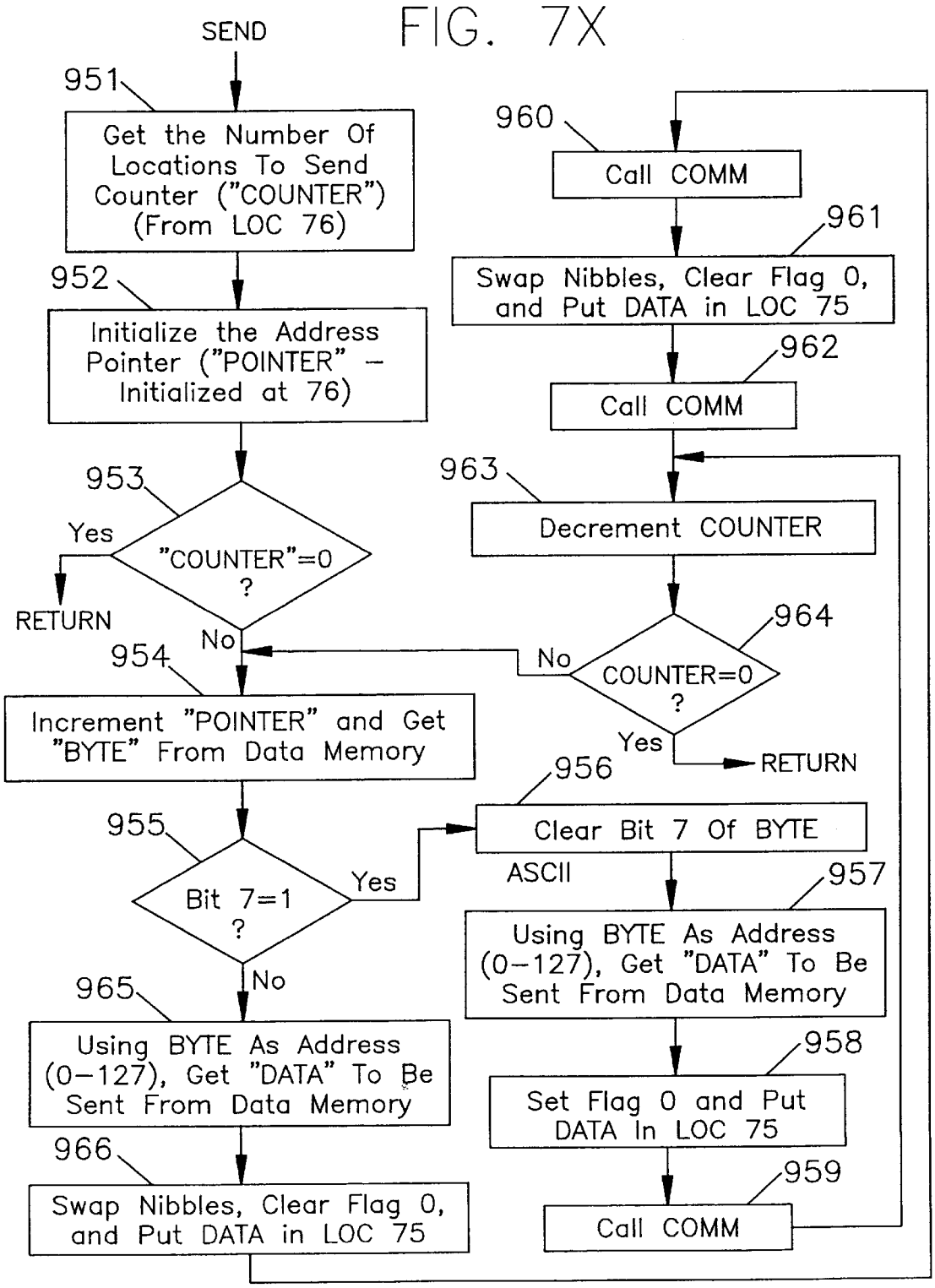
Figure 7Y:
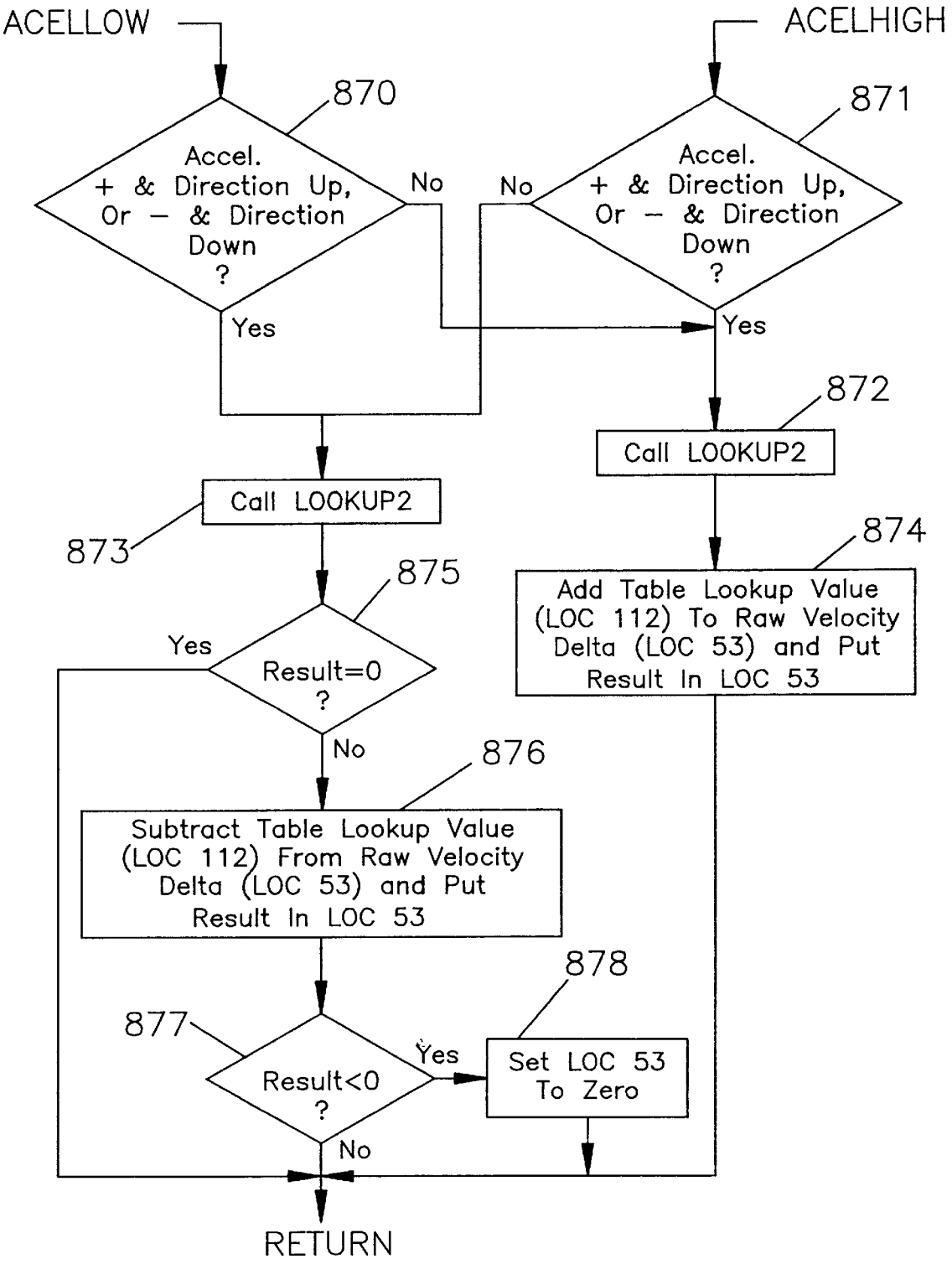
Figure 8:
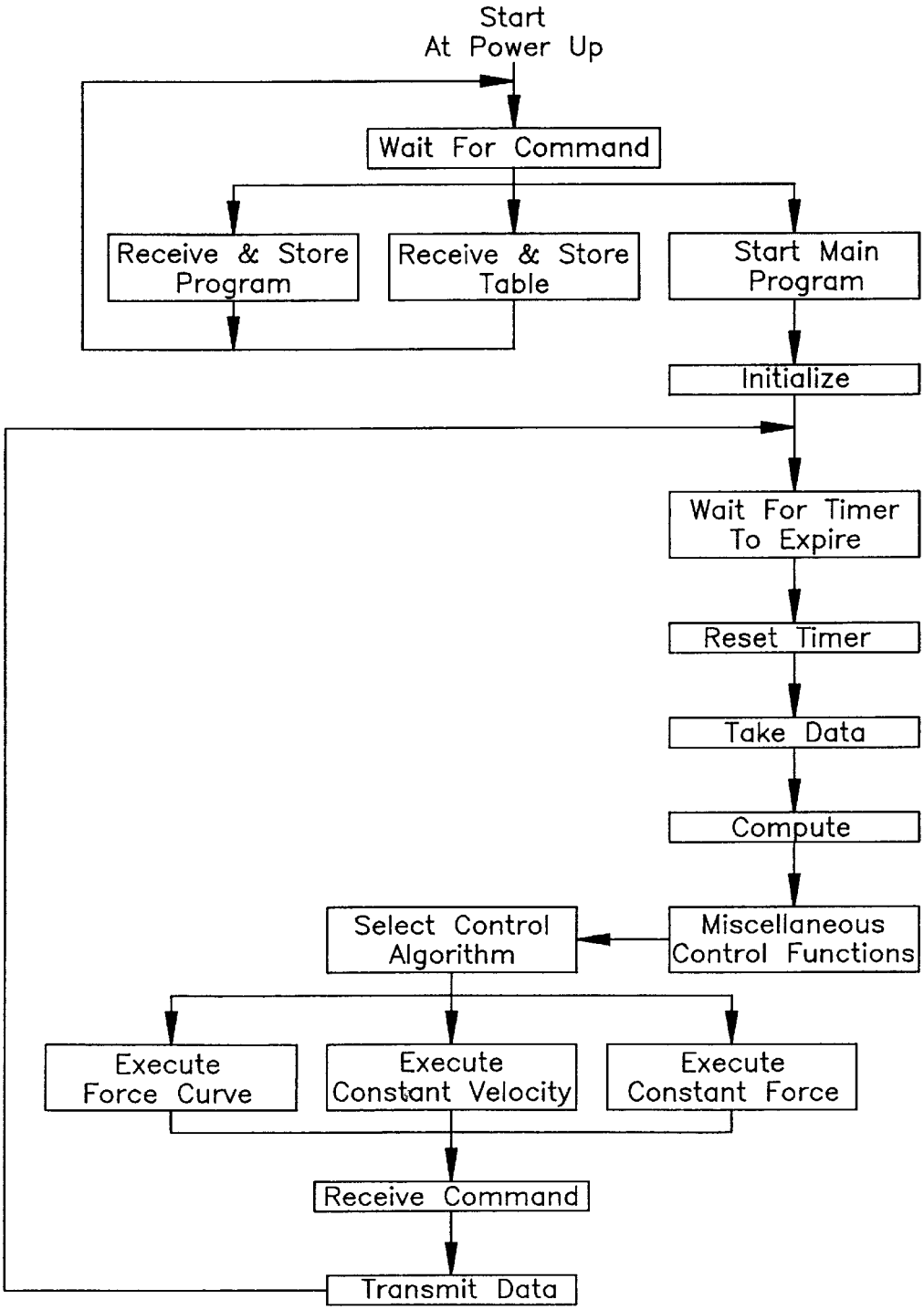

FIG. 8 is a high level flowchart of the software which forms part of the present invention and which identifies the three functions, Receive Program Download, Receive Table Download, and Start Main Program, implemented by the EPROM program that starts execution when power is applied to the electronics assembly that is part also of the present invention. FIG. 8 also identifies the major functions that are implemented by the main program that executes from the flash memory that is likewise part of the disclosed invention. Operation of the main program is shown in the flow charts in FIGS. 7A through 7A1-16 as is described in detail below.

Referring now to the flow charts of the software used with the instant invention, there is shown in FIG. 7A a diagram of the flow chart for the KILLTIME code segment that continually tests the timer flag (TF) for overflow. Overflow of the timer flag indicates that the 5 millisecond data collection and control cycle of the disclosed invention has expired—it is time to take data and execute the currently selected control program mode (Constant Velocity, Constant Force, or Force Curve). The entire data collection-control program is a subroutine that is called by the KILLTIME code segment. The KILLTIME code segment continually tests the timer flag at 700 in FIG. 7A. If the flag is not set, the test is performed again. If the flag is set, the TAKEDATA routine is called at 701.

The TAKEDATA routine beings execution at 702 in FIG. 7B, where the 5 millisecond timer is reset and then started. At 703, the position, velocity, acceleration, and stroke Segment ID data from the last measurement and control cycle are saved. This is required because several of the calculations performed by the data collection and control program require that both current data and last data be available. At 704, position data are read and stored. At 705, motor current is read and stored. At 706, a determination is made as to whether or not this is the first pass through the TAKEDATA routine. The first pass occurs once, at start up, and is determined by the all zeroes state of the Last Position reading.

If this is the first pass, a return to the KILLTIME routine is executed after position and motor current are read, since twos sets of data (present cycle data and last cycle data) are required for completion of the presently executing control program cycle. If this is not the first pass, the TAKEDATA routine continues to 707 in FIG. 7C, where the magnitude and sign of the velocity are computed (by subtracting the Last Position from the Present Position) and saved. At 708, if Flag 1 is set, the velocity magnitude is divided by two and Flag 1 is cleared. Flag 1 is set in the RETR routine, if it is determined that the 5 millisecond timer overflowed while the data collection and control program was executing. When this overflow occurs, the normal 5 millisecond cycle is caused to default to 10 milliseconds, requiring that the computed velocity be corrected by dividing it by two.

At 709 the magnitude and sign of the acceleration are computed (by subtracting the last velocity from the current velocity) and saved. At 710, the stroke Segment ID (one of the 1 through 7 exercise stroke positions) is determined and stored. This is accomplished by using the sign of the velocity in combination with several test using the bottom and top end zone start points to determine if position is bottom end zone, mid zone, or top end zone, and moving, or if in the bottom end zone with a zero velocity (stopped). At 711*a* in FIG. 7C, the PSCONTRL (Power Supply Control) routine (shown in FIG. 7A1-13) is called. Upon return from the PSCONTRL routine, the MINMAX (Minimum/Maximum) routine (shown in FIG. 7A1-16) is called at 711*b*. Upon return from the MINMAX routine, the BALANCE routine (shown in FIG. 7F) is called. Upon return from the BALANCE routine, execution of the code segment flow-charted in FIG. 7D is executed.

The FIG. 7D code segment addresses the Force Track function of the disclosed invention. When enabled, the force track function limits the force on the negative portion of the exercise stroke to no more than the force generated by the user on the positive portion of the exercise stroke. At 712 in FIG. 7D, a test is made to determine if the exercise stroke Segment ID is Bottom End Zone, positive direction (Segment ID=1, Bottom Up). If Segment ID is 1, a test is executed at 713 to determine if Force Track is enabled. If Force Track is enabled, 717 is executed, setting Dynamic Negative Maximum Force to the Pull Down value. If Force Track is not enabled, 716 is executed, setting Dynamic Negative Maximum Force to the Static Negative Maximum Force level.

After execution of 716 or 717, code execution passes to 720 in FIG. 7E. If at 712, of FIG. 7D, it is determined that the Segment ID is not 1, the combination of 714 and 715 determine if the Segment ID is either 6 or 4 (Mid Up or Top UP). If the Segment ID is either 6 or 4, a test is executed at 715*a* to determine if Force Track is enabled. If Force Track is enabled, 718 compares the force currently being generated (based on motor current) to the present Dynamic Negative Maximum Force. If the Present Force is greater than the present Dynamic Negative Maximum Force, Dynamic Negative Maximum Force is made equal to Present Force at 719. If Present Force is not greater than the present Dynamic Negative Maximum Force, or if Segment ID is not 6 or 4 (as shown by the tests at 714 and 715) code execution passes to 720 in FIG. 7E.

The FIG. 7C code segment addresses the Auto Force function of the disclosed invention. When enabled, the Auto Force function causes the maximum force setting (the maximum force the disclosed invention is allowed to deliver) to increase, as a function of the actual velocity values that are above the target/desired velocity by a predetermined amount. This allows the user, when Auto Force is enabled, to increase the maximum force being delivered by the Force Generation and Control Unit (FGCU) up to any desired value (weight) by simply keeping the stroke velocity high. Once the force/weight desired by the user is reached, maintaining the stroke velocity at or below the desired/target value will leave the force/weight constant for the remainder of the exercise set (until Bottom End Zone Stopped is detected). Force/weight is reset to the Static Maximum Positive Force level when the FGCU is in the Bottom End Zone stopped (see element 744, FIG. 7F). The Auto Force algorithm makes use of four parameters: a counter, a velocity delta value, the amount to add to the FET drive level (when the Auto Force algorithm determines that the force is to be increased), and the complement of the number of times excess velocity (velocity high by the velocity delta value) must be detected before force is increased. As identified in FIG. 7E, these parameters/values are kept in processor data memory locations 108, 109, 110, and 111, respectively. Locations 109, 110, and 111 are initialized at processor power-up.

At 720 in FIG. 7E, a test is made to determine if Auto Force is enabled. If Auto Force is not enabled, code execution passes to 730 in FIG. 7F. If at 720 it is determined that Auto Force is enabled, 721 tests to see if the Segment ID is 1. If the Segment ID is 1, then the Auto Force counter (location 108) is reset to the complement of the number of times the excess velocity must be detected before the maximum force/weight is increased (location 111 is copied into location 108). Code execution then passes to 730 in FIG. 7F. If at 721 it is determined that the Segment ID is not 1, then steps 722 and 724 determine if the Segment ID is either 6 or 4. If the Segment ID is not 6 or 4, then code execution passes to 730 in FIG. 7F. If Segment ID is 6 or 4, code execution passes to 725, where the velocity is tested to see if it is high—that is, is it above the desired/target velocity. If the velocity is not high, then code execution passes to 730 in FIG. 7F. If at 725 it is determined that the velocity is high, step 726 tests to see if the difference between the actual velocity and the desired/target velocity is equal to or greater than the Auto Force velocity delta amount contained in the data memory location 109. If the result is negative at step 726, then code execution passes to 730 in FIG. 7F. If the result is affirmative at step 726, then 1 is added to the Auto Focus counter at the data memory location 108.

At step 728, the Auto Force counter is tested for overflow (a carry). If the overflow test is negative at step 728, then code execution passes to 730 in FIG. 7F. If the overflow test at 728 is positive, then the value contained in the data memory location 110 is added to the data memory location 49 (Dynamic Positive Maximum Force). Code execution then passes to 730 in FIG. 7F.

Steps 734 through 744 in FIG. 7F handle incrementing the three 24 bit counters that are used by the FGCU control program (and are available to the externally attached personal computer 434 for use in monitoring and controlling exercise routines, etc.), clearing and incrementing Loop Counter 0 (kept in data memory locations 119, 120, and 121), setting force to the Pull Down value when in the Bottom End Zone Stopped, and initiating the branch to the Constant Force or Constant Velocity control algorithms. Loop Counter 0 is "managed" by this code segment, such that the number of 5 milliseconds measurement cycles that the disclosed invention has been at rest in the Bottom End Zone and the total number of measurement cycles spanned by each exercise stroke are available to the control program (and to the external personal computer 434).

At step 730 in FIG. 7F, a determination is made as to whether the present and last stroke directions are different. If the result of the test at 730 is affirmative, a change of direction has occurred (either from up to down or down to up), representing either a maximum or minimum in the exercise stroke. At step 731, a test is made to see if the direction is up. If the test at step 731 produces a negative result (that is, that the direction is not up—then it is down, so the stroke direction change indicates a stroke maximum), the TOPZONE (see FIG. 7W) routine is called at step 732. Upon return from the TOPZONE routine, code execution passes to 734. If the test at 731 produces a positive result (direction is up), a stroke minimum has been reached, and the BOTZONE (see FIG. 7V) routine is called at step 733. Upon return from the BOTZONE routine, code execution passes to step 734.

If the result of the test at 730 is negative, then code execution passes to 734. At step 734, a determination is made as to whether the present and last Segment IDs are different. If the result of the test at 734 is affirmative (the present and last IDs are different), step 735 tests to see if the present Segment ID is 3. If the result is affirmative at 735 (indicating that the disclosed ;invention has just come to rest in the Bottom End Zone), Loop Center 0 is cleared at 738 and all three counters (0, 1, and 2) are incremented at step 741. Code execution then passes to 745 in FIG. 7G. If the result of the test at 735 is negative, step 736 tests to see if the last Segment ID was 3. If the result is affirmative at 736 (meaning that the disclosed invention has just started to move from the rest position in the Bottom End Zone), Loop Counter 0 is cleared at step 739 and all three loop counters are incremented at step 742. Code execution then passes to 754 in FIG. 7H.

If the result of the test at 736 is negative (indicating that neither the present nor last Segment ID is 3—which means the control program is more than one measurement cycle into the present exercise stroke), all three loop counters are incremented at step 742. Code execution then passes to 754 in FIG. 7H. If the result of the test at 734 is negative (present and last Segment IDs are the same (meaning that the disclosed invention is either stopped in the Bottom End Zone, or it is in some intermediate portion of the present exercise stroke), all there loop counters are incremented at 737. At step 740, a determination is made as to whether the present and last Segment IDs are 3 (Bottom End Zone stopped). If the result is affirmative at 740, the PULLDOWN routine is called at 743, which sets the motor current to the pull down value which is imposed to keep the cable taut when no exercise stroke is progressing. Upon return from the PULLDOWN routine, step 744 resets the Auto Force mode by copying the data in the data memory location 50 into location 49 (Static Positive Maximum Force is copied into Dynamic Positive Maximum Force) and the Stroke Counter (data memory) location 116 keeps a count of the number of exercise strokes in an exercise set—the Stroke Counter is incremented in the TMINUS routine—see FIG. 7N) is cleared. Code execution then passes to 745 in FIG. 7G. If the result of the test at 740 is negative (which means that the present and the last Segment IDs are the same, but they are not 3—indicating that an exercise stroke is in progress), code execution passes to 754 in FIG. 7H.

The FIG. 7G code segment is always executed as the last group of activities in each measurement and control cycle. Three functions are performed by steps 745 through 753 in FIG. 7G: commands are received (from the externally attached personal computer 434) and executed, data are transmitted to the externally attached personal computer 434 (unless the position is Bottom Stopped—SEGID=3), the 5 millisecond measurement and control cycle is defaulted to 10 milliseconds if the timer has expired while the present loop through the measurement and control program was being executed, and a return to the KILLTIME code segment (where the measurement and control program waits for the measurement cycle timer to expire) is executed. Steps 745 and 746 provide for the receipt of multiple commands by looping through the decision block at step 745 on each return from the COMMAND subroutine.

At step 745 in FIG. 7G, a test is performed to see if a character is waiting in the US/ART (the communications controller that is the interface to the external personal computer 434). If there is a character waiting, the COMMAND routine is called at 746. Upon return from the COMMAND routine, a test is made at 747 to see if the present Segment ID is 3 (indicating Bottom End Zone stopped). If the result of the test at 745 is negative, the COMMAND routine is NOT called, and control passes to 747. If the result of the test at 745 is negative (NOT in Bottom End Zone stopped), the SEND routine is called at 748 (at the end of each 5 millisecond measurement cycle data are transmitted to the externally attached personal computer 434, except when the disclosed invention is at rest, that is stopped in the Bottom End Zone). If the result of the test at 747 is affirmative (stopped in the Bottom End Zone), the SEND routine is NOT called, and control passes to 749. At step 749, a test is made to determine if the 5 millisecond timer has expired while the present loop through the measurement and control program was being executed. If the result of the test at 749 is negative, a return to the KILLTIME routine is executed at step 753. If the result of the test at 749 is affirmative, the timer value is read at step 750 (incrementing of the timer continues after it has expired, and it is read at 750 to determine how much time has elapsed since the last 5 millisecond measurement cycle expired), and Flag #1 is set to 1. At step 751 the timer value read at step 750 is subtracted from 60 Hex. The result of the subtraction at 751 is loaded into the timer and the timer is started at 752. This sets the timer to a value that is the remaining time to cause the measurement and control cycle to default to 10 milliseconds. The resulting velocity calculation is corrected, based on the fact that Flag #1 is set, at 708 in FIG. 7C. A return to the KILLTIME routine is executed at 753.

The code segment flow-charted in FIG. 7H is used to determine if the exercise mode presently enabled is Constant Velocity, Constant Force, or Force Curve, and to jump to the appropriate control algorithm. At 754 in FIG. 7H, a test is made to determine if the Constant Velocity (CONVEL) exercise mode is enabled. If the result of the test is affirmative, a jump to the CONVEL routine is executed at 756. If the result of the test at 754 is negative, a test is made at 755 to determine if the Constant Force exercise mode is enabled. If the result of the test is affirmative, a jump to the CONFRC routine is executed at 757. If the result of the test at 755 is negative, a test is made at 755*a* to determine if the Force Curve exercise mode is enabled. If the result of the test is affirmative, a jump to the FRCCRV routine is executed at 757*a*. If the result of the test at 755*a* is negative (this should not occur, since one of the three modes is always enabled), a jump to the RETR routine (see FIG. 7G) is executed.

The code segment flow-charted in FIGS. 7I and 7J implements the Constant Velocity exercise mode of the disclosed invention. Steps 761 through 767 ensure that the Positive Direction Maximum Force (a setable parameter) is not exceeded during the positive portion of the exercise stroke, that the Negative Direction Maximum force (a setable parameter) is not exceeded during the negative portion of the exercise stroke, and that the force never falls below a preset minimum value. The Bottom End Zone portion of the exercise stroke must receive special treatment on the first stroke, and decision blocks 759 and 760 are used for the purpose of detecting when this special condition occurs. During this initial portion of the exercise stroke, the force is coming up from the pull down value that is in effect when stopped in the Bottom End Zone. Therefore, in this situation, force is ALWAYS below minimum which, which causes the CURNTSET routine to be called. Because of the way the CURNTSET routine operates, multiple measurement and control cycles would be required for it to bring the force up to the minimum value. Allowing that to occur would introduce a noticeable lag in the onset of the desired force in the initial part of the first stroke, which would severely detract from the desired exercise feel. That is corrected by bypassing the tests for maxima and minimum force when in the Bottom End Zone, on the first stroke. That allows the Acceleration function, that is invoked during every measurement and control cycle during which measured force falls between the presently set maxima (positive and negative) and minimum, to come into play. The Acceleration function prohibits excess slip (a lag in force onset) in the Bottom End Zone on the first stroke.

At step 759 in FIG. 7I, a test is made to determine if this is the first stroke (the stroke counter, kept at the data memory location 116, has a value of zero during the first stroke). If the result of the test at 759 is affirmative, a test is made at 760 to determine if the Segment ID is 1 (Bottom End Zone, positive direction). Bottom End Zone moving in the positive direction receives special treatment on the first stroke, as discussed above. If the result of the test at step 760 is affirmative, code execution passes to step 768 in FIG. 7J. If the result of the test at 760 is negative, step 761 tests to see if the direction is up. If the direction is not up (it is therefore down), step 762 tests to see if Present Force is equal to or greater than Negative Direction Maximum Force. If the result of the test at 762 is negative, 764 tests to see if Present Force is equal to or less than Minimum Force.

If the result of the test at step 764 is negative, code execution passes to 768 in FIG. 7J. If the result of the test at 761 is affirmative (direction is up), 763 tests to see if Present Force is equal to or greater than Positive Direction Maximum Force. If the result of the test at 763 is affirmative, CURNTSET is called at 767, with the parameter values as shown (target force is Positive Direction Maximum Force, maximum number of loops through CURNTSET is 3, amount to be added to FET drive per pass [if setting is low] is 1, and amount to be subtracted [FF Hex is added] from FET drive per pass [if setting is high] is 1).

Upon return from CURNTSET, control passes to 745 in FIG. 7G. If the result of the test at 763 is negative, the minimum test at 764 is executed as described above. If the result of the test at 762 is affirmative. CURNTSET is called at 765 with parameter values as shown. Upon return from CURNTSET, control passes to 745 in FIG. 7G. If the result of the test at 764 is affirmative, CURNTSET is called at 766 with the parameter values as shown. Upon return from CURNTSET, control passes to 745 in FIG. 7G.

The code segment flow-charted in FIG. 7J is the continuation of the execution of the Constant Velocity (CONVEL) mode of operation of the disclosed invention. Steps 768 through 773 determine which of the six exercise stroke segments; 1, 2, 4, 5, 6, or 7 is current, and executes a call to the required routine: BPLUS, BMINUS, TPLUS, TMINUS, MPLUS, or MMINUS, respectively. The calls are executed at steps 775 through 780 in FIG. 7J, and upon return, a jump to the DOIT routine is executed. The present Segment ID is kept in the data memory location 38. If an error occurs, and the Segment ID is not one of the expected values, a jump to RETR (to 745 in FIG. 7G) is executed as the negative result of the test at 773. Upon return from the BPLUS, BMINUS, TPLUS, TMINUS, MPLUS, or MMINUS routine, a jump to the DOIT routine is executed at step 774A through 774F, respectively, in FIG. 7J.

The code segment flow-charted in FIG. 7K is the BPLUS routine that forms part of the Constant Velocity mode of operation of the disclosed invention. The BPLUS routine determines the required 19 address bits and reads the positive direction desired/target velocity value from the End Zone tables previously described. At step 811 in FIG. 7K, the End Zone table address bits 0 through 10 are determined, by subtracting the Present Position from BOTZONE (the position of the present Bottom End Zone start point, kept in the data memory locations 54 and 55). Also at step 811, if the result is larger than 7FF Hex, the result is made 7FF Hex in order to avoid reading values beyond the end of the table segment, since each table segment contains 2,048 values. At 812, the End Zone table address bits 11 through 15 are determined, by subtracting 14 Hex from the Static Positive Desired Velocity (in the data memory location 58). Also at 812, if the result of the address bits calculation is negative, the result is made zero; and if the result is larger than 31 Hex, it is made 31 Hex. That guarantees that the table address points to one of the 32 table segments in the particular one of the eight stroke length sets presently active (as determined by the Stroke Length Range [STRKRNGE] routine).

At 813, address bits 16 through 18 are determined. These three address bits are the Stroke Length Range from the Data memory location 117. With the 19 address bits determined, the table lookup is accomplished at 814, the resulting velocity is put into the data memory location 59 (Dynamic Positive Desired Velocity), and a return to the calling routine is executed.

The code segment flow-charted in FIG. 7L is the BMINUS routine that is part of the Constant Velocity mode of operation of the disclosed invention. The BMINUS routine determines the required 19 address bits and reads the negative direction desired/target velocity value from the End Zone tables previously described. At 851 in FIG. 7L, the End Zone table address bits 0 through 10 are determined, by subtracting the Present Position from BOTZONE (the position of the present Bottom End Zone start point, kept in data memory locations 54 and 55). Also at 815, if the result is larger than 7FF Hex, the result is made 7FF Hex in order to avoid reading values beyond the end of the table segment, since each table segment contains 2,048 values. At step 816, the End Zone table address bits 11 through 15 are determined, by subtracting 14 Hex from Static Negative Desired Velocity (data memory location 58). Also at 816, if the result of the address bits calculation is negative, the result is made zero; and if the result is larger than 31 Hex, it is made 31 Hex. That guarantees that the table address points to one of the 32 table segments in the particular one of the eight stroke length sets presently active (determined by Stroke Length Range [STRKRNGE] routine). At 817, the address bits 16 through 18 are determined. These three address bits are the Stroke Length Range from the data memory location 117. With the 19 address bits determined, the table lookup is accomplished at 818, the resulting velocity is put into data memory location 61 (Dynamic Negative Desired Velocity), and a return to the calling routine is executed.

The code segment flow-charted in FIG. 7M is the TPLUS routine forms a part of the Constant Velocity mode of operation of the disclosed invention. The TPLUS routine determines the required 19 address bits and reads the positive direction desired/target velocity value from the End Zone tables previously described. At step 807 in FIG. 7M, the End Zone table address bits 0 through 10 are determined by subtracting TOPZONE (the position of the present Top End Zone start point, kept in the data memory locations 56 and 57) from the Present Position. Also at 807, if the result is larger than 7FF, the result is made 7FF Hex, again in order to avoid reading values beyond the end of the table segment, since each table segment contains 2,048 values. At step 808, the End Zone table address bits 11 through 15 are determined, by subtracting 14 Hex from Static Positive Desired Velocity (data memory location 58). Also at step 808, if the result of the address bits calculation is negative, the result is made zero, and if the result is larger than 31 Hex, it is made 31 Hex. That guarantees that the table address points to one of the 32 table segments in the particular one of eight stroke length sets presently active (determined by Stroke Length Range [STRKRNGE] routine). At step 809, the address bits 16 through 18 are determined. These three address bits are the Stroke Length Range from the data memory location 117. With the 19 address bits determined, the table lookup is accomplished at step 810, the resulting velocity is put into the data memory location 59 (Dynamic Positive Desired Velocity), and a return to the calling routine is executed.

The code segment flow-charted in FIG. 7N is the TMINUS routine that is part of the Constant Velocity mode of operation of the disclosed invention. The TMINUS routine first checks to see if the last Segment ID was 4 (which indicates that the direction has just changed from UP to DOWN). If the direction has changed, the Stroke Counter is incremented. The TMINUS routine than determines the required 19 address bits and reads the negative direction desired/target velocity value from the End Zone tables previously described. At step 801 in FIG. 7N, the last Segment ID is tested to see if it was 4. If the result of the test 801 is affirmative, the Stroke Counter (data memory location 116) is incremented at 802, and code execution passes to step 803. If the result of the test at 801 is negative, the Stroke Counter is not incremented, and code execution then passes to 803. At step 803 the End Zone table address bits 0 through 10 are determined by subtracting TOPZONE (the position of the present Top End Zone start point, kept in the data memory locations 56 and 57) from the Present Position. Also at 803, if the result is larger than 7FF Hex, the result is made 7FF, Hex to avoid reading values beyond the end of the table segment, since each table segment contains 2,048 values. At 804, the End Zone table address bits 11 through 15 are determined, by subtracting 14 Hex from Static Negative Desired Velocity (data memory location 60). Also at step 804, if the result of the address bits calculation is negative, the result is made zero; and if the result is larger than 31 Hex, it is made 31 Hex. This guarantees that the table address points to one of the 32 table segments in the particular one of eight stroke length sets presently active (determined by Stroke Length Range [STRKRNGE] routine). At step 805, the address bits 16 through 18 are determined. These three address bits are the Stroke Length Range from the data memory location 117. With the 19 address bits determined, the table lookup is then accomplished at step 806, the resulting velocity is subtracted from two-times the Static Negative Desired Velocity (data memory location 60) and the result is put into the data memory location 61 (Dynamic Negative Desired Velocity), and a return to the calling routine is executed. The reason for the multiplication by two and the subtraction are addressed elsewhere in this disclosure.

The single block of the flow chart in FIG. 7O identifies the function performed by the MPLUS routine. At step 799 the Static Positive Desired Velocity (data memory location 58) is copied into Dynamic Positive Desired Velocity (data memory location 59). A return to the calling routine is then executed.

The single block of the flow chart in FIG. 7P identifies the function performed by the MMINUS routine. At step 800 the Static Negative Desired Velocity (data memory location 60) is copied into Dynamic Negative Desired Velocity (data memory location 61). A return to the calling routine is then executed.

Figure 6:
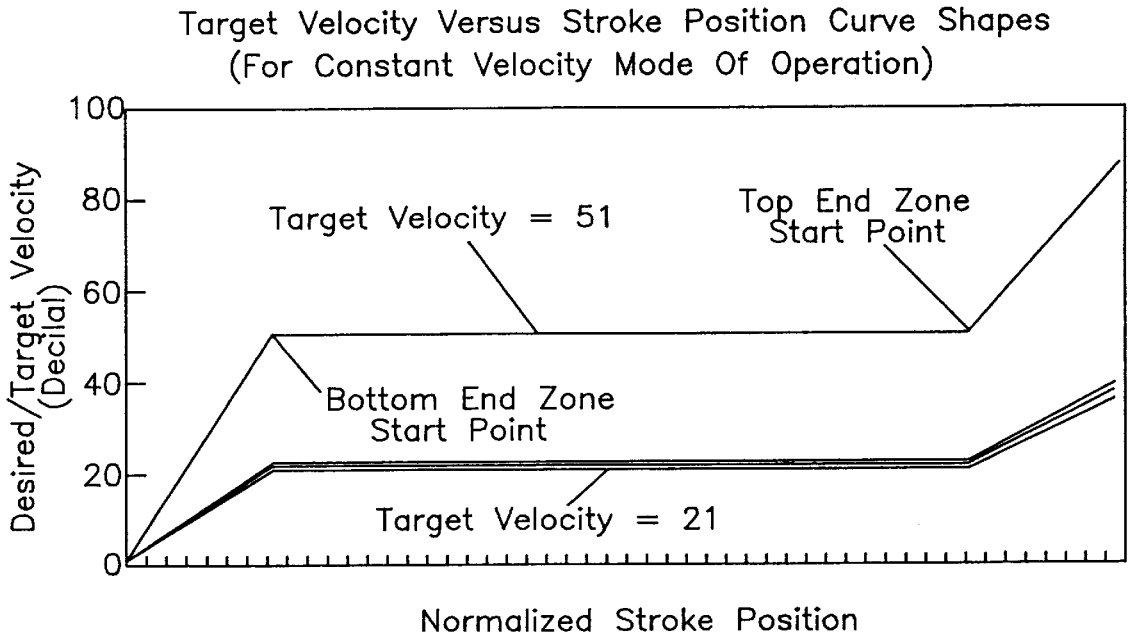
FIG. 6 shows the general shape of the desired/target velocity profile used when the disclosed invention is operating in the Constant Velocity mode. The velocity range accommodated by the disclosed invention is 20 to 51, decimal.

In combination, the BPLUS (Bottom End Zone, positive direction), BMINUS (Bottom End Zone, negative direction), TPLUS (Top End Zone, positive direction), TMINUS (Top End Zone, negative direction), MPLUS (Mid Zone, Positive direction), and MMINUS (Mid Zone, negative direction) routines produce a desired/target velocity profile, across the exercise stroke, as shown in FIG. 6. In attempting to track this velocity profile, the Constant Velocity (CONVEL) algorithm produces the exercise feel that is one of the objectives of the disclosed invention.

Once the desired/target velocity, applicable to the particular point in the exercise stroke that is presently being traversed, has been determined (by the end zone and mid zone routines described above), the code segment flow-charted in FIG. 7Q (DOIT) is executed. The DOIT routine completes the work of the Constant Velocity algorithm of the disclosed invention. That includes determination of the velocity error (the difference between Present Velocity and the desired/target velocity) and acceleration, and performing the table lookups that convert the acceleration and the velocity error into the changes in gate drive voltage to the two FETs 504, 506 that control the DC servomotor current. The resulting current changes are such as to reduce the velocity error.

At step 781 in FIG. 7Q, a test is performed to determine if the exercise stroke direction is UP. If the result of the test at 781 is negative (meaning that the direction is DOWN), the velocity error is determined at step 783 by subtracting Dynamic Negative Desired Velocity from the Present Velocity. At step 785, a test is performed to determine if the result of the subtraction at step 783 is negative (indicating that the velocity is low). If the result of the test at 783 is negative, code execution passes to step 786.

Steps 786 through 791 address two cases: when the velocity is high and the direction is UP, or when the velocity is low and the direction is DOWN. At step 786 a test is performed to see if the Present Velocity is equal to the desired/target velocity. If the result of the test at step 786 is affirmative, a jump to the RETR routine is executed. If the result of the test at 786 is negative (indicating that the velocity is not correct), then the accumulator is saved in the data memory location 53, at step 787. At this point, the accumulator contains the FET drive change prior to a modification to account for acceleration (raw velocity delta). That value is modified by the ACELHIGH routine. Upon a return from ACELHIGH, the LOOKUP routine is called at step 789. Upon return from LOOKUP, the DRVPLUS routine is called at step 790. Upon return from DRVPLUS, the OUTPUT routine is called at step 791. If the result of the test at step 781 is affirmative, the velocity error is determined at step 782 by subtracting Dynamic Positive Desired Velocity from the Present Velocity. At 784 a determination is made as to whether the result of the subtraction at step 782 is positive or negative (indicating whether the velocity is high or low, respectively). If the result of the test at step 784 is affirmative, code execution passes to 786. If the result of the test at step 784 is negative, the code execution passes to 792.

Steps 792 through 798 address two cases: whether the velocity is low and the direction is UP, or whether the velocity is high and the direction is DOWN. At step 792, the accumulator is saved in the data memory location 53. At that point, the accumulator contains the FET drive change prior to a modification to account for acceleration (raw velocity delta). At 793 the ACELLOW routine is called. Upon a return from ACELLOW, the LOOKUP routine is called at step 794. Upon return from LOOKUP, a test is performed at step 795 to determine if the result of the table lookup performed at 794 is zero. If the result of the test at 795 is affirmative (the result is zero), a jump to the RETR routine is executed. If the result of the test at 795 is negative (the result is not zero), the data memory location 53 is complemented and put back into location 53.

At step 797, the DRVMINUS routine is called. Upon return from the DRVMINUS routine, the OUTPUT routine is called at step 798. Upon return from the OUTPUT routine, a jump to the RETR routine is executed. That completes execution of one 5 millisecond control loop through the Constant Velocity (CONVEL) algorithm of the disclosed invention. The RETR routine accomplishes the functions performed at the end of each 5 millisecond measurement and control cycle, including testing for, and responding to, a command from, and transmitting data to, the attached personal computer 434.

The code segment flow-charted in FIG. 7R implements the Constant Force (CONFRC) exercise mode of the disclosed invention. In operation, if the velocity is higher than 5, the force is increased to the set value, and if the velocity is less than 5, the force is reduced to the Pull Down value. The rates of application and removal of force are independently controllable via the data downloaded from the externally attached personal computer 434. At step 819 in FIG. 7R, a test is performed to see if the velocity is less than 5. If the result of the test at step 819 is affirmative, the PULLDOWN routine is called at step 820. The PULLDOWN routine (see FIG. 7A1-2) includes a special release rate function to support the Constant Force mode of operation of the disclosed invention.

Upon return from the PULLDOWN routine, a jump to RETR is performed. If the result of the test at 819 is negative, a test is performed at step 831 to see if the Loop Counter #2 has reached a value of 16 decimal. Loop Center #2, in conjunction with parameters delivered to the CURNTSET routine, which is called at step 830, controls the rate at which the force is brought up to the set level. The Loop Counter is incremented at the 5 millisecond data collection and control cycle rate of the disclosed invention. Therefore, the test at step 831 causes CURNTSET to be called at 80 millisecond intervals, if the velocity is above 5 and the Constant Force mode of operation is enabled.

If the result of the test at step 831 is negative (indicating that 80 milliseconds have not passed since the last call to the CURNTSET routine), a jump to the RETR routine is executed. If the result of the test at 831 is affirmative, the CURNTSET routine is called, with the force parameter set at the Dynamic Positive Maximum Force level (which is contained in the data memory location 49) and the loop parameters contained in the data memory location 72. Upon return from CURNTSET, a jump to the RETR routine is executed. Since force is removed if the velocity is below 5, the Constant Force algorithm performs the important exercise function of removing the weight if it is "in the air" and the exerciser does not have the energy to "put it down". Typically, in the latter stages of an exercise set, when exhaustion may be setting in, the exerciser is able to hold the weight in place ("in the air") but may not have the energy to "put it down". This is caused by the drastic changes in joint angles as the "weight is put down" and the resulting reduction in output force capability of the exerciser, and is generally addressed by a trainer/helper. The disclosed invention obviates the need for a trainer/helper in this situation.

The code segment flow-charted in FIG. 7S implements the Balance (BALANCE) function that is a key to successful operation of the disclosed invention. The BALANCE routine is executed once during the early part of each 5 millisecond data collection and control cycle, and is instrumental in maintaining current flow equality (that is, it forces current sharing) in the two FET devices 504, 506 that control current flow in the DC servomotor 200 that is the force producing element of the disclosed invention. The BALANCE routine operates as follows. At step 832 a test is performed to determine if the current flowing in the first FET 504 is higher than the current flowing in the second FET 506. If the result of the test at step 832 is affirmative, at step 833 a 1 is added to the data memory locations 101 and 102, and a 1 is subtracted from the data memory locations 99 and 100. Data memory locations 99 and 100 are the source for the portion of the OUTPUT routine that determines the voltage level at the gate of the FET 504, and the data memory locations 101 and 102 are the source for the second FET 506. If the result of the test at step 832 is negative, the addition is made to the data memory locations 99 and 100, and the subtraction is made from the data memory locations 101 and 102. The BALANCE routine attempts to maintain the current balance to within plus or minus one count in the output of the A/D converters 410, 412 that measure current in the two FETs 504, 506.

The code segment (CURNTSET) flow-charted in FIGS. 7T and 7U represent the mechanism whereby the disclosed invention sets the DC servomotor current (force) level to a predetermined value. In execution, the CURNTSET routine makes use of three parameters: the allowed number of loops through the code during a single call (the current/force does not normally reach the target value during a single pass through the CURNTSET routine), the amount to add to the D/A drive level when the current/force is found to be low, and the amount to subtract from the D/A drive level when the current/force is found to be high. During execution, the values of these three parameters are kept in registers R2, R3, and R4, respectively. Two D/As 406, 408 (attached to the gates of the two FETs 504,506) use FET gate drive values computed by the CURNTSET routine to keep the current flowing in each FET well within the required limits, while delivering the total required current to the DC servo control motor 200. The CURNTSET routine inherently aids in keeping the two FET devices 504,506 current balanced, since the routine attempts to set the D/A drive levels so that the currents in the two FETs are equal.

The CURNTSET routine can be entered in two ways: directly, at 7 in FIG. 7T (via CALL CURNTSET), or through the CURSET routine (via CALL CURSET), which is flow-charted in FIG. 7A1-11, and which flows into 7 in FIG. 7T. When entered directly at 7 in FIG. 7T, the required three parameters are passed directly in the registers R2, R3, and R4. When entered via CURSET, the register R2 points to the data memory location where the values of the three parameters are identified, and the CURSET routine extracts the parameters, putting each in the required register (R2, R3, and R4). The CURSET path into CURNTSET is provided to support real-time dynamic testing during optimization of the feel of the exercise stroke, and to allow CURNTSET parameters to be dynamically modified (while the system is in use for exercise purposes) under control of the externally attached personal computer 434.

At step 836 in FIG. 7T, the electrical current level of the FET 504 is read. At 837, a test is made to determine if the measured FET current is more than 1 above the value in the data memory location 103 (the target current/force value). If the result of the test at step 837 is affirmative, the value contained in R4 is added (the value is in R4 is complemented—the result is therefore a subtraction) to the FET 504 D/A drive level contained in the data memory locations 99 and 100. Code execution then passes to step 850 in FIG. 7U, where the OUTPUT routine is called.

If the result of the test at step 837 in FIG. 7T is negative (which means that the FET 504 current level is not high—CURNTSET attempts to bring the current level to within plus or minus 1 of the target value), the bit position 0 of R1 is set to 1. The current level of the FET 504 is again read at step 839, and, at step 840, a test is performed to determine if the current is more than 1 below the target level. If the result of the test at step 840 is affirmative, the value contained in R3 is added to the FET 504 D/A drive level. Code execution then passes to step 850 in FIG. 7U, where the OUTPUT routine is called. If the result of the test at step 840 is negative (the FET 504 current level is not low), the bit position 1 of R1 is set to 1, and code execution passes to step 842, where the same tests are initiated for the FET 506. The only difference in the code that addresses the FET 506 is that the bit position 2 and 3 of R1 are set to indicate that the FET 506 current level is not high and not low, respectively. In any event, the high-low tests for each of the two FETs 504, 506 terminate at step 850, where the OUTPUT routine is called.

The return from the OUTPUT routine is to step 853 in FIG. 7U, where a test is performed to determine if both FETs are at the required/target current/force level. That is determined by the existence of a binary "1" in the bit positions 0, 1, 2, and 3 of R1 (to detect this state, R1 is tested for the value "0F" Hex). If the result of the test at step 853 is affirmative (both FETs 504, 506 are at the required/target current level), the CURNTSET routine terminates with a return to the calling routing. If the result of the test at step 853 is negative, the value of R2 is tested at step 854. The value in R2 determines the number of passes allowed through the CURNTSET routine. A zero in R2 allows the CURNTSET routine to execute as many loops as required for current in the two FETs 504, 506 to reach the target value (within plus or minus 1). Any value other than zero in R2 is the number of loops allowed before a return to the calling routine is executed.

The logic to implement the "number of loops limitation" is shown in steps 854 through 857, in FIG. 7U. If the result of the test at 854 is affirmative, R1 is set to zero (so that the results of the high-low FET current tests can again be recorded) and code execution passes to step 836 in FIG. 7T, for the start of another loop through CURNTSET. If the result of the test at 854 is negative, R2 is decremented at step 856, and R2 is tested for zero at 857. If the result of the test at 857 is negative, code execution passes to 836 in FIG. 72, for start of another loop through CURNTSET. If the result of the test at step 857 is affirmative, CURNTSET terminates with a return to the calling routine.

The code segment flow-charted in FIG. 7V is the BOTZONE routine that continually determines the position of the Bottom End Zone start point, in support of the dynamic calibration function and the dynamic modification of the desired/target velocity when traversing the Bottom End Zone. The BOTZONE routine is called when a minimum in the exercise stroke is detected, which is indicated by a direction change from DOWN to UP. BOTZONE is terminated if at steps 858 and 859 it is determined that an apparent new minimum is too close to the old minimum. That determination is necessary to avoid concluding that short duration direction changes during the negative portion of the exercise stroke represent new minima. At step 858 in FIG. 7V, the Present Position is subtracted from the present Minimum (MIN), which is stored in the data memory locations 41 and 42. At step 859, the result of the subtraction at step 858 is tested to determine if it is greater than 1 inch. If the result of the test at 859 is negative (indicating that the position in question is not a true minimum), a return to the calling routine is executed. If the result of the test at 859 is affirmative, the Present Position is copied into MIN (the data memory locations 32 and 33 are copied into the locations 41 and 42). The STRKRNGE routine is then called at step 861.

The STRKRNGE routine determines the stroke range value (0 through 7) to be used as address bits 16–18 in accessing the End Zone tables. Upon return from the STRKRNGE routine, a new Bottom End Zone start point (BOTZONE) is computed by adding the new value of MIN to End Zone Delta, which is kept in the data memory locations 62 and 63. At step 863, the new value for BOTZONE is stored in the data memory locations 54 and 55, after which a return to the calling routine is executed.

The code segment flow-charted in FIG. 7W is TOPZONE. The TOPZONE routine operates identically to BOTZONE, discussed above, except that parameters are stored and accessed into and from different data memory locations, and the Top End Zone start point is determined by subtracting (instead of adding as is done in BOTZONE) End Zone Delta from MAX. Also, TOPZONE is terminated after the first test at step 864 if the Present Position, that is potentially a new MAX, is not above the stroke midpoint. That allows the system to avoid unintentional "short stroke" and similar situations that could produce a false MAX.

The code segment flow-charted in FIG. 7X is SEND, which controls the transmission of data to the externally attached personal computer 434. The SEND routine makes use of the data memory locations 75 and 98. Location 75 is used as the data source for the COMM routine that handles the transmission of data to the externally attached personal computer 434 (see FIG. 7A1-12)—data is put into the memory location 75 by the SEND routine. The data memory locations 76 through 98 are set up via data received by the disclosed invention from the externally attached personal computer 434, under control of the "Z" command (see FIG. 7A1-3).

In operation, the data memory location 76 contains the count of the number of data memory locations, 77 through 98, which are to be acted upon. The SEND routine uses the content of the data memory location 76 to control the number of data transmission loops to be executed. The data memory locations 77 through 98 contain pointers to other data memory locations the contents of which are to be transmitted to the externally attached personal computer 434. The microprocessor 402 used in the disclosed invention has a total of 128 data memory locations, addressed as 0 through 127. Therefore, the most significant bit of the pointer (bit 7, contained in the data memory locations 77 through 98) is not required as part of the pointer address. That bit (bit 7) is used to indicate whether the data memory location pointed to is in ASCII form and is to be transmitted as is, or if conversion from Hex to ASCII is required before transmission. Hex to ASCII conversion is done by the COMM routine.

At step 951 in FIG. 7X, the number of locations (77 through 98) that are to be dealt with is retrieved from the data memory location 76 (referred to as COUNTER in the remainder of the flow chart). At step 952, the address pointer (referred to as POINTER in the remainder of the flow chart) is initialized with the value 76. At step 953, a test is performed to determine if the value of COUNTER is zero (which would mean that no data are to be transmitted to the externally attached personal computer 434). If the result of the test at 953 is affirmative, a return to the calling routine is executed. If the result of the test at 953 is negative, POINTER is incremented by 1, and the byte (BYTE) addressed by POINTER is retrieved from the data memory at step 954. At step 955, bit 7 of the retrieved data (BYTE) is tested to see if its value is binary "1". If the result of the test at step 955 is affirmative, the bit 7 of the BYTE is cleared to zero, at 956, and DATA is retrieved from the data memory location addressed by BYTE at step 957. At 958, Flag 0 is set to 1, and the character to be transmitted (DATA) is put in the data memory location 75.

The COMM routine is called at step 959. The "1" state of Flag 0 notifies the COMM routine that the byte in the data memory location 75 is already in ASCII form, and is to be transmitted "as is". Upon return from the COMM routine, code execution passes to step 963. If the result of the test at 955 is negative, BYTE is used at step 965 as the address from which to get the DATA to be transmitted. At 966, the upper and lower 4-bit nibbles of DATA are swapped, DATA is put into the location 75, and Flag 0 is cleared. The COMM routine is then called at step 960. Upon return from COMM, code execution passes to step 961, where BYTE is again used to retrieve DATA to be sent. The COMM routine is again called at 962. For a single call, the COMM routine sends only one character—either the character in the data memory location 75 "as is," or the lower four bits in the data memory location 75, interpreted as Hex and converted to ASCII. Upon return from the COMM routine, COUNTER is decremented at step 963. At 964, a test is performed to see if the value of COUNTER is zero (which would mean that data transmission is complete). If the result of the test at step 964 is affirmative, a return to the calling routine is executed. If the result of the test at 964 is negative, more data is to be transmitted, and the send data loop is started again at step 954.

The code segment flow-charged in FIG. 7Y encompasses the ACELHIGH and ACELLOW routines. These two routines are shown together, since they both access the same code following the two initial steps at 870 and 871. At step 870 in FIG. 7Y a determination is made as to whether acceleration is positive and direction UP or if acceleration is negative and direction DOWN. If the result at 870 is affirmative, LOOKUP2 is called at step 872. The table lookup routine (LOOKUP2) uses "raw" Acceleration and Segment ID as the arguments, to determine the required modification to "raw" velocity error to account for acceleration. LOOKUP2 puts the result of the table lookup into the data memory location 112. Upon return from the LOOKUP2 routine, at 874, the table value is added to the "raw" velocity error and the result is left in the data memory location 53. A return to the calling routine is then executed.

If the result of the determination at 870 is negative, the LOOKUP2 routine is called at step 873. Upon return from LOOKUP2, a test is performed at 875 to determine if the result of the table lookup is zero. If the result of the test at step 875 is affirmative, a return to the calling routine is executed. If the result of the test at 875 is negative, the value from the table lookup (in the data memory location 112) is subtracted from the "raw" velocity error (in the location 53) and the result is left in the data memory location 53. At step 877, a test is performed to determine if the result of the subtraction at 876 is negative. If the result of the test at step 877 is negative, a return to the calling routine is executed. If the result of the test at 877 is affirmative, the data memory location 53 is set to zero, and a return to the calling routine is executed. At step 871, a test is performed to determine if Acceleration is positive and direction is UP, or if Acceleration is negative and direction is DOWN. If the result of the test is affirmative, the same code execution path is followed that resulted from the negative result at step 870. If the result of the test is negative, the same code execution path is followed the resulted from the affirmative result at step 870.

The single flow chart block shown in FIG. 7Z represents the CLEARCNT routine. The CLEARCNT routine is called to clear Loop Counter 0 or 1. The CLEARCNT routine clears any three consecutive data memory locations, beginning at the data memory location identified in microprocessor register zero (R0).

The single flow chart block shown in FIG. 7A1-1 represents the INCLOOP routine. The INCLOOP routine increments the three Loop Counters kept in the data memory locations 119 through 125. The counter 0 is 24-bits, counter 1 is 24-bits, and counter 2 is 8-bits.

The code segment flow-charted in FIG. 7A1-2 is the PULLDOWN routine. The PULLDOWN routine responds in two different ways, depending upon whether the Constant Velocity or Constant Force mode of the disclosed invention is in operation. At step 881 in FIG. 7A1-2, a test is performed to determine if the Constant Force mode is enabled. If the test at 881 is negative, CURNTSET is called at step 884, with Pull Down Force (data memory location 48) as the force parameter, and the other parameters as shown in step 884. Upon return from the CURNTSET routine, a return to the calling routine is executed.

If the result of the test at step 881 is affirmative, a test is made at 882 to determine if 16.5 millisecond loops have been executed (80 milliseconds) since the last time the CURNTSET routine was called. This timer, and parameters with which CURSET is called, are the way the force release rate is controlled when the Constant Force mode of the disclosed invention is in effect. If the result of the test at step 882 is negative, then CURSET is not called, and a return to the calling routine is executed. If the result of the test at step 882 is affirmative, CURSET is called with Pull Down force as the force parameter, and with the other parameters identified in the data memory location 118. Upon return from CURSET, a return to the calling routine is executed.

The code segment flow-charted in FIG. 7A1-3 implements the COMMAND function of the disclosed invention. The COMMAND routine receives an ASCII character (V, W, X, Z, Y or G) from the externally attached personal computer 434 (PC), echoes (retransmits) the character to the PC, and jumps to a code segment identified by the received character, which, when executed, responds to the command. At step 885 in FIG. 7A1-3, the received character is retrieved from the communications interface (US/ART), that is part of the control processor electronics assembly which forms part of the disclosed invention, used to receive data from and send data to the externally attached personal computer 434. Steps 886 through 891 determine if one of the six valid characters has been received. If the received character is not valid (that is, not one of the allowed six) a return to the calling routine is executed.

At steps 892 through 897, valid received characters are echoed to the PC 434, and the appropriate command execution code segment is entered. At 898 through 903, the commands are executed. At step 898, four Hex digits (two characters) are received and stored. The first two digits represent Static Positive Desired Velocity, and are stored in the data memory location 58. The second two digits represent Static Negative Desired Velocity, and are stored in the data memory location 60. At step 899, four Hex digits (two characters) are received and stored. The first two digits represent Static Positive Maximum Force, and are stored in the data memory location 50. The second two digits represent Static Negative Maximum Force, and are stored in the data memory location 47. At step 900, two characters are received. The first character represents one of 128 data memory locations. The second character is the value to be stored in the designated data memory location. At 901, a string of up to 23 characters are received and stored in consecutive data memory locations. The first character is the count of the number of characters to be received and stored—it is stored in the data memory location 76, and is also saved as a "decrement and jump" counter to determine when all characters have been received. The number of characters, as specified by the first received character, are then received and stored in consecutive data memory locations starting at locations 77, at most, up to location 98.

At step 901*a*, the SEND routine is called. The call to the SEND routine causes the identified register sequence to be sent once each time the "Z" command is executed. That allows the attached personal computer 434 to interrogate data memory locations contained in the processor 402 that is the controller of the disclosed invention (instead of waiting for the data to be transmitted during each measurement and control cycle) as part of an external exercise control and management program. At step 902, two enable/disable control bytes are received and stored in the data memory locations 73 and 74. At step 903, the Ramp ID used by the Force Curve (FRCCRV) mode of operation of the disclosed invention is received and stored in the data memory location 113.

The code segment flow-charted in FIG. 7A1-4 is the STRKRNGE routine. STRKRNGE does two table lookups. The first is to determine End Zone Delta, as a function of total stroke length. The second table lookup is to determine Stroke Length Range (0 through 7), as a function of End Zone Delta. At step 904 in FIG. 7A1-4, address bits 0 through 11 of the desired table address are determined. The address bits 0 through 11 are determined by subtracting MIN (data memory locations 41 and 42) from MAX (locations 43 and 44). The desired 12 address bits are the most significant three Hex digits of the step 904 subtraction result. At 905, the eight most significant address bits (12 through 18) are set to 0000001, binary (01 Hex). At step 906, with the 19 address bits determined, a single byte (two Hex digits) is read from the flash memory table. The End Zone Delta is three hex digits, the most significant two of which are the two digits read from the table, and the least significant of which is set to zero. The result is stored in the data memory locations 62 and 63. That reduces the table size otherwise required by a factor of 16, and produces results with sufficient resolution for the intended purpose (16 positions counts of the disclosed invention position determining mechanism represents approximately 0.06 inches of exercise stroke). At step 907 in FIG. 7A1-4, the least significant 8 address bits (0 through 7) of the next required table lookup are determined. The address bits 0 through 7 are the End Zone Delta byte read from the table at step 906. At 908, the address bits 8 through 18 are set to 00000010100, binary (014 Hex). At step 909 the Stroke Length Range is read (the possible values are 0 through 7), the result is stored in the data memory location 117, and a return to the calling routine is executed.

The code segment flow-charted in FIG. 7A1-5 is the DRVPLUS routine. DRVPLUS is executed because the drive level to the FETs 504, 506 that control current to the DC servomotor 200 that is the force producing element of the instant systems is about to be increased, that is, force is about to be increased. A major function of the DRVPLUS routine is to predict the result of the anticipated motor current increase, and, depending upon the result of the prediction, apply the increase or take a different action. The objective is to avoid making an FET gate drive level change that will cause the force to exceed the Dynamic Positive Maximum Force (DPMF) or Dynamic Negative Maximum Force (DNMF), depending upon whether the direction is positive (UP) or negative (DOWN), respectively.

At step 910 in FIG. 7A1-5, a test is performed to determine if the present direction of the exercise stroke is UP. If the result of the test at 910 is negative (direction is DOWN), the present motor current (force) is subtracted from the Dynamic Negative Maximum Force (which is kept in the data memory location 46). Then, a test is performed at step 919 to determine if the Present Force is above DNMF. If the result of the test at 919 is negative, the LOOKUP1 routine is called at step 920. The LOOKUP1 routine does a table lookup to determine the force change that will result if the planned change in FET drive level is made (LOOKUP1 puts the predicted level change in the data memory location 107). Upon a return from LOOKUP1, a test is executed at step 923 to determine if the predicted force change is less than the difference between the Present Force and DNMF. If the result of the test at step 923 is negative (indicating that the predicted force change will cause the force to exceed DNMF), the CURNTSET routine is called at 924 with parameters that will set the force level to DNMF. Following the return from the CURNTSET routine, a return (from DRVPLUS) is made to the calling routine.

If the result of the test at step 923 is affirmative (indicating that the planned force change will not take the force above DNMF), the computed FET drive change is added to the data memory locations 99 and 100, and 101 and 102, at step 915. Then, a return to the calling routine is executed. If the result of the test at 919 is affirmative (meaning that the force is already above DNMF, which could be caused by a temperature induced drift since the last measurement and control cycle), the CURNTSET routine is called at step 922 to set force to DNMF. Upon a return from CURNTSET, a return to the calling routine is executed. If the result of the test at 910 is affirmative (indicating that the direction is UP), a code segment identical to that just discussed is executed, except that the objective is to keep the force below Dynamic Positive Maximum Force (DPMF).

The code segment flow-charted in FIG. 7A1-6 is the DRVMINUS routine. DRVMINUS is executed because the drive level to the FETs 504, 506 that control current to the DC servomotor 200 that is the force producing element of the disclosed invention is about to be decreased. That is, the force is about to be reduced. A major function of the DRVMINUS routine is to predict the result of the anticipated motor current decrease, and, depending upon the result of the prediction, apply the decrease or take other action. The objective is to avoid making an FET gate drive level change that will cause the force to fall below the Minimum Constant Velocity Force (MCVF, kept in the data memory location 45). At step 926 in FIG. 7A1-6, the Minimum Constant Velocity Force is subtracted from the Present Force. At 932, a test is performed to determine if the Present Force is already below MCVF (which could be caused by a temperature induced drift since the last measurement and control cycle). If the result of the test at step 932 is affirmative, CURNTSET is called at 933 to set the force to MCVF. Upon return from CURNTSET, a return to the calling routine is executed.

If the result of the test at step 932 is negative, LOOKUP1 is called at step 928. The LOOKUP1 routine does a table lookup to determine the force change that will result if the planned change in FET drive level is made (LOOKUP1 puts the predicted level change in the data memory location 107). Upon a return from LOOKUP1, a test is executed at step 929 to determine if the predicted force change is less than the difference between the current force and MCVF. If the result of the test at 929 is negative (indicating that the predicted force change will cause force to fall below MCVF), CURNTSET is called at step 930 with parameters that will set the force level to MCVF. Following the return from the CURNTSET routine, a return (from DRVMINUS) is made to the calling routine. If the result of the test at 929 is affirmative, (meaning that the planned force change will not take the force below MCVF), the computed FET drive change is added to the data memory locations 99 and 100, and 101 and 102, at step 931. A return to the calling routine is then executed.

The two step flow chart in FIG. 7A1-7 represents the OUTPUT routine. At step 934, the OUTPUT routine outputs the contents of the data memory locations 99 and 100 to the Digital-to-Analog converter 406 attached to the gate of FET 504. At step 935, the OUTPUT routine outputs the contents of the data memory locations 101 and 102 to the Digital-to-Analog converter 408 attached to the gate of FET 506. A return to the calling routine is then executed.

The code segment flow-charted in FIG. 7A1-8 is the LOOKUP routine. LOOKUP uses the computed FET drive level change (including a correction/modification to account for acceleration) and the Segment ID as arguments, to retrieve the actual drive level change. The tables accessed by LOOKUP represent the gain function that is part of the feedback loop that attempts to keep the velocity at the desired level, when the Constant Velocity mode of operation is being utilized by the disclosed invention. The use of a separate table for each Segment ID allows the feedback loop gain to be tailored to the requirements of the particular exercise stroke segment being traversed. At step 936 in FIG. 7A1-7, table address bits 0 through 7 are determined. The eight least significant address bits (bits 0 through 7) are the "computed drive level change", kept in the data memory location 53, and which is the difference between the desired/target velocity and the Present Velocity. At step 937, the table address bits 8 through 11 are determined. The address bits 8 through 11 are the stroke Segment ID, which is kept in the data memory location 38. At 938, address bits 12 through 18 are set to zero. At 939, the actual drive level change is read from the table and stored in the data memory location 53. Then, a return to the calling routine is executed.

The code segment flow-charged in FIG. 7A1-9 is the LOOKUP1 routine. LOOKUP1 uses the value produced by LOOKUP as the argument, to determine the anticipated change in force that will result from the planned change in FET drive level. At step 940 in FIG. 7A1-9, the table address bits 0 through 7 are set equal to the value contained in data memory location 53, which is the final drive level change, corrected for Acceleration, Segment ID, etc. At step 941, the table address bits 8 through 18 are set to zero. At 942, the value is retrieved from the table and put in the data memory location 107. A return to the calling routine is then executed.

The code segment flow-charged in FIG. 7A1-10 is the LOOKUP2 routine. LOOKUP2 uses the Acceleration and Segment ID as the arguments, to retrieve a table value representing the magnitude of the influence the Acceleration is allowed have on the velocity error, in computing the FET drive level change required to drive the velocity toward the target value. The use of a separate table for each Segment ID allows the feedback loop gain to be tailored to the requirements of the particular exercise stroke segment being traversed. At step 943 in FIG. 7A1-10, the table address bits 0 through 7 are set equal to the acceleration magnitude, which is kept in the data memory location 36. At step 944, the table address bits 8 through 11 are set equal to the Segment ID, which is kept in the data memory location 38. At step 944, the table address bits 12 through 18 are set to zero. At 946, the value is retrieved from the table and put into the data memory location 112. A return to the calling routine is then executed.

The code segment flow-charted in FIG. 7A1-11 is CURSET. CURSET is a short routine that is positioned in front of, and flows into, CURNTSET. Accessing CURNTSET via a call to CURSET allows the calling routine to deliver the address of the parameters required by CURNTSET, instead of the parameters themselves (with the exception of the desired current/force level, which is always contained in the data memory location 103). The CURSET routine retrieves a byte from the data memory location identified in working register R2, and delivers the required three parameters to CURNTSET (number of loops allowed, amount to add, and complement of amount to subtract) in working registers R2, R3, and R4. At step 947 in FIG. 7A1-11, the 8-bit byte from the data memory location pointed to by R2 is retrieved. At 948, the bits 4 through 7 of the retrieved byte are put into R2 as bits 0 through 3. At 949, the bits 2 and 3 of the retrieved byte are put into R3 as bits 0 and 1, and 1 is then added to R3. The addition is necessary to address the fact that the four possible states, 0 through 3, of the bits 2 and 3 are used to represent the four states 1 through 4, for use by the CURNTSET routine. At step 950, the bits 0 and 1 of the retrieved byte are put into R4 as bits 0 and 1, and 1 is then added to R4 (the addition is for the same reason described for R3). Code execution then flows into the CURNTSET routine, which "expects" values in R2, R3, and R4.

The code segment flow-charted in FIG. 7A1-12 is COMM. The COMM routine transmits a single character (contained in the data memory location 75) to the externally attached personal computer 434. If Flag 0 is set, the bits 0 through 3 of the data memory location 75 are converted from Hex to ASCII, and the resulting ASCII character is transmitted. If Flag 0 is clear, the character contained in the data memory location 75 is transmitted "as is." At step 967 in FIG. 7A1-12, Flag 0 is tested to see if it is set to "1". If the result of the test at 967 is affirmative, code execution passes to step 968, where the bits 0 through 3 of the data memory location 75 are converted from Hex to ASCII, and the ASCII character is put into the data memory location 75. At 969, the byte in the data memory location 75 is output to the US/ART that is the asynchronous, RS-232 data transmission interface 428 between the disclosed invention and the externally attached personal computer 434. If the result of the test at step 967 is negative, code execution passes directly to 969, and the byte in the data memory location 75 is transmitted "as is."

The code segment flow-charted in FIG. 7A1-13 is PSCONTRL) Power Supply Control). The PSCONTRL routine controls the output level of the DC power supply 512 that provides power to the DC servo control motor 200. The power supply output voltage is controlled to keep the total loop voltage available to drive the servo control motor 200 relatively constant. That minimizes power dissipation in the FETs 504, 506 that control the servo motor current, and greatly improves the smoothness of control produced by the control algorithms of the disclosed invention.

During the positive half of the exercise stroke, the back-EMF of the servo motor 200 adds to the power supply voltage, and on the negative half of the exercise stroke, the back-EMF of the servo motor 200 subtracts from the power supply voltage. That being the case, the output level of the DC power supply 512 is decreased during the positive portion of the exercise stroke, and increased during the negative portion of the stroke, to maintain the total voltage at approximately 35 volts. The values contained in the table used by the PSCONTRL routine are formulated to inherently incorporate the conversion from the measured velocity (measured by the control processor 402) to the D/A drive level required to produce the required DC power supply output voltage level.

At step 1002 in FIG. 7A1-13, the 19-bits of the power supply control table address are generated as follows: the bits 0–6 are the Present Velocity shifted one place to the right; the bit 7 is a binary "1" if direction is up, and a "0" if direction is down; the bits 8–15 are "15" Hex; and the bits 16–18 are binary "0". At step 1003, the value is read from the table, and at 1004 the table value is output to the D/A converter 440 that is part of the interface to the DC power supply 512 (see block diagram at FIG. 4). A RETURN to the calling program is then executed.

The code segment flow-charted in FIGS. 7A1-14 and 7A1-15 is the FRCCRV (Force Curve) routine. The FRCCRV code segment accommodates eight (0–7) Stroke Length Ranges, addressing stroke lengths between 16.5 and 40.5 inches, in 3 inch increments (i.e., range 0 applies to stroke lengths between 16.5 and 19.5 inches, range 1 applies to stroke lengths between 19.5 and 22.5 inches, etc.). At each position in the exercise stroke (force changes are made at approximately one-quarter inch intervals) the FRCCRV algorithm sets the force/weight to a value that is the sum of the "base" force setting, a "ramp value" read from the ramp table (at step 976 in FIG. 7A1-14), and an adjustment for the acceleration (if the acceleration function is enabled), read from the acceleration table at step 980 in FIG. 7A1-15. An objective of the FRCCRV routine is to never allow a position value beyond the "bottom end" of the ramp table to be utilized in setting the force/weight as a function of position. Such an occurrence would cause a value from an adjacent table to be read (probably atop, as opposed to bottom end When the exercise apparatus is at rest at the bottom of the stroke, the MINMAX routine (see FIG. 7A1-16) computes a minimum position that is the bottom stopped position. Therefore, on the first exercise stroke of the Force Curve mode of operation of the disclosed invention, the first position read when movement is first initiated will be slightly above the minimum point, and the stroke will proceed properly. That is, at step 970 in FIG. 7A1-14, the position will be above MIN (the currently recorded minimum point). On exercise strokes after the first stroke, the rest position will never be reached, and the minimum point will be translated up, with the amount of the translation dependent upon how the particular user does the exercise. At step 970 in FIG. 7A1-14, a test is performed to see if the Present Position is above MIN. If the result of the test at 970 is negative, an additional test is performed at step 971 to determine if the "below MIN" condition has persisted for 255 measurement and control cycles (1.275 seconds), which is taken to mean that the exercise has been completed and the device has come to rest in the bottom stopped position.

If the result of the test at step 971 is positive, CURNTSET is called at 974, with parameters that will set the force/weight at the PULLDOWN value of approximately 5 pounds. If the test at step 971 is negative, the parameter "A" is set to zero. That ultimately causes the value from the zero position of the ramp table to be read. If the result of the test at 970 is positive, the "Position Below MIN" counter is cleared and A is set equal to the Present Position minus MIN. At step 975, the "ramp table" address is computed and the addressed value is retrieved from the table at step 976. At 977 in FIG. 7A1-14, the parameter "F" is set to the value retrieved from the ramp table plus the current base force setting (in the data memory location 49 in the control processor), and code execution passes to step 978 in FIG. 7A1-15. At 978, a test is performed to determine if the acceleration function is enabled. If the result of the test at step 978 is negative, CURSET is called at 982, with a force setting of F and loop parameters contained in the data memory location 126. If the result of the test at step 978 is positive (meaning that acceleration is enabled), the acceleration table address is computed at step 979 and the addressed value is retrieved from the table at 980. At step 981, the parameter F is set to F plus the value read from the table, and CURSET is called at 982 with a force setting of F and loop parameters as contained in the data memory locations 126. Upon a return from CURSET, a jump to RETR is executed.

The code segment flow charted in FIG. 7A1-16 is the MINMAX routine. The MINMAX routine computes five exercise stroke related parameters that are used extensively by the Constant Velocity and Force Curve modes of operation of the disclosed invention: MIN (minimum position), MAX (maximum position), Bottom End Zone start point, Top End Zone start point, and, because of "calls" from the BOTZONE and TOPZONE routines, Stroke Length Range (STRKRNGE). At step 983 in FIG. 7A1-16, a test is performed to see if Stroke Segment ID is three (3) (Bottom Stopped, SEGID=3). If the result of the test at step 983 is positive, a test is performed at 984 to see if the Bottom Stopped (SEGID=3) condition has persisted for 32 measurement cycles (0.16 seconds). If the result of the test at step 984 is negative, a RETURN to the calling code segment is executed.

If the result of the test at 984 is positive (which would indicate that exercise is not in progress), the BOTZONE routine is called at step 986. Upon return from the BOTZONE routine, a RETURN to the calling code segment is executed. If the result of the test at 983 is negative (indicating that exercise is in progress), a test is executed at step 987 to see if the Present Position is below the nominal stroke midpoint. If the result of the test at 987 is positive (meaning that the position is below the stroke midpoint), a test is performed at step 988 to see if the "Below Midpoint Flag" is set. If the result of the test at 988 is negative, the "Below Midpoint Flag" is set at step 991 and the "Above Midpoint Flag" is cleared. At step 992, MAX (Dynamic Maximum position) is copied into MAX (Maximum point). At step 993, the TOPZONE subroutine is called. Upon a return from TOPZONE, the MAX parameter is initialized to the nominal stroke midpoint value, 1480 Hex, at step 994, and a RETURN to the calling routine is executed.

If the result of the test at 988 is positive, a test is performed at step 989 to see if the Present Position is less that the current value of DMIN. If the result of the test at step 989 is negative (indicating that the Present Position is not less than DIN), a RETURN to the calling routine is executed. If the result of the test at step 989 is positive (meaning that the Present Position is less than DMIN), the Present Position is copied into DIN at step 990, and a RETURN to the calling routine is executed. If the result of the test at step 987 is negative (indicating that the Present Position is above the stroke midpoint), a test is performed at step 995 to see if the "Above Midpoint Flag" is set. If the result of the test at 995 is negative, the "Above Midpoint Flag" is set at step 998 and the "Below Midpoint Flag" is cleared. At 999, DMIN is copied in MIN, and the BOTZONE routine is then called at step 1000. Upon a return from the BOTZONE routine, DIN is initialized to the nominal stroke midpoint value, 1480 Hex, at step 1001, and a RETURN to the calling routine is executed.

If the result of the test at step 995 is positive, a test is performed at 996 to see if the Present Position is greater than MAX. If the result of the test at step 996 is negative (indicating that the Present Position is less than MAX), a RETURN to the calling routine is executed. If the result of the test at 996 is positive (indicating that the Present Position is above MAX), the Present Position is copied in MAX at step 997, and a RETURN to the calling routine is executed.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. A force generation and control system for an exercise machine in which the exercise machine includes a user interface engaged by a user to exercise using said exercise machine, comprising:

an electric motor for use as a force producing element;

a mechanical linkage for mechanically connecting said user interface to said electric motor; and a digital data processor operatively connected to said electric motor for determining the position and direction of movement of said mechanical linkage relative to said electric motor and for operating said electric motor to provide one of forcing movement and resistance to the movement of said mechanical linkage depending on said direction of movement of said mechanical linkage.

2. The force generation and control system of claim 1, wherein said digital data processor further controls the power delivered to said electric motor, whether forcing or resisting movement of said mechanical linkage, depending upon a selected mode of operation and at least one of said position presence of movement and velocity of movement of said mechanical linkage.

3. The force generation and control system of claim 1, wherein said mechanical linkage is connected directly to said electric motor without any gear reduction.

4. The force generation and control system of claim 1, wherein said digital data processor divides an exercise stroke into a plurality of segments and continually determines an absolute position of said mechanical linkage for each segment while said user is exercising using said exercise machine.

5. The force generation and control system of claim 1, further including a second digital data processor connected to said first digital data processor for transferring data therebetween.

6. An exercise machine having a user interface engaged by a user to perform exercises using said exercise machine, comprising:

an electric motor for use as a force producing element;

a mechanical linkage for mechanically connecting said user interface to said electric motor; and a digital data processor operatively connected to said electric motor, for determining the position and direction of movement of said mechanical linkage relative to said electric motor and for controlling said electric motor to operate as one of a generator or motor depending on said determined position and direction of movement of said mechanical linkage.

7. The force generation and control system of claim 6, wherein said digital data processor further controls the force exerted by said electric motor, whether resisting or forcing movement of said mechanical linkage, dependent on a selected mode of operation and at least one of said position, presence of movement and velocity of movement of said mechanical linkage.

8. The force generation and control system of claim 6, further including a programmable power supply controlled by said digital data processor for supplying power to said electric motor, wherein said programmable power supply is controlled so as to maintain the total voltage available to said electric motor relatively constant, whether said electric motor is forcing or resisting movement of said mechanical linkage.

9. The force generation and control system of claim 6, wherein said digital data processor determines which portion of an exercise stroke said mechanical linkage occupies and its velocity and direction of movement to control the force applied by said electric motor to said mechanical linkage.

10. The force generation and control system of claim 6, wherein said digital data processor automatically establishes dimensions for each portion and direction of an exercise stroke said mechanical linkage occupies based upon the position and direction of movement of said mechanical linkage by said user interface while said user is exercising using said exercise machine.

11. The force generation and control system of claim 6, further including a second digital data processor connected to said first digital data processor for transferring data therebetween.

12. The force generation and control system of claim 1, further including a programmable power supply connected to both said digital data processor and said electric motor for supplying current to said electric motor.

13. The force generation and control system of claim 12, wherein said power supply is controlled by said digital data processor.

14. The force generation and control system of claim 12, further including at least two semiconductor devices connected between said power supply and said electric motor which are used to control said current supplied to said electric motor, under control of said digital data processor.

15. The force generation and control system of claim 14, further including software in said digital data processor which provides real time controlled current sharing and balancing of said at least two semiconductor devices.

16. The force generation and control system of claim 12, further including software in said digital data processor which provides both relative and absolute current and weight control routines for said electric motor.

17. The force generation and control system of claim 16, wherein said software includes modifiable application and release rates for said electric motor current and weight control routines.

18. A force generation and control system for an exercise machine, in which the exercise machine includes a user interface engaged by a user to exercise using said exercise machine, comprising:

an electric motor for use as a force producing element;

a computer controlled, programmable power supply for supplying power to said electric motor;

a mechanical linkage for mechanically connecting said user interface to said electric motor; and a digital data processor operatively connected to said electric motor and said mechanical linkage, for determining the position and direction of movement of said mechanical linkage relative to said electric motor and for controlling the power delivered to said electric motor, whether resisting movement or forcing movement of said mechanical linkage.

19. The force generation and control system of claim 18, wherein said digital data processor further controls the power delivered to said electric motor, whether resisting movement or forcing movement of said mechanical linkage, depending upon a selected mode of operation and at least one of said position, presence of movement and velocity of movement of said mechanical linkage.

20. The force generation and control system of claim 18, wherein the output voltage of said programmable power supply is controlled so as to maintain the total voltage available to said electric motor relatively constant, whether said electric motor is resisting movement or forcing movement of said mechanical linkage.

21. The force generation and control system of claim 18, wherein said mechanical linkage is connected directly to said electric motor without any intervening gear reduction.

22. The force generation and control system of claim 18, wherein said digital data processor determines which portion of an exercise stroke said mechanical linkage occupies and its velocity and direction of movement in order to control the force supplied by said electric motor to said mechanical linkage.

23. The force generation and control system of claim 22, wherein said digital data processor automatically establishes dimensions and absolute position for each portion of an exercise stroke said mechanical linkage occupies based upon the position and direction of movement of said mechanical linkage by said user interface while said user is exercising using said exercise machine.

24. The force generation and control system of claim 18, further including a second digital data processor connected to said first digital data processor for transferring data therebetween.

* * * * *